United States Patent [19]

Nishikawa et al.

[11] Patent Number: 4,952,491

[45] Date of Patent: Aug. 28, 1990

[54] PHOTOGRAPHIC LIGHT-SENSITIVE MATERIAL AND METHOD OF DEVELOPING THE SAME

[75] Inventors: Toshihiro Nishikawa; Shunji Takada, both of Minami-Ashigara, Japan

[73] Assignee: Fuji Photo Film Co., Ltd., Minami-Ashigara, Japan

[21] Appl. No.: 242,351

[22] Filed: Sep. 9, 1988

[30] Foreign Application Priority Data

Sep. 10, 1987 [JP] Japan ..... 62-227338

[51] Int. Cl.[5] ..... G03C 1/02; G03C 1/08; G03C 7/26; G03C 7/32

[52] U.S. Cl. ..... 430/570; 430/543; 430/552; 430/567; 430/568; 430/569; 430/577; 430/581; 430/611

[58] Field of Search ..... 430/569, 570, 567, 543, 430/552, 568, 581, 577, 611

[56] References Cited

U.S. PATENT DOCUMENTS 4,476,220 10/1984 Penfound ..... 430/569

4,783,398 11/1988 Takada et al. ..... 430/569

*Primary Examiner*—Paul R. Michl

*Assistant Examiner*—Thorl Chea

*Attorney, Agent, or Firm*—Burns, Doane, Swecker & Mathis

[57] ABSTRACT

A photographic light-sensitive material comprising, on a support, at least one silver halide emulsion layer containing silver halide grains, wherein at least 50% of the total projected surface area of silver halide grains contained in the silver halide emulsion layer is occupied by tabular grains comprising at least about 50 mol% of silver chloride, the tabular grains having been precipitated in the presence of a dye and having an aspect ratio of at least 2.

29 Claims, 2 Drawing Sheets

PHOTOGRAPHIC LIGHT-SENSITIVE MATERIAL AND METHOD OF DEVELOPING THE SAME

BACKGROUND OF THE INVENTION

1. Field of the Invention

The present invention relates to a color photographic light-sensitive material containing a novel silver halide emulsion and a method of developing the same.

2. Description of the Related Art

Various silver halide photographic light-sensitive materials are put into practical use by utilizing the fact that silver halide crystal grains are sensitive to radiation such as visible light or ultraviolet rays to form a latent image and the latent image is converted into a visible image by development. Examples of a silver halide are silver iodide, silver bromide, silver chloride, and their mixed crystals. In this case, a silver halide to be used is selected in accordance with the application and the required function of a light-sensitive material in which the silver halide is used. For example, silver iodobromide grains having a relatively large grain size are used in a photographing light-sensitive material which must have high sensitivity. To the contrary, silver iodobromide or silver chlorobromide having a small grain size is used in a duplicating or printing light-sensitive material having relatively low sensitivity. A type of silver halide, a shape of crystals, a size of grains, and the like are important factors in determining properties of a silver halide emulsion. This is described in "The Theory of the Photographic Process" by T. H. James, 4th. ed. Macmillan Co. Ltd. New York, 1977, "Die Grundlagen der Photographischen Prozesse mit Silberhalogeniden" by C. Hasse, H. Frieser, and E. Klein, Akademische Verlagsgesellschaft, Frankfurt an Main, 1968, or the like.

Recently, printing and developing times of a printing light-sensitive material have been reduced. Therefore, a strong demand has increasingly arisen for a light-sensitive material which has high sensitivity and can be stably processed. Conventionally, a silver chlorobromide emulsion subjected to sulfur sensitization is practically used as a printing light-sensitive material. However, when a silver chlorobromide emulsion is used, a developing time cannot be reduced because development is significantly restrained by bromide ions released during development. In addition, since these ions are accumulated in a processing liquid, variations in photographic characteristics are increased. Furthermore, since the silver chlorobromide emulsion has low solubility in water, a long fixing time is required. A high silver chloride emulsion having a high silver chloride content and containing substantially no silver iodide is known as a preferable material for reducing a time required for development, bleaching, and fixing steps and for minimizing changes in photographic characteristics caused by variations in processing conditions. In a high silver chloride emulsion, cubic grains having a (100) crystal plane are normally formed. When these grains are chemically sensitized, they tend to cause fog. This fog is significant especially when the grains are subjected to gold sensitization. More specifically, fog poses a practical problem in a color developer having high activity for rapid development. Storage fogging generated when a light-sensitive material is storaged also poses a practical problem. When a high silver chloride emulsion is exposed at high intensity for a short period of time, a reciprocity failure is increased. This is another drawback of a high silver chloride emulsion when it is used as a printing material.

It is known that a high silver chloride emulsion of a regular crystal having a (111) crystal plane can be prepared by a special method. However, researches for such a method are not so many. F. H. Claes et al., Journal of Photographic Science, Vol. 21, Page 39 (1973) reports that silver chloride grains having the (111) crystal plane can be prepared using dimethyl thiourea. However, this report does not refer to a photographic property of the grains. D. Wyrsch reported in International Congress of Photographic Science (Rochester 1978) that grains having the (111) crystal plane can be prepared using a cadmium compound and ammonium. He reported that when photographic sensitivities of grains having the (111) crystal plane and those having the (100) crystal plane are compared with each other using a sulfur sensitizer, the grains having the (100) crystal plane have a slightly higher sensitivity although a large difference is not found. ("JP-A-" means unexamined published Japanese patent application, and "JP-B-" means examined Japanese patent application.) JP-A-55-26589 discloses that silver chloride octanhedral grains having the (111) crystal plane can be obtained in the presence of a merocyanine dye after nuclei are formed in grain formation. However, this patent specification describes only an effectiveness of adding a dye not in an initial stage of grain formation but at a predetermined timing thereof, regardress of a crystal plane or a composition of the grain. Therefore, although it is well known that a high silver chloride emulsion is a preferable material for reducing the time required for the processing steps, it is assumed to be technically difficult to use a high silver chloride light-sensitive material because fog is significant and a high-intensity failure is large when chemical sensitization is sufficiently performed in order to achieve high sensitivity. In addition, fog is naturally increased when gold sensitization is performed in order to improve the high-intensity failure. Therefore, no technique has been achieved to sufficiently perform gold plus sulfur sensitization with a high silver chloride emulsion.

It is well known to those skilled in the art that a so-called tabular grain having a grain size much larger than a grain thickness is preferred in order to increase sensitivity of a silver halide photographic emulsion and to increase sharpness, graininess, and a spectral sensitization efficiency and a coating power of a sensitizing dye.

Silver halide grains having a high silver chloride content (to be referred to high silver chloride grains hereinafter) tend to be cubic grains. Therefore, in order to obtain tabular grains, some techniques must be used. Examples of a method of obtaining high silver chloride tabular grains having a silver chloride content of 50 mol % or more are only a method disclosed in U.S. Pat. No. 4,399,215 in which grains are formed so as not to contain a bromide and an iodide under conditions of a pAg of 6.5 to 10 and a pH of 8 to 10; and a method disclosed in U.S. Pat. No. 4,400,463 in which grains are formed in the presence of an aminoazaindene and peptizer having an thioether bond.

Both of these patent specifications disclose a method of forming silver chloride tabular grains having a high aspect ratio and a large grain size, as can be seen from the examples. An emulsion having a high aspect ratio and a large grain size is advantageous in increasing an amount of a spectral sensitizing dye to be adsorbed in one grain. However, this emulsion is not preferably used in rapid development which is an object of the present invention. In addition, an emulsion having a high aspect ratio and a large grain size is disadvantageous in handling properties such as stress marks and stress desensitization which are essential in tabular grains and therefore is not preferable in practical use.

Furthermore, an increase in surface area of the grains does not lead to an increase in spectral sensitivity. Improving adsorption of a sensitizing dye is an important technique when a high silver chloride emulsion, especially a high silver chloride tabular emulsion is used. Moreover, spectral sensitivity cannot be improved without a technique of overcoming an inefficiency such as desensitization of instinct sensitivity caused when a large amount of a dye is used.

For these reasons, a strong demand has arisen for a high silver chloride grain which has a rapid development aptitude in addition to basic characteristics of, e.g., high sensitivity and less fog and satisfies practical conditions of, e.g., graininess and a response to stress.

SUMMARY OF THE INVENTION

It is a first object of the present invention to provide a silver halide light-sensitive material which has low fog and high spectral sensitivity and can be rapidly processed.

It is a second object of the present invention to provide a silver halide light-sensitive material which has a high sensitivity, can be rapidly processed, and can overcome practical problems such as stress marks and stress desensitization.

It is a third object of the present invention to provide a silver halide light-sensitive material which can achieve a constant quality even when color development and desilvering including bleaching and fixing are rapidly performed by means of continuous development.

It is still another object of the present invention to provide a developing method wherein developing can be performed within two minutes and which can be used for various purposes.

Other objects of the present invention will be apparent from the following description.

It is confirmed that the above objects can be achieved by:

(1) A photographic light-sensitive material comprising, on a support, at least one silver halide emulsion layer containing silver halide grains, wherein at least 50% of the total projected surface area of silver halide grains contained in the silver halide emulsion layer is occupied by tabular grains comprising at least about 50 mol % of silver chloride, the tabular grains having been precipitated in the presence of a dye and having an aspect ratio of at least 2.

(2) A method of developing a photographic light-sensitive material comprising color-developing the photographic light-sensitive material in the presence of a color coupler, the photographic light-sensitive material comprising, on a support, at least one silver halide emulsion layer containing silver halide grains, wherein at least 50% of the total projected surface area of silver halide grains contained in the silver halide emulsion layer is occupied by tabular grains comprising at least about 50 mol % of silver chloride, the tabular grains having been precipitated in the presence of a dye and having an aspect ratio of at least 2.

(3) A photographic light-sensitive material comprising, on a support, at least one silver halide emulsion layer containing silver halide grains, wherein at least 50% of the total projected area of silver halide grains contained in the silver halide emulsion layer is occupied by tabular grains comprising at least about 50 mol % of silver chloride, the tabular grains having been prepared in the presence of a crystal habit controlling amount of a spectral sensitizing dye before and during nucleation and during precipitation of the silver halide grains, and having an aspect ratio of at least 2.

The contents concerning the present invention will be described in detail below.

(1) Tabular High Silver Chloride Grain 1-1. Halogen composition, Inner Structure, and Aspect Ratio As a result of extensive studies, the present inventors have found that the above objects ca be achieved by forming in the presence of at least one dye, grains of a silver halide emulsion in which at least 50% of a total projected surface area of silver halide grains contained are occupied by tabular high silver chloride grains consisting of at least 50 mol % of a chloride and having a ratio between a sphere-equivalent diameter of a projected surface area and a grain size of two or more.

The silver chloride content of the tabular high silver chloride grains of the present invention is 75 mol %, and more preferably, 90 mol % or more.

The rest of the grains consist of silver bromide and/or silver iodide. The content of the silver iodide is 20 mol% or less, and preferably, 10 mol % or less. The tabular grains of the present invention may have a uniform inner crystal structure, differing inner and outer halogen compositions, or a layer structure of three or more layers. Alternatively, a silver halide having a different composition may be bonded by epitaxial bonding. Preferably, a layer substantially not containing silver iodide and mainly consisting of silver bromide is locally present in a position close to the surface of the grain.

In order to form the localized layer mainly consisting of silver bromide, after the high silver chloride grains are formed, a water-soluble silver salt and a water-soluble bromide salt may be added to form a shell, or only a water-soluble bromide salt may be added and thermally ripened. Alternatively, a silver bromide small grain emulsion may be added and ripened.

The localized layer mainly consisting of silver bromide may be formed before washing, before or after chemical sensitization, or before coating. The localized layer is preferably 0.01% to 10 mol %, and more preferably, 0.1 mol % to 3 mol % of the total silver halide amount. The silver bromide content of the localized layer must be larger than an average silver bromide content of the high silver chloride grains. The content of silver bromide is preferably 50 mol % or more, and more preferably, 70 mol % or more. That is, the silver bromide content is larger than the average silver bromide content of the high silver chloride grains by preferably 20 mol % or more, more preferably, 40 mol % or more, and most preferably, 60 mol % or more. The presence of the localized layer can be analyzed by a surface analysis method such as XPS (X-ray Photoelectron Spectroscopy).

A reference of the XPS method is "Spectroscopy of Electron" by Junichi Aihara et al. (Kyoritsu Library 16, Kyoritsu Shuppan, 1978).

In an emulsion containing the high silver chloride tabular grains of the present invention, 50% or more of a total projected area of the silver halide grains present in the emulsion are occupied by high silver chloride tabular grains having a ratio between a circle-equivalent diameter of the projected area of the grain to a grain thickness (called an aspect ratio) of two or more.

The high silver chloride tabular grains having an aspect ratio of two or more preferably occupy 70% or more, and more preferably, 90% or more of the total projected area.

An average aspect ratio (a number-averaged aspect ratio) of the high silver chloride tabular grains having an aspect ratio of two or more, preferably falls within the range of 3 to 10, more preferably, 3 to 8, still more preferably, 5 to 8, and most preferably, 5 to 7.

If a large number of grains having an aspect ratio of less than two are present, the spectral sensitivity is low. If a large number of grains having an aspect ratio of 10 or more are present, development progresses slowly, and practical problems such as a problem of pressure property may be posed.

In the present invention, an average diameter of the tabular silver halide grains is preferably 0.5 to 3.0 μm.

An average thickness of the tabular silver halide grains is preferably 0.3 μm or less, and more preferably, 0.2 μm or less.

In general, the tabular silver halide grain has two parallel surfaces, and therefore a "thickness" in the present invention is represented by a distance between the two parallel surfaces constituting the tabular silver halide grain.

A weight-averaged volume of the grains is preferably 2 $\mu m^3$ or less and, more preferably, falls within the range of 0.8 $\mu m^3$ (inclusive) to 0.01 $\mu m^3$ (inclusive).

The weight-averaged volume ($\bar{V}$) is represented as follows:

$$\bar{V}=\Sigma(n_iV_i)V_i/\Sigma n_iV_i$$

$n_i$: number of grains
$V_i$: volume of grain 1-2. Crystal Habit

The tabular high silver chloride grains of the present invention are preferably formed in the presence of one or more of the crystal habit control agents. A preferable example of the crystal habit control agent is a colorless compound represented by the following formula (I) or (II) which facilitates formation of the tabular grains by promoting or restricting generation of a predetermined surface of the grain. These compounds and a method of using the same are also described in JP-A-63-25643, page 242, lower-left column to page 245, lower-right column, and JP-A-63-41845, page 255, upper-left column to page 257, lower-left column, filed by the present inventors.

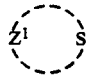
(I)

In formula (I), $Z^1$ represents an atom group required for forming a saturated or unsaturated heterocyclic ring together with a sulfur atom. This heterocyclic ring may have one or more substituting groups.

This atom group represented by $Z^1$ preferably comprises carbon, nitrogen, oxygen, and sulfur atoms. A heterocyclic ring formed by $Z^1$ and the sulfur atom is a 3- to 8-membered ring and may be condensed together with another ring to form a condensation ring.

The compound represented by formula (I) is preferably a colorless compound and does not have an absorption peak with a molecular absorbance coefficient of $10^3 l \cdot mol^{-1} \cdot cm^{-1}$ or more in a visible region (400 to 700 nm).

More specifically, examples of a heterocyclic ring which can be formed are thiirane, thiethane, thiane, thiepine, thiocyne, dihydrothiorane, thiophene, dihydrothiopyrane, 4H-thiopyrane, 2H-thiopyrane, 1,3-thiazylisine, thiazole, 1,3-oxathiorane, 1,3-dithiorane, 1,3-dithiolene, 1,4-oxathiane, 1,4-thiazane, and 1,3-thiazane, and examples of a heterocyclic condensed ring are benzothiorane, benzothiane, benzothiadilysine, and benzooxathiane.

Examples of substituting groups (to be referred to as R hereinafter) of a heterocyclic ring formed by $Z^1$ and the sulfur atom are a halogen (fluorine, chlorine, or bromine), alkyl (preferably the number of carbon atoms is 1 to 20), aryl (preferably the number of carbon atoms is 6 to 20), alkoxy (preferably the number of carbon atoms is 6 to 20), aryloxy (preferably the number of carbon atoms is 6 to 20), alkylthio (preferably the number of carbon atoms is 1 to 20), arylthio (preferably the number of carbon atoms is 6 to 20), acyloxy (preferably the number of carbon atoms is 2 to 20), amino (nonsubstituted amino, or secondary or tertiary amino substituted by preferably alkyl having 1 to 20 carbon atoms or aryl having 6 to 20 carbon atoms), carboneamido (preferably alkyl carboneamido having 1 to 20 carbon atoms or arylcarboneamido having 6 to 20 carbon atoms), ureido (preferably alkylureido having 1 to 20 carbon atoms or arylureido having 6 to 20 carbon atoms), carboxyl, carbonate (preferably alkyl carbonate having 1 to 20 carbon atoms or aryl carbonate having 6 to 20 carbon atoms), oxycarbonyl (preferably alkyloxycarbonyl having 1 to 20 carbon atoms or aryloxycarbonyl having 6 to 20 carbon atoms), carbamoyl (preferably alkylcarbamoyl having 1 to 20 carbon atoms or arylcarbamoyl having 6 to 20 carbon atoms), acyl (preferably alkylcarbonyl having 1 to 20 carbon atoms or arylcarbonyl having 6 to 20 carbon atoms), sulfo, sulfonyl (preferably alkylsulfonyl having 1 to 20 carbon atoms or arylsulfonyl having 6 to 20 carbon atoms), sulfinyl (preferably alkylsulfonyl having 1 to 20 carbon atoms and arylsulfonyl having 6 to 20 carbon atoms), sulfonamido (preferably alkylsulfonamido having 1 to 20 carbon atoms or arylsulfonamido having 6 to 20 carbon atoms), sulfamoyl (preferably alkylsulfamoyl having 1 to 20 carbon atoms or arylsulfamoyl having 6 to 20 carbon atoms), cyano, hydroxyl, nitro, oxo, thioxo, imino, and selenoxo. When alkyl to selenoxo groups can be substituted, these groups may be substituted by one or more substituting groups selected from the above substituting groups (R). When two or more substituting groups are present, they may be either the same or different.

Of the compounds represented by formula (I), a preferable one can be represented by following formula (IA).

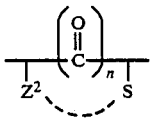
(IA)

In formula (IA), $Z^2$ represents an atom group required for forming a 5- to 6-membered saturated or unsaturated heterocyclic ring together with a sulfur atom and a carbonyl group. This heterocyclic ring may have a substituting group. In this case, the substituting groups on the heterocyclic ring formed by $Z^2$, the sulfur atom, and the carbonyl group are the same as those on the heterocyclic ring represented by formula (I).

In formula (IA), n represents 1 to 3. When n is 2 or 3, the respective carbonyl groups may or may not be adjacent to each other.

Examples of the 5- to 6-membered saturated or unsaturated heterocyclic ring represented by formula (IA) are listed in Table 12 to be presented later. In Table 12, reference symbol R represents a hydrogen atom or an allowable substituting group represented by R described above.

Of the compounds represented by formula (IA), a compound, wherein a carboxyl group is combined with a sulfur atom, and the heterocyclic ring is saturated, is particularly preferred.

Examples of compounds represented by formula (IA) used in the invention are listed in Table 13.

Many of the compounds used in this invention are commercially available, and the other compounds can be synthesized by a method described in U.S. patent application No. 07/065,444 filed on June 23, 1987 by H. Mifune et al.

A compound represented by formula (II) will be described.

$$R_1—S—(X)_m—Y—R_2 \quad \text{(II)}$$

Wherein X represents an organic group having a valency of and constituted by using alkylene, allylene, alkenylene, $$—SO_2—,\ —SO—,\ —O—,\ —\underset{\underset{O}{\|}}{S}—,\ —C—,\ \text{and}\ —\overset{\overset{R^3}{|}}{N}—$$

singly or in a combination. Alkylene, allylene, and alkenylene may have a substituting group, and examples of the substituting group are represented by $R_1$ below.

$R^3$ represents hydrogen, alkyl, or aryl. Alkyl and aryl may have one or more substituting groups.

m represents 0 or 1.

$R_1$ represents hydrogen, alkali metal, alkali earth metal, substituted or nonsubstituted alkyl (preferably the number of carbon atoms is 1 to 20), substituted or nonsubstituted aryl (preferably the number of carbon atoms is 6 to 20), and substituted or nonsubstituted heterocyclic ring group having an N, S, or O atom. Preferable examples of $R_1$ are hydrogen and substituted or nonsubstituted alkyl (preferably the number of carbon atoms is 1 to 5). Examples of the substituting group on $R_1$ are halogen, alkyl, aryl, alkoxy, aryloxy, sulfonyl, sulfonamido, amido, acyl, sulfamonyl, carbamoyl, ureido, alkoxycarbonylamino, aryloxycarbonylamino, alkoxycarbonyl, aryloxycarbonyl, aminocarbonylthio, alkylcarbonylthio, arylcarbonylthio, cyano, hydroxyl, mercapto, carboxy, sulfo, nitro, amino, alkylthio, arylthio, and heterocyclic. Most preferable examples of $R_1$ are hydrogen and substituted or nonsubstituted lower alkyl or phenyl.

$R_2$ represents hydroxyl, substituted or nonsubstituted alkyl, substituted or nonsubstituted aryl, substituted or nonsubstituted heterocyclic ring, substituted or nonsubstituted amino, alkoxy, and aryloxy. As substituting groups on $R_2$, those of $R_1$ can be used. Preferable examples of $R_2$ are hydroxyl, substituted or nonsubstituted alkyl, and substituted or nonsubstituted amino.

Y represents —CO— or —$SO_2$—, and preferably, —CO—.

A total number of carbon atoms of an organic group, X, $R^1$, $R^2$, or $R^3$ including a substituting group portion is preferably 20 or less, respectively.

Examples of the compound represented by formula (II) used in this invention are summarized in Table 14 to be presented later. However, the present invention is not limited to these compounds.

The compounds used in this invention can be synthesized as follows:

For example, thiolcarboxylic acids can be synthesized by hydrolyzing thiolactones. Thiocarbamic acid esters can be easily synthesized by reacting isocyanate with thiol. Isocyanates can be synthesized by a method described in Organic Functional Group Preparations P. 301 (Academic Press). Thiolester can be synthesized by a method described in Chem. Comm., 435 (1969) or Chem. Lett., 187 (1974).

The compound represented by formula (I) or (II) of this invention can be added in an amount falling within the range of $2\times10^{-5}$ mol to $3\times10^{-1}$ mol, and preferably, $2\times10^{-4}$ mol to $1\times10^{-1}$ mol per silver halide mol.

The compound represented by formula (I) or (II) of this invention may be added at any timing before grain formation is finished. However, it is preferred that a part of the compound is present at the start of grain formation.

According to this invention, nucleation (formation of initial grains) is carried out under a chloride concentration of about 0.05 mol/liter or more, preferably 0.10 mol/liter or more, more preferably 0.15 mol/liter or more, and grain formation (precipitation) is continued in the presence of at least one compound represented by formulae (I) or (II).

When the chloride concentration is about 0.15 mol/liter or less during nucleation, regular grains tend to be formed as the concentration is decreased.

In this invention, the chloride concentration during grain formation is preferably 5 mol/liter or less, and more preferably, 0.07 to 3 mol/liter. A temperature during grain formation is 10° to 95° C., and preferably, 40° to 90° C. A pH during grain formation is not limited but preferably falls within the neutral to weakly acidic range. Most preferably a pH range during precipitation is maintained between 2 and 6.

In preparing the silver halide grains of this invention, a silver halide solvent may be used.

Examples of the silver halide solvent are thiocyanate salt, thioether, and thiourea. Also, ammonia can be used as long as it does not adversely affect grain formation.

Examples are thiocyanate salt (e.g., U.S. Pat. Nos. 2,222,264, 2,448,534, and 3,320,069), thioether compound (e.g., U.S. Pat. Nos. 3,271,157, 3,574,628, 3,704,130, 4,297,439, and 4,276,347), thion compound (e.g., JP-A-No. 53-144319, JP-A-No. 53-82408, and JP-A-No. 55-77737), and an amine compound (e.g., JP-A-No. 54-100717).

During formation or physical ripening of the silver halide grains, cadmium salt, zinc salt, lead salt, thallium salt, iridium salt or its complex salt, rhodium salt or its complex salt, or iron salt or its complex salt may be used. Especially, iridium salt or rhodium salt is preferable.

In the manufacture of the silver halide grains of this invention, an addition rate, an addition amount, and an addition concentration of a silver salt solution (e.g., an aqueous $AgNO_3$ solution) and a halide solution (e.g., an aqueous NaCl solution), both solution being added in order to promote grain formation, are preferably increased.

Examples of this method are described in British Patent No. 1,335,925, U.S. Pat. Nos. 3,672,900, 3,650,757, 4,242,445, JP-A-No. 55-142329, JP-A-No. 55-158124, JP-A-No. 58-113927, JP-A-No. 58-113928, JP-A-No. 58-111934, and JP-A-No. 58-111936.

1-3. Grain Formation in the Presence of a Dye

The tabular high silver chloride grains of the present invention cannot obtain a high spectral sensitivity which is an object of the present invention unless a dye, preferably a spectral sensitizing dye is added before precipitation formation of the silver halide is completed. The dye may be added to a reactor before or during precipitation formation. Although a total amount of the dye maybe added at a time, it is preferred to add the dye several times during nuclei formation or growth. It is preferred to add the dye at the same time water-soluble silver salt or watersoluble halogen salt is added thereto. It is also preferred to add two or more types of the dye before precipitation formation is completed. The dye(s) is/are preferably added after it is dissolved in water or a suitable organic solvent or dispersed in gelatin.

An addition timing of the dye is a very important factor for the high silver chloride tabular grains of the present invention. Although the dye must be added before precipitation formation of the silver halide is completed, the following addition methods may also be used. Most ordinarily, the dye is added after chemical sensitization is completed and before coating is performed. However, the dye may be added at the same time a chemical sensitizer is added so that spectral sensitization is performed simultaneously with chemical sensitization as described in U.S. Pat. Nos. 3,6228,969 and 4,225,666, or it may be added before chemical sensitization as described in JP-A-No. 58-113,928. Alternatively, the above compound may be added several times, i.e., part of the compound may be added before chemical sensitization and the rest of the compound may be added thereafter as described in U.S. Pat. No. 4,225,666. That is, as described in, e.g., U.S. Pat. No. 4,183,756, the dye may be added any timing during the silver halide grain formation.

Examples of the dye used upon formation of the tabular silver halide grains of the present invention are methine spectral sensitizing dyes, which include a cyanine dye, a merocyanine dye, a complex cyanine dye, a complex merocyanine dye, a holopolar cyanine dye, a hemicyanine dye, a styryl dye, and a hemioxonol dye. These dyes are generally known as spectral sensitizing dye.

Most effective dyes are those belonging to cyanine dye, merocyanine dye, and complex merocyanine dye. Any nucleus normally used in the cyanine dye or the like as a basic heterocyclic ring nucleus can be used in these dyes. Examples of the nucleus are pyrroline, oxazoline, thiazoline, pyrrole, oxazole, thiazole, selenazole, imidazole, tetrazole, and pyridine; nuclei obtained by condensed alicyclic hydrocarbon ring to the above nuclei; and nuclei obtained by condensed aromatic hydrocarbon ring to the above nuclei, i.e., indolenine, benzindolenine, indole, benzoxadole, naphthoxazole, benzothiazole, naphtothiazole, benzoselenazole, benzimidazole, and quinoline. These nuclei may have a substituting group on a carbon atom.

Examples of a nucleus used in the merocyanine dye or the complex merocyanine dye are 5 and 6-membered ring nuclei having a ketomethylene structure such as a pyrazoline-5-one, thiohydantoin, 2-thiooxazolidine2,4-dione, thiazolidine-2,4-dione, rhodanin and thiobarbituric acid.

For example, the compounds described in Research Disclosure, Item 17643, Page 23, Section IV (Dec. 1978) or the compounds described in the references cited therein can be used.

A typical example is the following methine dye.

Formula [IIIa]

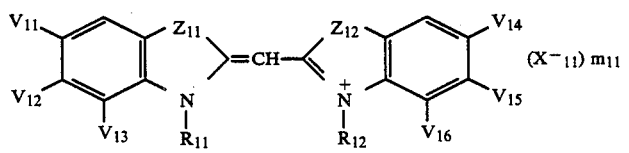

In the above formula, $Z_{11}$ represents oxygen, sulfur, or selenium, and $Z_{12}$ represents sulfur or selenium.

$R_{11}$ and $R_{12}$ each represent alkyl or alkenyl which has six carbon atoms or less and may be substituted. At least one of $R_{11}$ or $R_{12}$ represents sulfo-substituted alkyl, and most preferably, at least one of them represents 3-sulfopropyl, 2-hydroxy-3-sulfopropyl, 3-sulfobutyl, or sulfoethyl. Examples of a substituting group are alkoxy having four carbon atoms or less, halogen, hydroxyl, and carbamoyl, phenyl which have eight carbon atoms or less and may be substituted, carboxy, and sulfo and alkoxycarbonyl having five carbon atoms or less. Examples represented by $R_{11}$ and $R_{12}$ are methyl, ethyl, propyl, allyl, pentyl, hexyl, methoxyethyl, ethoxyethyl, phenethyl, 2-p-tolylethyl, 2-p-sulfophenethyl, 2,2,2-trifluoroethyl, 2,2,3,3-tetrafluoropropyl, carbamoylethyl, hydroxyethyl, 2-(2-hydroxyethyl)ethyl, carboxymethyl, carboxyethyl, ethoxycarbonylmethyl, 2-sulfoethyl, 2-chloro-3-sulfopropyl, 3-sulfopropyl, 2-hydroxy-3-sulfopropyl, and 3 or 4-sulfobutyl.

When $Z_{11}$ represents oxygen, $V_{11}$ and $V_{13}$ represent hydrogen, and $V_{12}$ represents phenyl, alkyl having 3 carbon atoms or less or alkoxy having 3 carbon atoms or less or phenyl substituted by chlorine (more preferably, $V_{12}$ is phenyl), and also represents that $V_{11}$ and $V_{12}$ or $V_{12}$ and V13 can be coupled to form a condensed benzene ring. Most preferably, $V_{11}$ and $V_{13}$ represent hydrogen, and $V_{12}$ represent phenyl.

When $Z_{11}$ represents sulfur or selenium, $V_{11}$ represents alkyl or alkoxy each having four carbon atoms or less, or hydrogen, $V_{12}$ represents alkyl having five carbon atoms or less, alkoxy having four carbon atoms or less, chlorine, hydrogen, phenyl which may be substituted (e.g., tolyl, anisyl, and phenyl) or hydroxyl; and $V_{13}$ represents hydrogen and also represents that $V_{11}$ and $V_{12}$ or $V_{12}$ and $V_{13}$ can be coupled to form a condensed benzene ring. More preferably, $V_{11}$ and $V_{13}$ represent hydrogen and $V_{12}$ represents alkoxy having four carbon atoms or less, phenyl, or chlorine; $V_{11}$ represents alkoxy or alkyl each having four carbon atoms or less and $V_{12}$ represents hydroxyl or alkyl having four carbon atoms or less; or $V_{12}$ and $V_{13}$ are coupled to form a condensed benzene ring.

When $Z_{12}$ represents selenium, $V_{14}$, $V_{15}$, and $V_{16}$ represent the same meanings as those represented by $V_{11}$, $V_{12}$, and $V_{13}$ when $Z_{11}$ represents selenium, respectively. When, $Z_{12}$ represents sulfur and $Z_{11}$ represents selenium, $V_{14}$ represents hydrogen, alkoxy having four carbon atoms or less, or alkyl having five carbon atoms or less, $V_{15}$ represents alkoxy having four carbon atoms or less, phenyl which may be substituted (preferably phenyl, tolyl or anisyl), alkyl having four carbon atoms or less, chlorine, or hydroxyl, and $V_{16}$ represents hydrogen and also represents that $V_{14}$ and $V_{15}$ or $V_{15}$ and $V_{16}$ can be coupled to form a condensed benzene ring. More preferably, $V_{14}$ and $V_{16}$ represent hydrogen, $V_{15}$ represents alkoxy having four carbon atoms or less, chlorine, or phenyl, and $V_{15}$ and $V_{16}$ are coupled to form a condensed benzene ring. When both $Z_{11}$ and $Z_{12}$ represent sulfur, $V_{14}$ and $V_{16}$ represent hydrogen, $V_{15}$ represents phenyl which may be substituted (e.g., phenyl and tolyl), and $V_{14}$ represents hydrogen and also represents that $V_{15}$ and $V_{16}$ can be coupled to form a condensed benzene ring. When $Z_{11}$ represents oxygen and $Z_{12}$ represents sulfur, $V_{14}$ and $V_{16}$ represent hydrogen, and $V_{15}$ represents chlorine, phenyl which may be substituted, or alkoxy having four carbon atoms or less and also represents that $V_{15}$ and $V_{16}$ can be coupled to form a condensed benzene ring. More preferably, $V_{14}$ and $V_{16}$ each represent hydrogen and $V_{15}$ represents phenyl, or $V_{15}$ and $V_{16}$ are coupled to represent a condensed benzene ring.

$X_{11}^-$ represents anion residue of acid.

$m_{11}$ represents 0 or 1, and in the case of an inner salt, represents 1.

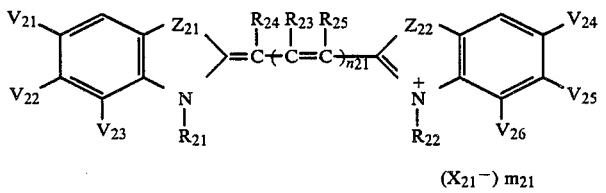

Formula [IIIb]

In the above formula, $Z_{21}$ and $Z_{22}$ may be the same or different and each represent oxygen, sulfur, selenium, or $>N\text{-}R_{26}$.

$R_{21}$ and $R_{22}$ each represent the same meanings as those represented by $R_{11}$ and $R_{12}$ of formula [IIIa], and also represent that $R_{21}$ and $R_{24}$ or $R_{22}$ and $R_{25}$ can be coupled to form a 5 or 6-membered carbon ring. When $n_{21}$ represents 2 or 3, $R_{21}$ and $R_{22}$ do not represent a substituting group having sulfo at the same time.

When at least one of $Z_{21}$ and $Z_{22}$ represents $N\text{-}R_{26}$, $R_{23}$ represents hydrogen, and otherwise, represents lower alkyl or phenethyl (more preferably ethyl). When $n_{21}$ represents 2 or 3, $R_{23}$ represents that different $R_{23}$ and $R_{23}$ can be coupled to form a 5 or 6-membered ring.

$R_{24}$ and $R_{25}$ each represent hydrogen.

$R_{26}$ and $R_{27}$ each represent the same meanings as that represented by $R_{21}$ or $R_{22}$ and also represent that $R_{21}$ and $R_{26}$ do not represent a substituting group having sulfo at the same time and that $R_{22}$ and $R_{26}$ represent a substituting group having sulfo at the same time.

When $Z_{21}$ represents oxygen, $V_{21}$ represents hydrogen. When $Z_{21}$ represents sulfur or selenium, $V_{21}$ represents hydrogen, or an alkyl or alkoxy each having five carbon atoms or less. When $Z_{21}$ represents $>N\text{-}R_{26}$, $V_{21}$ represents hydrogen or chlorine.

When $Z_{21}$ represents oxygen and $Z_{22}$ represents $>N\text{-}R_{27}$, $V_{22}$ represents hydrogen, alkyl or alkoxy, each having five carbon atoms or less, chlorine, or phenyl which may be substituted (e.g., tolyl, anisyl, or phenyl) and also represents that $V_{22}$ can be coupled to $V_{21}$ or $V_{23}$ to form a condensed benzene ring (more preferably, $V_{22}$ represents alkoxy or phenyl, or $V_{21}$ and $V_{22}$ or $V_{22}$ and $V_{23}$ are coupled to form a condensed benzene ring). When $Z_{21}$ and $Z_{22}$ mainly represent oxygen, $V_{22}$ represents phenyl which may be substituted (e.g., tolyl, anisyl, or phenyl, and more preferably, phenyl) or represents that $V_{22}$ can be coupled to $V_{21}$ or $V_{23}$ to form a condensed benzene ring. When $Z_{21}$ represents sulfur or selenium, $V_{22}$ represents hydrogen, alkyl or alkoxycarbonyl, each having five carbon atoms or less, alkoxy or acylamino, each having four carbon atoms or less, chlorine, or phenyl which may be substituted (more preferably, alkyl or alkoxy each having four carbon atoms or less, chlorine, or phenyl) and also represents that $V_{22}$ can be coupled to $V_{23}$ to form a condensed benzene ring. When $Z_{21}$ represents $>N\text{-}R_{26}$, $V_{22}$ represents chlorine, trifluoromethyl, cyano, alkylsulfonyl having four carbon atoms or less, or alkoxycarbonyl having five carbon atoms or less (more preferably, when $Z_{21}$ represents $>N\text{-}R_{26}$, $V_{21}$ represents chlorine, and $V_{22}$ represents chlorine, trifluoromethyl, or cyano).

$V_{23}$ represents hydrogen.

$V_{24}$ represents the same meaning as that represented by $V_{21}$ when $Z_{22}$ represents an atom type corresponding to that represented by $Z_{21}$.

When $Z_{22}$ represents oxygen, $V_{25}$ represents alkoxy having four carbon atoms or less, chlorine, or phenyl which may be substituted (e.g., anisyl, tolyl, or phenyl) or represents that $V_{25}$ can be coupled to $V_{24}$ or $V_{26}$ to form a condensed benzene ring. When $Z_{21}$ represents $>N\text{-}R_{26}$, $V_{25}$ preferably represents alkoxy having four carbon atoms or less or phenyl or represents that $V_{25}$ can be coupled to $V_{24}$ or $V_{26}$ to form a condensed benzene ring. When $Z_{21}$ represents oxygen, sulfur, or selenium, $V_{25}$ preferably represents phenyl or represents that $V_{25}$ can be coupled to $V_{24}$ or $V_{26}$ to form a condensed benzene ring. When $Z_{22}$ represents $>N\text{-}R_{26}$, $V_{25}$ represents the same meaning as that represented by $V_{22}$ when $Z_{21}$ represents $>N\text{-}R_{26}$. When $Z_{22}$ represents sulfur or selenium, $V_{25}$ represents the same meaning as that represented by $V_{22}$ when $Z_{21}$ represents sulfur or selenium.

$V_{26}$ represents hydrogen.

$X_{21}$-represents anion residue of acid.

$m_{21}$ represents 0 or 1, and in the case of an inner salt, represents 0.

$n_{21}$ represents 1, 2, or 3.

Formula [IIIc]

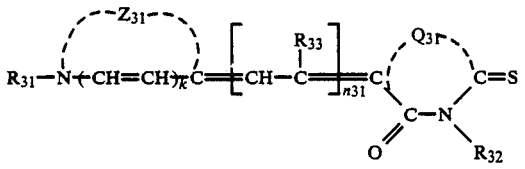

In formula [IIIc], $Z_{31}$ represents an atom group for forming nuclei such as thiazoline, thiazole, benzothiazole, naphtholthiazole, selenazoline, selenazole, benzoselenazole, naphthoselenazole, benzimidazole, naphthoimidazole, oxazole, benzoxazole, naphthooxazole, or pyridine. These heterocyclic nuclei may be substituted. In the case of benzimidazole or naphthomidazole, examples of a substituting group on nitrogen at the 1-position which is not $R_{31}$ are those listed as $R_{26}$ or $R_{27}$ of formula [IIIb]. Examples of a substituting group on a condensed benzene ring of benzimidazole are chlorine, cyano, alkoxycarbonyl having five carbon atoms or less, alkylsulfonyl having four carbon atoms or less, or trifluoromethyl. Preferably, the 5-position is substituted by chlorine, and the 6-position is substituted by cyano, chlorine, or trifluoromethyl. Examples of a substituting group on heterocyclic nuclei other than benzimidazole, selenazoline, and thiazoline nuclei are alkyl having eight carbon atoms or less which may be substituted (examples of the substituting group are hydroxy, chlorine, fluorine, alkoxy, carboxy, alkoxycarbonyl, phenyl, and substituted phenyl), hydroxyl, alkoxycarbonyl having five carbon atoms or less, halogen, carboxy, furyl, thienyl, pyridyl, phenyl, or substituted phenyl (e.g., tolyl, anicyl, and chlorophenyl). Examples of a substituting group on a selenazoline or thiazoline nucleus are alkyl having six carbon atoms or less, hydroxyalkyl and alkoxycarbonylaklyl, each having five carbon atoms or less.

$R_{31}$ represents the same meaning as that represented by $R_{11}$ or $R_{12}$ of formula [IIIa].

$R_{32}$ represents the same meaning as that represented by $R_{11}$ or $R_{12}$ of formula [IIIa], and also represents hydrogen, furfuryl, or monocyclic aryl which may be substituted (e.g., phenyl, tolyl, anicyl, carboxyphenyl, hydroxyphenyl, chlorophenyl, sulfophenyl. pyridyl, 5-methyl-2-pyridyl, 5-chloro-2-pyridyl, thienyl, and furyl), and also represents that at least one of $R_{31}$ and $R_{32}$ is a substituting group having sulfo or carboxy and the other is a group not containing sulfo.

$R_{33}$ represents hydrogen, alkyl having five carbon atoms or less, phenethyl, phenyl, 2-carboxyphenyl, and when n represents 2 or 3, represents that different $R_{33}$ and $R_{33}$ can be coupled to form a 5 or 6-membered ring.

$Q_{31}$ represents oxygen, sulfur, selenium, or $>N\text{-}R_{34}$, and when $Z_{31}$ represents an atom group for forming thiazoline, selenazoline, or oxazole nucleation, preferably represents sulfur, selenium, or $>N\text{-}R_{34}$.

$R_{34}$ represents hydrogen, pyridil, phenyl, substituted phenyl (e.g., tolyl and anicyl), or an aliphatic hydrocarbon group having eight carbon atoms or less which may contain oxygen, sulfur, or nitrogen in a carbon chain and may contain a substituting group such as hydroxyl, halogen, alkyl aminocarbonyl, alkoxycarbonyl, and phenyl, and more preferably, represents hydrogen, phenyl, pyridyl, or alkyl which may contain an oxygen atom in a carbon chain and may contain hydroxyl.

k represents 0 or 1, and $n_{31}$ represents 0, 1, 2, or 3.

Examples of a compound of a spectral sensitizing dye preferably used in the present invention are listed in Table 15 to be presented later.

The amount of the dye may be $1\times10^{-6}$ to $8\times10^{-3}$ mol per mol of the silver halide. However, when a silver halide grain size is more preferable, i.e., 0.2 to 1.2 μm, about $5\times10^{-5}$ to $2\times10^{-3}$ mol is more effective.

The tabular crystal grains are preferably spectrally sensitized by at least one blue spectral sensitizing dye. That is, the tabular crystal silver halide emulsion of this invention is preferably spectrally sensitized in a blue region and used in a blue-sensitized emulsion layer. In this case, the phrase "spectrally sensitized in a blue region" means that a spectral sensitizing dye having at least one absorption peak in the region of 400 to 500 nm, preferably 430 to 490 nm, and more preferably 445 to 490 nm when it is adsorbed to the emulsion grains of this invention is used. Examples of the blue spectral sensitizing dye are compounds represented by formulas [IIIa] and [IIIc] in which $n_{31}=0$. More specifically, examples of the compound are those represented by formulas III-1 to III-8 and III-29 to III-32. In the present invention, tabular, high silver chloride grains are preferably used.

Some spectral sensitizing dyes function as crystal habit control agents. A spectral sensitizing dye having a crystal habit control function can be selected from a cyanine dye, a merocyanine dye, a complex cyanine dye, a complex merocyanine dye, a holopolar cyanine dye, a hemicyanine dye, a styryl dye, and a hemioxonole dye, more preferably a cyanine dye and a merocyanine dye, and most preferably a merocyanine dye. A typical example is a merocyanine dye represented by formula [IIIc]. In Example 7 which is described later, compound III-31 is used.

When the spectral sensitizing dye is used as a crystal habit control agent, at least a portion of the dye must be added before precipitation in order to form tabular grains. Although the dye may be added in a reaction vessel at one time, it is preferred to add the dye in several portions, i.e., before nucleation, during nucleation and/or precipitation. Dyes for controlling the crystal habit and for spectral sensitization may be the same or different.

The photographic light-sensitive material of the present invention comprises a support having thereon at least one silver halide emulsion layer. At least 50% of a total projected area of silver halide grains contained in the silver halide emulsion layer is occupied by tabular grains, prepared in the presence of crystal habit controlling amount of a spectral sensitizing dye before and during nucleation and during precipitation of silver halide grains, comprising at least 50 mole percent of silver chloride, and having an aspect ratio of at least 2.

According to the present invention, nucleation (formation initial grains) are carried out at a chloride concentration of about 0.05 mol/l or more, preferably, 0.10 mol/l or more, and more preferably, 0.15 mol/l or more, and precipitation is continued in the presence of at least one spectral sensitizing dye.

The fact that tabular grains of the present invention are formed in the presence of a dye can be checked by a spectral sensitivity distribution. That is, in a high silver choride emulsion, a sharp spectral sensitivity distribution is generally difficult to be formed. When grain formation is performed in the presence of a dye as in the present invention, a sharp J-band is formed if a methine dye represented by formula [IIIa] or [IIIb] is used, and a sharp monomer band (M-band) is formed when a merocyanine dye represented by formula [IIIc] is used. In either case, a sharp spectral sensitizing distribution can be obtained.

Therefore, grain formation in the presence of a dye can be confirmed in accordance with identification of a peak wavelength, a spectral sensitivity distribution, and the type of dye. Note that the J- and M-bands are described in "The Theory of the Photographic Process" by T. H. James, Section 8, Macmillan Co. Ltd. (1977).

1-4. Chemical Sensitization

The tabular silver halide grains of the present invention should better be chemically sensitized in the presence of a sulfur sensitizer than not sensitized at all. It is more preferable that the grains be chemically sensitized in the presence of a gold sensitizer or sulfur and gold sensitizers.

Chemical sensitization methods are a gold sensitization method using a gold compound (e.g., U.S. Pat. Nos. 2,448,060 and 3,320,069), a sensitization method using a metal such as iridium, platinum, rhodium, or palladium (e.g., U.S. Pat. Nos. 2,448,060, 2,556,245, and 2,566,263), a sulfur sensitization method using a sulfur-containing compound (e.g., U.S. Pat. No. 2,222,264), a selenium sensitization method using a selenium compound, a reduction sensitization method using stannates, thiourea dioxide, or polyamine (e.g., U.S. Pat. Nos. 2,487,850, 2,518,698, and 2,521,925), or a combination of at least two of the above-described methods.

As for the silver halide grains of this invention, gold sensitization, a combination of gold sensitization and sulfur sensitization, or a combination of gold sensitization and reduction sensitization is preferable, and gold-plus-sulfur sensitization is most preferable.

The amount of the gold sensitizer is preferably $5\times10^{-6}$ mol or more per one mol of silver halide, and more preferably $1.5\times10^{-5}$ mol or more. The amount of the sulfur sensitizer used together with the gold sensitizer can be properly selected according to conditions such as a grain size, a chemical sensitization temperature, pAg, and pH and is $10^{-7}$ to $10^{-3}$ mol per one mol of silver halide, preferably $5\times10^{-7}$ to $10^{-4}$ mol per one silver halide mol, and more preferably $5\times10^{-7}$ to $10^{-5}$ mol per one silver halide mol. When gold-plus-sulfur sensitization is to be performed, chemical sensitization is preferably performed in the presence of the sulfur sensitizer and 250 mol % or more (with respect to the sulfur sensitizer) of the gold sensitizer.

Examples of a typical preferable gold sensitizer are a chloroauric acid and chloroaurate. As described in "James' Book", page 155, a gold sensitization effect can be effectively enhanced using thiocyanate salt.

Examples of the sulfur sensitizer used in this invention are sodium thiosulfate, thioureas such as tetramethylthiourea, and rhodanine compound.

This invention is characterized in that chemical sensitization is performed using the gold sensitizer in an amount larger than a normal amount, thereby increasing a sensitivity/fogging ratio and improving reciprocity failure.

The regular crystal silver halide emulsion of this invention may be treated using an oxidizing agent as needed after grain formation. This method is described in JP-A-60-136736 (corresponding European Patent No. 144990A2). Although inorganic and organic oxidizing agents are present, hydrogen peroxide is typical and effective to deactivate an effect of the compound represented by formula (I) or (II) which is added during grain formation. More specifically, hydrogen peroxide can eliminate dye adsorption inhibition, chemical sensitization inhibition, a development restraining effect, or the like which the crystal habit controlling agent represented by formula (I) or (II) obtains after grain formation. The amount of the oxidizing agent is 1/10 to 10 times that in molar ratio of the used crystal habit controlling agent and the silver halide emulsion. The oxidizing agent is preferably used before chemical ripening. A detailed method is described in the patent specifications cited in this paragraph.

1-5. Additives

Adding a compound having a mercapto group to the silver halide emulsion of this invention, can reduce the for of the light-sensitive material, improve the storage stability before exposure, and improve the stability over time of an emulsion coating liquid before light-sensitive material manufacture.

For this purpose, tetrazaindene is normally used, and a mercapto-containing compound must be used in a small limited amount. It is assumed that when the compound is used in an amount below an optimal range, it becomes ineffective, and that when the amount exceeds the optimal range, it adversely affects, e.g., desensitizes. For the above purpose, although unexpected, it is preferable to add the mercapto compound which is assumed to have a strong restraining effect to the emulsion of this invention, resulting in less desensitization and development restraint.

The mercapto-containing compound preferably used in this invention can be represented by formula (IV):

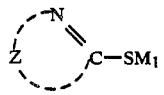

Formula (IV)

In formula (IV), $M_1$ represents hydrogen, cation, or a protective group for mercapto which is cleaved by alkali, and Z represents an atom group required for forming a 5 or 6-membered heterocyclic ring. This heterocyclic ring may have a substituting group or may be condensed. More specifically, $M_1$ represents hydrogen, cation (e.g., sodium ion, potassium ion, and ammonium ion) or a protective group for mercapto (e.g., —COR', —COOR', and —$CH_2CH_2COR'$, wherein R' is hydrogen, alkyl, aralkyl, aryl, and the like) which is cleaved by alkali.

Z represents an atom group required for forming a 5 or 6-membered heterocyclic ring. This heterocyclic ring may contain sulfur, selenium, nitrogen, oxygen, or the like as a heterocyclic atom, may be condensed, or may have a substituting group on a heterocyclic ring or a condensation ring.

Examples of Z are tetrazole, triazole, imidazole, oxazole, thiadiazole, pyridine, pyrimidine, triazine, azabenzimidazole, purine, tetraazaindene, triazaindene, pentaazaindene, benstriazole, benzimidazole, benzoxazole, benzthiazole, benzselenazole, and naphthoimidazole. Examples of a substituting group on the above rings are alkyl (e.g., methyl, ethyl, n-hexyl, hydroxyethyl, and carboxyethyl), alkenyl (e.g., allyl), aralkyl (e.g., benzyl and phenethyl), aryl (e.g., phenyl, naphthyl, p-acetamidophenyl, p-carboxyphenyl, m-hydroxyphenyl, p-sulfamoylephenyl, p-acetylphenyl, o-methoxyphenyl, 2,4-diethylaminophenyl, and 2,4-dichlorophenyl), alkylthio (e.g., methylthio, ethylthio, and n-butylthio), arylthio (e.g., phenylthio and naphthylthio), aralkylthio (e.g., benzylthio), and mercapto. Especially the condensation ring may be substituted by nitro, amino, halogen, carboxyl, or sulfo in addition to the above substituting groups.

An amount of the above mercapto-containing compound is preferably $10^{-3}$ mol or less per mol of the silver halide.

Examples of a nitrogen-containing heterocyclic compound having mercapto are summarized in Table 16.

(2) Light-Sensitive Material 2-1. Color Coupler

In color development of the present invention, a color coupler may be contained in the light-sensitive material or dissolved in a developer. Preferably, the photographic material of the present invention contains at least one yellow coupler, at least one magenta coupler, and at least one cyan coupler. It is preferable to use a nondiffusible color coupler so that the contained coupler is not diffused in a binder even under alkaline conditions. A method of dissolving and dispersing such a color coupler in a small droplet of a lipophilic oil is known to those skilled in the art.

The color coupler used in the present invention will be described below. A color coupler must satisfy general requirements such as a desired hue and a high absorptivity coefficient and must be highly active so that a coupling color forming reaction with the oxidation product of a color developing agent such as a paraphenylenediamine derivative does not become a rate-determining factor, because development of the emulsion used in the present invention progresses fast. In this respect, a coupler represented by formula [IV], [V], [VI], [VII] or [VIII] listed below is preferably used.

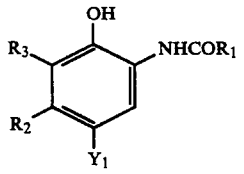

Formula [IV]

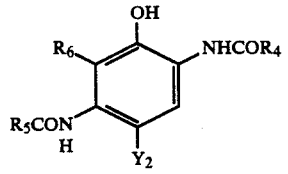

Formula [V]

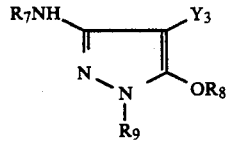

Formula [VI]

-continued

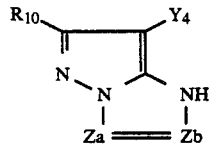

Formula [VII]

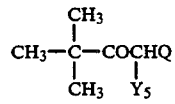

Formula [VIII]

Wherein $R_1$, $R_4$, and $R_5$ each represent aliphatic, aromatic, heterocyclic, aromatic amino, or heterocyclic amino, $R_2$ represents aliphatic, $R_3$ and $R_6$ each represent hydrogen, halogen, aliphatic, aliphatic oxy, or acylamino, $R_7$ and $R_9$ each represent substituted or nonsubstituted phenyl, $R_8$ represents hydrogen, aliphatic or aromatic acyl, or aliphatic or aromatic sulfonyl, $R_{10}$ represents hydrogen or a substituent group, Q represents substituted or nonsubstituted N-phenylcarbamoyl, Za and Zb each represent methine, substituted methine, or =N—, $Y_1$, $Y_2$, and $Y_4$ each represent halogen or a group which can be released during the coupling reaction with the oxidation product of a developing agent, the group being hereinafter referred to as a "releasable group".

$Y_3$ represents hydrogen or a releasable group, $Y_5$ represents a releasable group, and $R_2$ and $R_3$ or $R_5$ and $R_6$ in formulas [IV] and [V] may form 5, 6, and 7-membered rings, respectively.

$R_1$, $R_2$, $R_3$ or $Y_1$; $R_4$, $R_5$, $R_6$, or $Y_2$; $R_7$, $R_8$, $R_9$ or $Y_3$; $R_{10}$, Za, Zb or $Y_4$; or Q or $Y_5$ may form a dimer or higher polymers. It is preferable that $R_5$ and $R_6$ are bonded to form a 5-membered ring, thereby forming a cyan coupler of an oxyindole type or an indazoline-2-on type (U.S. Ser. No. 6,511 filed on Jan. 23, 1987).

More specifically, $R_1$, $R_2$, $R_3$, $R_4$, $R_5$, $R_6$, $R_7$, $R_8$, $R_9$, $R_{10}$, Za, Zb, $Q_1$, $Y_1$, $Y_2$, $Y_3$, and $Y_4$ in formulas [IV], [V], [VI], [VII], and [VIII] are the same as those in formulas (I), (II), (III), (IV), and (V) described in JP-A-63-11939, page 446, lower-left column to page 451, upper-left column.

Examples of these color couplers are (C-1) to (C-40), (M-1) to (M-42), and (Y-1) to (Y-46) described in JP-A-63-11939, page 451, lower-left column to page 464, lower-right column. More preferably, compounds listed in Table 17 to be presented later can be used.

A standard content of the color coupler falls within the range of 0.001 to 1 mol per mol of a light-sensitive silver halide. More specifically, contents of yellow, magenta, and cyan couplers are preferably 0.01 to 0.5 mol, 0.003 to 0.3 mol, and 0.002 to 0.3 mol, respectively.

A coating amount of silver halide in a light-sensitive material in which the color coupler represented by formula [IV], [V], [VI], [VII], or [VIII] is used, is preferably 1.5 g/m$^2$ to 0.1 g/m$^2$ when a reflective support is used, and is preferably 7 g/m$^2$ to 0.2 g/m$^2$ when a transparent support is used.

These couplers can be dispersed and contained in an emulsion layer together with at least one of the high boiling point organic solvents. High boiling point organic solvents represented by formulas (A) to (B) are preferably used;

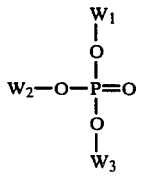

Formula (A)

$W_1—COO—W_2$ Formula (B)

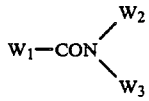

Formula (C)

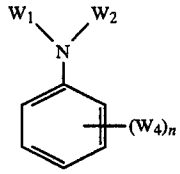

Formula (D)

$W_1—O—W_2$ Formula (E)

wherein $W_1$, $W_2$, and $W_3$ each represent substituted or nonsubstituted alkyl, cycloalkyl, alkenyl, aryl, or heterocyclic ring, $W_4$ represents $W_1$, $OW_1$, or $S-W_1$, and n represents an integer from 1 to 5. When n is 2 or more, $W_4$s may be the same or different. In formula (E), $W_1$ and $W_2$ may form a condensed ring.

2-2. Additives

The light-sensitive material according to the present invention may contain, as an antifoggant or a color mixing inhibitor, hydroquinone derivatives, aminophenol derivatives, amines, gallate derivatives, catechol derivatives, ascorbic derivatives, colorless compound forming couplers, or sulfonamidophenol derivatives.

A conventional decoloration inhibitor can be used in the light-sensitive material of the present invention. Examples of organic decoloration inhibitors are hydroquinones, 6-hydroxychromans, 5-hydroxycoumarans, spirochromans, p-alkoxyphenols, hindered phenols mainly including bisphenols, gallate derivatives, methylenedioxybenzenes, aminophenols, hindered amines, and an ether or ester derivative obtained by silylating or alkylating the phenolic hydroxyl group of the above compounds. A metal complex such as (bissalicylaldoximato) nickel complex or (bis-N,N-dialkyldithiocarbamato) nickel complex can be used.

In order to prevent degradation in a yellow dye image caused by heat, moisture, and light, a compound having partial structures of hindered amine and hindered phenol in a single molecule as described in U.S. Pat. No. 4,268,593 can be effectively used. In order to prevent degradation in a magenta dye image, especially degradation caused by light, spiroindanes described in JP-A-56-159644 and a substituted chromans substituted by hydroquinonediether or monoether described in JP-A-55-89835 can be effectively used.

An image stabilizer described in JP-A-59-125732 can be effectively used especially to stabilize a magenta image formed using a pyrazolotriazole magenta coupler.

In order to improve storage stability, especially lightfastness of a cyan image, it is preferable to use a benzotriazolic ultraviolet absorbent. The ultraviolet absorbent may be emulsified together with a cyan coupler.

The ultraviolet absorbent may be applied in an amount sufficient to give light stability to the cyan dye image. If too much absorbent is applied, a nonexposed portion (white portion) of the color photographic light-sensitive material may turn yellow. Therefore, the content of the ultraviolet absorbent preferably falls within the range of $1\times10^{-4}$ mol/m$^2$ to $2\times10^{-3}$ mol/m$^2$, and more preferably, $5\times10^{-4}$ mol/m$^2$ to $1.5\times10^{-3}$ mol/m$^2$.

In a light-sensitive material layer structure of normal color paper, the ultraviolet absorbent is contained in either of, preferably, two layers adjacent to a cyan coupler-containing red-sensitive emulsion layer. When the ultraviolet absorbent is added in an interlayer between a green-sensitive layer and a red-sensitive layer, it may be emulsified together with a color mixing inhibitor. When the ultraviolet absorbent is added in a protective layer, another protective layer may be formed as an outermost layer. A mixture of a matting agent having any grain size and latex having different grain sizes may be contained in this protective layer.

In the light-sensitive material according to the present invention, the ultraviolet absorbent can be added in a hydrophilic colloid layer.

In the light-sensitive material of the present invention, in addition to the above additives, various stabilizers, pollution inhibitors, developing chemicals or their precursors, development accelerators or their precursors, lubricants, mordants, matting agents, antistatic agents, plasticizers, or other effective additives for the photographic light-sensitive material may be used. Typical examples of the above additives are described in Research Disclosure, No. 17643 (December, 1978) and No. 18716 (November, 1979).

In the light-sensitive material of the present invention, a water-soluble dye may be contained in the hydrophilic colloid layer as a filter dye or in order to prevent irradiation or halation.

The photographic emulsion layer or other hydrophilic colloid layers of the light-sensitive material of the present invention may contain a stilbene type, triazine type, oxazole type, or coumarin type whitener. In this case, the whitener may be water-soluble or a water-insoluble whitener may be used in the form of a dispersion.

2-3. Support

A reflective support which can be used in the present invention preferably increases reflectivity to obtain a clear dye image in the silver halide emulsion layer. Examples of such a reflective support are a support coated with a hydrophobic resin containing a dispersed light reflective material such as titanium oxide, zinc oxide, calcium carbonate, or calcium sulfate and a support of polyvinyl chloride containing a dispersed light reflective material. Examples are baryta paper, polyethylene coated paper, polypropylene synthetic paper, a transparent support having a reflective layer or comprising a reflective material, e.g., a glass plate, a polyester film such as a polyethyleneterephthalate, cellulose triacetate, or cellulose nitrate film, a polyamide film, a polycarbonate film, or a polystyrene film. These supports can be arbitrarily selected in accordance with a purpose. Supports having a mirror reflective surface or a surface having secondary reflectivity as described in JP-A-60-20346, JP-A-63-118154, and JP-A-63-24247 may be used. A transparent support may be also used in the present invention.

2-4. Layer Structure

As described above, the present invention can be applied to a multilayer multicolor photographic material having at least two different spectral sensitivities. A multilayer natural color photographic material normally has at least one of each of red-sensitive, green-sensitive, and blue-sensitive layers on a support. The photographic material of the present invention preferably comprises at least one blue-sensitive silver halide emulsion layer containing a yellow coupler, at least one green-sensitive silver halide emulsion layer containing a magenta coupler, and at least one red-sensitive silver halide emulsion layer containing a cyan coupler. The order of these layers can be arbitrarily selected. Each of the above emulsion layers may consist of two or more emulsion layers having different sensitivities, and a non-light-sensitive layer may be interposed between two or more emulsion layers having the same spectral sensitivity.

In the color light-sensitive material according to the present invention, an auxiliary layer such as a protective layer, an interlayer, a filter layer, an antihalation layer, or a backing layer is preferably formed in addition to the silver halide emulsion layer on the support.

Gelatin can be advantageously used as a binding agent or a protective colloid which can be used as an emulsion layer or an interlayer of the light-sensitive material of the present invention. However, other hydrophilic colloids can be used.

Examples are a protein such as gelatin derivative, graftpolymer of gelatin and another polymer, albumin, and casein; a cellulose derivative such as hydroxyethylcellulose, carboxymethylcellulose, and a cellulose sulfate ester, a suger derivative such as soda alginate, and a starch derivative; and a homopolymer or copolymer such as polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole. That is, various synthetic hydrophilic polymer materials can be used.

Examples of gelatin are lime-processed gelatin, acid-processed gelatin, and oxygen-processed gelatin as described in Bull. Soc. Sci. Phot. Japan. No. 16, page 30 (1966). In addition, a hydrolyzed product or oxygen-decomposed product of gelatin can be used.

2-5. Coating Silver Amount

Another characteristic of the present invention lies in that color development can be rapidly and stably performed. That is, color development can be performed within 3 minutes and 40 seconds, and preferably, within a time shorter than 3 minutes or 2 minutes and 30 seconds. In the present invention, the content of the silver halide is about 1.5 g/m$^2$ or less, and preferably, 1.2 g/m$^2$ or less when a reflective support is used, and is 7 g/m$^2$ or less, and preferably, 5 g/m$^2$ or less when a transparent support is used. When the content of the silver halide is small, not only color development but also desilverizing can be advantageously, rapidly performed.

(3) Developing Method 3-1. Color Developing Agent

An aromatic primary amino type color developing agent used in a color developer of the present invention includes developing agents known to those skilled in the art and widely used in various color photographic processes. These developing agents include aminophenol type and p-phenylenediamine type derivatives. The p-phenylenediamine type derivative is preferred and its typical examples will be listed below. However, the derivative is not limited to the following examples.

D-1 N,N-diethyl-p-phenylendiamine
D-2 2-amino-5-diethylaminotoluene
D-3 2-amino-5-(N-ethyl-N-laurylamino)toluene
D-4 4-[N-ethyl-N-(β-hydroxyethyl)amino]aniline
D-5 2-methyl-4-[N-ethyl-N-(β-hydroxyethyl-)amino]aniline
D-6 N-ethyl-N-(β-methanesulfonamidoethyl)-3-methyl-4-aminoaniline
D-7 N-(2-amino-5-diethylaminophenylethyl)methanesulfonamide
D-8 N,N-dimethyl-p-phenylenediamine
D-9 4-amino-3-methyl-N-ethyl-N-methoxyethylaniline
D-10 4-amino-3-methyl-N-ethyl-N-β-ethoxyethylaniline
D-11 4-amino-3-methyl-N-ethyl-N-β-butoxyethylaniline The above p-phenylenediamine derivatives may be in the form of salts such as sulfate, hydrochloride, sulfite, and p-toluenesulfonate. The above compounds are described in U.S. Pat. Nos. 2,193,015, 2,552,241, 2,566,271, 2,592,364, 3,656,950, and 3,698,525. The content of the aromatic primary amine developing agent is about 0.1 g to about 20 g, and more preferably, about 0.5 g to about 10 g per liter of the developer.

3-2. Color Developer

The color developer used in the present invention can contain hydroxylamines, and N-dialkyl hydroxlyamines.

Although the hydroxylamines can be used in the form of a free amine in a color developer, it is more general to use the hydroxylamines in the form of a water-soluble acid salt. Examples of such a salt are sulfate, oxalate, hydrocloride, phosphate, carbonate, acetate, and the like. The hydroxylamines may be substituted or nonsubstituted, and nitrogen atom of the hydroxylamines may have substituent of alkyl.

The content of hydroxylamine is preferably 0 g to 10 g, and more preferably, 0 g to 5 g per liter of the color developer. A smaller content is preferred as long as stability of the color developer is maintained.

A sulfite such as sodium sulfite, potassium sulfite, sodium bisulfite, potassium bisulfite, sodium metasulfite or potassium metasulfite, or a carbonyl sulfite adduct is preferably contained as a preservative. The content of the above compounds is preferably 0 g to 20 g/l, and more preferably, 0 g to 5 g/l. A smaller content is preferable as long as stability of the color developer can be maintained.

Examples of the preservative are aromatic polyhydroxy compounds described in JP-A-No. 52-49828, JP-A-No. 56-47038, JP-A-No. 56-32140, 59-160142, and U.S. Pat. No. 3,746,544; hydroxyacetones described in U.S. Pat. No. 3,615,503 and British Patent No. 1,306,176; α-aminocarbonyl compounds described in JP-A-No. 52-143020 and JP-A-No. 53-89425; various metals described in JP-A-No. 57-44148 and JP-A-No. 57-53749; various sugars described in JP-A- 52-102727; an α-α'-dicarbonyl compound described in JP-A-No. 59-160141; salicylic acids described in JP-A-No. 59-180588; alkanolamines described in JP-A-No. 54-3532; poly(alkyleneimine)s described in JP-A-No. 56-94349; and a gluconic acid derivative described in JP-A-No. 56-75647. These preservatives may be used singly or in a combination of two or more types. Especially, 4,5-dihydroxy-m-benzenedisulfonic acid, poly(ethyleneimine), and triethanolamine are preferred.

The pH of the color developer used in the present invention falls within the range of, preferably 9 to 12, and more preferably, 9 to 11.0. The color developer may contain a compound of known developer components.

In order to maintain the above pH, it is preferable to use various buffering agents. Examples of the buffering agent are carbonate, phosphate, borate, tetraborate, hydroxybenzoate, glycine salt, N,N-dimethylglycine salt, leucine salt, norleucine salt, guanine salt, 3,4-dihydroxyphenylalanine salt, alanine salt, aminobutyrate, 2-amino-2-methyl-1,3-propanediol salt, valine salt, proline salt, trishydroxylaminomethane salt, and lysine salt. Especially, carbonate, phosphate, tetraborate, and hydroxybenzoate have good solubilities and good buffering properties in a high pH region of pH 9.0 or more, do not adversely affect the photographic property (e.g., fogging) when added to the color developer, and are inexpensive. Therefore, it is most preferable to use these buffering agents.

Examples of such buffering agents are sodium carbonate, potassium carbonate, sodium bicarbonate, potassium bicarbonate, sodium tertiary phosphate, potassium tertiary phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2 hydroxybenzoate (sodium 5-sulfosalicylate), and potassium 5-sulfo-2-hydroxybenzoate (potassium 5-sulfosalicylate). However, the present invention is not limited to these compounds.

The content of the buffering agent to the color developer is preferably 0.1 mol/l or more, and more preferably, 0.1 mol/l to 0.4 mol/l.

In the color developer, various chelating agents may be used as a precipitation inhibitor for calcium or magnesium or in order to improve stability of the color developer.

An organic acid compound is preferable as the chelating agent. Examples of the compound are aminopolycarbonic acids described in JP-A-No. 48-030496 and JP-A-No. 44-30232, organic phosphonic acids described in JP-A-No. 56-97347, JP-B-56-39359, and West German Patent Application (OLS) No. 2,227,639, phosphonocarbonic acids described in JP-A-No. 52-102726, JP-A-No. 53-42730, JP-A-No. 54-121127, JP-A-No. 55-126241, and JP-A-No. 55-65956, and compounds described in JP-A-No. 58-195845, JP-A-No. 58-203440 and JP-B-53-40900. Although the examples are listed below, the compounds are not limited to the following examples.

Nitrilotriacetic Acid
Diethyleneaminepentaacetic Acid
Ethylenediaminetetraacetic Acid
Triethylenetetraminehexaacetic Acid
N,N,N-trimethylenephophonic Acid
Ethylenediamine-N,N,N',N'-tetramethylenephosphonic Acid
1,3-diamino-2-propanol-tetraacetic Acid
Transcyclohexanediaminetetraacetic Acid
Nitrilotripropionic Acid
1,2-diaminopropanetetraacetic Acid
Hydroxyethyliminodiacetic Acid
Glycoletherdiaminetetraacetic Acid
Hydroxyethylenediaminetriacetic Acid
Ethylenediamineorthohydroxyphenylacetic Acid
2-phosphonobutane-1,2,4-tricarbonic Acid
1-hydroxyethane-1,1-diphosphonic Acid
N,N'-bis(2-hydroxybenzyl)ethylenediamine-N,N'-diacetic Acid These chelating agents may be used singly or in a combination of two or more types. These chelating agents need only be added in an amount sufficient to hinder metal ions in the color developer. For example, the content is 0.1 g to 10 g per liter.

An arbitrary development accelerator can be added to the color developer.

Examples of the development accelerator are thioether type compounds described in JP-A-No. 37-16088, JP-A-No. 37-5987, JP-A-No. 38-7826, JP-A-No. 44-12380, JP-A-No. 45-9019, and U.S. Pat. No. 3,813,247; p-phenylenediamine type compounds described in JP-A-No. 52-49829 and JP-A-No. 50-15554, and quaternary ammonium salts described in JP-A-No. 50-137726, JP-A-No. 44-30074, JP-A-No. 56-156826 and JP-A-No. 52-43429; p-aminophenols described in U.S. Pat. Nos. 2,610,122 and 4,119,462; amino type compounds described in U.S. Pat. Nos. 2,494,903, 3,128,182, 4,230,796, and 3,253,919, JP-A-No. 41-11431, and U.S. Pat. Nos. 2,482,546, 2,596,926, and 3,582,346; and polyalkyleneoxides described in JP-A-No. 37-16088, JP-A-No. 42-25201, U.S. Pat. No. 3,128,183, JP-A-No. 41-11431, JP-A-No. 42-23883, and U.S. Pat. No. 3,532,501. In addition, 1-phenyl-3-pyrazolidones, hydrozines, a methoion type compound, a thion type compound, imidazoles, and the like can be added as needed. Especially, the thioether type compound or 1-phenyl-3-pyrazolidones are preferable.

An arbitrary antifoggant can be added to the color developer of the present invention as needed. Examples of the antifoggant are an alkali metal halide such as potassium bromide, sodium chloride, or potassium iodide combined with the compound represented by formula [XXI], [XXII], or [XXIII], and other organic antifoggants.

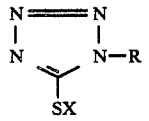

Formula [XXI]

wherein R represents alkyl, alkenyl, or aryl. X represents hydrogen, alkali metal, ammonium, or a precursor. Examples of the alkali metal are sodium and potassium, and examples of ammonium are tetramethylammonium and trimethylbenzyl ammonium. The precursor is a group which can be H or alkali metal under alkaline conditions. Examples of the precursor are acetyl, cyanoethyl, and methanesulfonylethyl.

Of the above Rs, alkyl and alkenyl include nonsubstituted and substituted groups and an alicyclic group. Examples of a substituent group of the substituted alkyl group are halogen, nitro, cyano, hydroxyl, alkoxy, aryl, acylamino, alkoxycarbonylamino, ureido, amino, heterocyclic ring, acyl, sulfamoyl, sulfonamido, thioureido, carbamoyl, alkylthio, arylthio, heterocyclic thio, a carbonic acid group, a sulfonic acid group, and their salts.

Ureido, thioureido, sulfamoyl, carbamoyl, and amino include a nonsubstituted group, an N-alkyl substituted group, and an N-aryl substituted group. Examples of aryl are phenyl or substituted phenyl, and examples of its substituent group are alkyl and the above-mentioned substituent groups on alkyl.

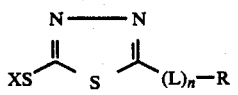

Formula [XXII]

wherein L represents a divalent bond group, R represents hydrogen, alkyl, alkenyl, or aryl. Alkyl and alkenyl of R and X have the same meanings as those of formula [XXI].

Examples of the divalent bond group represented by L are

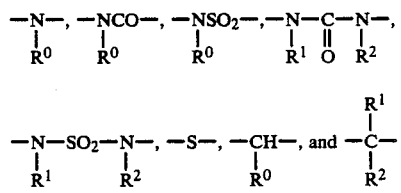

and their combinations.

n represents 0 or 1, and $R^0$, $R^1$, and $R^2$ each represent hydrogen, alkyl, or aralkyl.

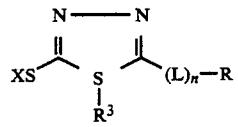

Formula [XXIII]

wherein R and X have the same meanings as those of formula [XXI], and L and n have the same meaning as those of formula [XXII]. $R^3$ has the same meaning as that of R, and they may have the same or different meanings.

Examples of the compounds represented by formulas [XXI], [XXII], and [XXIII] are listed in Table 18. However, the compounds are not limited to the following examples. For example, the compounds described in JP-A-No. 62-269957 page 820, upper-left column to page 824, lower-right column, may be used.

Examples of the organic antifoggant are a nitrogen-containing heterocyclic compound such as benzotriazole, 6-nitrobenzimidazole, 5-nitroisoindazole, 5-methylbenzotriazole, 5-nitrobenzotriazole, 5-chloro-benzotriazole, 2-thiazolyl-benzimidazole, 2-thiazolylmethylbenzimidazole, and hydroxyazaindolizine, a mercapto-substituted heterocyclic compound, represented by a formula other than formula [XXI], [XXII], or [XXIII], such as 2-mercaptobenzimidazole and 2-mercaptobenzothiazole, and a mercapto-substituted aromatic compound such as adenine and thiosalicylic acid. These antifoggants may be eluted from the color light-sensitive material during the process and stored in the color developer. In this case, in order to reduce a discharge amount, a smaller storage amount is preferred.

The color developer of the present invention preferably contains a fluorescent whitening agent. A 4,4-diamino-2,2'-disulfostilbene type compound is preferable as the fluorescent whitening agent. The content of the compound is 0 to 5 g/l, and preferably, 0.1 g to 2 g/l.

Various surface-active agents such as alkylphosphonic acid, arylphosphonic acid, aliphatic carbonic acid, and aromatic carbonic acid can be added as needed.

A process temperature of the color developer in the present invention is preferably 30° C. to 50° C., and more preferably, 33° C. to 42° C. A replenishment amount is 2,000 ml or less, and preferably, 1,500 ml or less per $m^2$ of light-sensitive material. In order to reduce a waste liquor amount, it is preferable that a smaller replenishment amount be used.

In the color developer of the present invention, in order to achieve rapid development by a color developer substantially not containing benzyl alcohol which is disadvantageous in terms of environmental pollution, storage stability of a color image, or generation of a stain, a color developing system may be constituted such that both of a restoring agent for the oxidation product of a color developing agent described in Japanese Patent Application No. 61-259799 and a trapping agent for the oxidation product of the restoring agent are used.

In the present invention, it is preferable that the color developer substantially does not contain iodide ions. In this case, the phrase "substantially does not contain iodide ions" means that the color developer contains not more than 1 mg/l of iodide ions. In addition, in the present invention, it is preferred that the color developer substantially does not contain sulfite ions. In this case, the phrase "substantially does not contain sulfite ions" means that the color developer contains not more than 0.02 mol/l of sulfite ions.

3-3. Desilverizing

The color photographic light-sensitive material of the present invention is desilverized after color development. In this case, a desilverizing process can include at least one of bleaching, fixing, and bleach-fixing (e.g., bleach-fixing; bleaching and fixing; bleaching and bleach-fixing; and fixing and bleach-fixing).

An example of a bleaching agent used in a bleaching solution or a bleach-fixing solution of the present invention is a ferric iron ion complex which is a complex of ferric iron ion and a chelating agent such as aminopolycarbonic acid, aminopolyphosphonic acid, or its salt. Aminopolycarbonate or aminopolyphosphonate is a salt of aminopolycarbonic acid or aminopolyphosphonic acid and an alkali metal, ammonium, or water-soluble amine. Examples of the alkali metal are sodium, potassium, and lithium. Examples of the water-soluble amine are an alkylamine such as methylamine, diethylamine, triethylamine, and butylamine, cycloaliphatic amine such as cyclohexylamine, an arylamine such as aniline and m-toluidine, and a heterocyclic amine such as pyridine, morpholine, and piperidine.

Examples of the chelating agent such as aminopolycarbonic acid, aminopolyphosphonic acid, and their salts are as follows:

Ethylenediaminetetraacetic Acid
Ethylenediaminetetraacetic Acid Disodium Salt
Ethylenediaminetetraacetic Acid Diammonium Salt
Ehtylenediaminetetraacetic Acid
Tetra(trimethylammonium) Salt
Ethylenediaminetetraacetic Acid Tetrapotassium Salt
Ethylenediaminetetraacetic Acid Tetrasodium Salt
Ethylenediaminetetraacetic Acid Trisodium Salt
Diethylenetriaminepentaacetic Acid
Diethylenetriaminepentaacetic Acid Pentasodium Salt
Ethylendiamine-N-(β-oxyethyl)-N,N',N'-triacetic Acid
Ethylenediamine-N-(β-oxyethyl)-N,N',N'-triacetic Acid Trisodium Salt Ethylenediamine-N-(β-oxyethyl)-N,N',N'-triacetic Acid Triammonium Salt
Propylenediaminetetraacetic Acid
Propylenediaminetetraacetic Acid Disodium Salt
Nitrilotriacetic Acid
Nitrilotriacetic Acid Trisodium Salt
Cyclohexanediaminetetraacetic Acid
Cyclohexanediaminetetraacetic Acid Disodium Salt
Iminodiacetic Acid
Dihydroxyethylglycine
Etyletherdiaminetetraacetic Acid
Glycoletherdiaminetetraacetic Acid
Ethylenediaminetetrapropionic Acid
Phenylenediaminetetraacetic Acid
1,3-diaminopropanol-N,N,N',N'-tetramethylenephosphonic Acid
Ethylenediamine-N,N,N',N'-tetramethylenephosphonic Acid
1,3-propylenediamine-N,N,N',N'-tetramethylenephosphonic Acid It is a matter of course that the compound is not limited to the above examples.

A ferric iron ion complex salt may be used in the form of a complex salt or formed in a solution using a ferric iron salt such as ferric iron sulfate, ferric iron chloride, ferric iron nitrate, ferric iron ammonium sulfate, and ferric iron phosphate and a chelating agent such as aminopolycarbonic acid, aminopolyphosphonic acid, and phosphonocarbonic acid. When a ferric iron ion complex salt is used in the form of a complex salt, one or more types of complex salt may be used. When a complex salt is formed in a solution using a ferric iron salt and a chelating agent, one or more types of ferric iron salt may be used. In this case, one or more types of chelating agents may be used. In either case, the chelating agent may be used in an amount larger than that required to form the ferric iron ion complex salt. An aminopolycarbonic acid iron complex is preferable as the iron complex, and its content is 0.01 to 1.0 mol/l, and more preferably, 0.05 to 0.50 mol/l.

An accelerator for bleaching can be used, if necessary, in the bleaching or bleach-fixing solution. Specific examples of the useful accelerator for bleaching are: compounds having a mercapto group or a disulfide group described in U.S. Pat. No. 3,893,858, West German Patent Application (OLS) Nos. 1,290,812 and 2,059,988, JP-A-No. 53-32736, JP-A-No. 53-57831, JP-A-No. 53-37418, JP-A-No. 53-65732, JP-A-No. 53-72623, JP-A-No. 53-95630, JP-A-No. 53-95631, JP-A-No. 53-104232, JP-A-No. 53-124424, JP-A- No. 53-141623, JP-A-No. 53-28426, and Research Disclosure No. 17129 (July, 1978); thiazolidine derivatives described in JP-A-No. 50-140129; thiourea derivatives described in JP-A-No. 45-8506, JP-A-No. 52-20832, JP-A-No. 53-32735, and U.S. Pat. No. 3,706,561; iodides described in West German Patent Application (OLS) No. 1,127,715 and JP-A-No. 58-16235; polyethylene oxides described in West German Patent Application (OLS) Nos. 966,410 and 2,748,430; a polyamine compound described in JP-A-No. 45-8836; compounds described in JP-A-No. 49-42434, JP-A-No. 49-59644, JP-A-No. 53-94927, JP-A-No. 54-35727, JP-A-No. 55-26506, and JP-A-No. 58-163940; and iodide and bromide ions. The compounds having a mercapto group or a disulfide group are preferable due to their excellent acceleration effect. More specifically, the compounds described in U.S. Pat. No. 3,893,858, West German Patent Application (OLS) No. 1,290,812, and JP-A-No. 53-95630 are preferable.

The bleaching solution or the bleach-fixing solution of the present invention may contain rehalogenation agents such as a bromide (e.g., potassium bromide, sodium bromide, and ammonium bromide), a chloride (e.g., potassium chloride, sodium chloride, and ammonium chloride), or an iodide (e.g., ammonium iodide). Further, the bleaching solution or the bleach-fixing solution may contain, if necessary, one or more of inorganic and organic acids, their alkali metals, or their ammonium salts and, having a pH buffering function, such as boric acid, borax, sodium methaborate, acetic acid, sodium acetate, sodium carbonate, potassium carbonate, phosphorous acid, phosphoric acid, sodium phosphate, citric acid, sodium citrate, and tartaric acid, or a corrosion inhibitor such as ammonium nitrate or guanidine.

A fixing agent used in the bleach-fixing or the fixing solution of the present invention is a known fixing agent. Examples of the known fixing agent are water-soluble silver halide solvents such as: a thiosulfate, e.g., sodium thiosulfate and ammonium thiosulfate; a thiocyanate, e.g., sodium thiocyanate and ammonium thiocyanate; a thioether compound, e.g., ethylenebisthioglycolic acid and 3,6-dithia-1,8-octanediol; and thioureas. These compounds may be used singly or in a combination of two or more types. A special bleach-fixing solution consisting of a fixing agent and a large amount of a halide such as iodide, described in JP-A-No. 55-155354 can be used. In the present invention, a thiosulfate, especially, ammonium thiosulfate is preferable.

The content of the fixing agent per liter is preferably 0.3 to 2 mol, and more preferably, 0.5 to 1.0 mol.

In the present invention, the pH of the bleach-fixing or fixing solution preferably falls within the range of 3 to 10, and more preferably, 4 to 9. If the pH of the solution is lower than the minimum value of the range, the desilverizing effect can be improved, but the solution is degraded and the cyan dye is converted to a leuco form. However, if the pH of the solution is higher than the maximum value of the range, desilverizing is delayed and stain tends to occur.

In order to adjust the pH of the solution, hydrochloric acid, sulfuric acid, nitric acid, acetic acid (glacial acetic acid), bicarbonate, ammonia, caustic potash, caustic soda, sodium carbonate, potassium carbonate, or the like can be added to the solution.

The bleach-fixing solution may contain various fluorescent whitening agents, an antifoamer or a surface-active agent, polyvinylpyrrolidone, and an organic solvent such as methanol.

The bleach-fixing and the fixing solutions can contain a sulfite ion releasing compound as a preservative, such as a sulfite (e.g., sodium sulfite, potassium sulfite, and ammonium sulfite), a bisulfite (e.g., ammonium bisulfite, sodium bisulfite, and potassium bisulfite), and a methabisulfite (e.g., potassium methabisulfite, sodium methabisulfite, and ammonium methabisulfite). The content of these compounds is about 0.02 to 0.50 mol/l, and more preferably, 0.04 to 0.40 mol/l as an amount of sulfite ion.

A typical preservative is a sulfite. However, ascorbic acid, a carbonyl bisulfite adduct, or a carbonyl compound may be used.

A buffering agent, a fluorescent whitening agent, a chelating agent, a mildewproofing agent, and the like may be added as needed.

As the bleaching agent of the bleach-fixing solution, it is preferred to use at least one of iron (III) complex salts of ethylenediaminetetraacetic acids, iron (III) complex salts of diethylenetriaminepentaacetic acids, and iron (III) complex salts of cyclohexanediaminetetraacetic acids.

3-4. Washing and Stabilizing

A washing step of the present invention will be described below. In the present invention, a simplified process method in which only a so-called "stabilizing process" without a washing step is performed in place of a conventional "washing process" can be used. That is, the term "washing process" of the present invention is used in a broad sense.

It is difficult to determine an amount of water used in the washing process of the present invention because it varies in accordance with the number of water tanks of multi-stage counter-current washing or an amount of preceding tank components in the light-sensitive material. However, in the present invention, a bleach-fixing solution component in the last washing water tank need be $1\times10^{-4}$ mol/g or less. For example, in 3-tank counter-current washing, water is used in an amount of preferably about 1,000 ml or more, and more preferably, 5,000 ml or more per $m^2$ of the light-sensitive material. In a water-saving process, ion exchanged water, in which amounts of $Ca^{2+}$ and $Mg^{2+}$ ions are reduced to 5 ppm or less, may be preferably used, and an amount of the water is preferably 100 to 1,000 ml per $m^2$ of the light-sensitive material.

A washing temperature is 15° C. to 45° C., more preferably, 20° C. to 35° C.

In the washing process, various known compounds may be added in order to prevent precipitation or to stabilize washing water. For example, a chelating agent such as inorganic phosphoric acid, aminopolycarbonic acid, and organic phosphonic acid; a germicide or an antifungal agent for preventing generation of various bacteria, algae, and fungi (e.g., a compound described in "J. Antibact. Antifung. Agents", Vol. 11, No. 5, PP. 207 to 223 (1983) and a compound described in "Chemistry of Antibacterial and Antifungal Agents" by Hiroshi Horiguchi), a metal salt such as magnesium salt and aluminum salt, an alkali metal salt and an ammonium salt, or a surface-active agent for preventing a dry load or uneveness may be added as needed. A compound described in "Photo. Sci. Eng.", Vol. 6, PP. 344 to 359 (1965) may be added.

The present invention is effective especially when a chelating agent, a germicide, or an antifungal agent is added to washing water and an amount of washing water is largely reduced by multi-stage counter-current washing of two or more water tanks. The present invention is also effective when a multi-stage counter-current stabilizing process step (so-called stabilizing process) as described in JP-A-No. 57-8543 is performed in place of a normal washing step. In these cases, a bleach-fixing solution component in the last water tank need be $5\times10^{-2}$ or less, and preferably, $1\times10^{-2}$ or less.

Various compounds can be added to the stabilizing tank of the present invention in order to stabilize an image. Examples are various buffering agents for adjusting a film pH (e.g., pH 3 to 8) (in this case, borate, methaborate, borax, phosphate, carbonate, potasium hydroxide, sodium hydroxide, ammonium water, monocarbonic acid, dicarbonic acid, polycarbonic acid, and the like are used in combination), and an aldehyde such as formalin. In addition, various additives such as a chelating agent (e.g., inorganic phosphoric acid, aminopolycarbonic acid, organic phosphonic acid, aminopolyphosphonic acid, and phosphonocarbonic acid), a bactericide (e.g., thiazole type, isothiazole type, phenol halide, sulfanylamide, and benzotriazole), a surface-active agent, a fluorescent whitening agent, and a film-hardening agent may be used. In this case, two or more types of compounds having the same or different purposes may be used.

In order to improve an image storage stability, it is preferable to add various ammonium salts such as ammonium chloride, ammonium nitrate, ammonium sulfate, ammonium phosphate, ammonium sulfite, and ammonium thiosulfate as a film pH adjusting agent of a processing solution.

When the amount of washing water is largely reduced as described above, part or all of the overflow liquid of washing water is preferably flowed into a preceding tank i.e. a bleach-fixing water tank or a fixing water tank, in order to reduce a discharge liquid amount.

In this developing process, it is preferred to continuously perform color development using a color developer in which the content of bromide ions is preferably maintained to be $1.0\times10^{-2}$ mol/l or less, and more preferably, $0.5\times10^{-2}$ mol/l or less.

In this developing process, a cycle including color development, desilverizing, washing, and drying can be performed within 120 seconds.

When this processing step is continuously performed, a replenishing liquid of each processing liquid is used to prevent variations in liquid composition, thereby obtaining a constant photofinishing. A replenishment amount can be reduced to be half or less of a standard replenishment amount, whereby the cost of developing the photographic material is lowered.

In each processing tank, a heater, a temperature sensor, a liquid surface sensor, a circulation pump, a filter, various types of a floating cover, various types of squeegees, a nitrogen agitator, an air agitator, and the like may be provided.

Any processing can be applied to the light-sensitive material of the present invention as long as a color developer is used. Examples of processing are those for color paper, color reversal paper, a color positive film, a color negative film, a color reversal film, and the like.

The present invention will be described in detail below by way of its examples. However, the present invention is not limited to these examples.

EXAMPLES

EXAMPLE 1 (Preparation of Emulsion)

Figure 1:
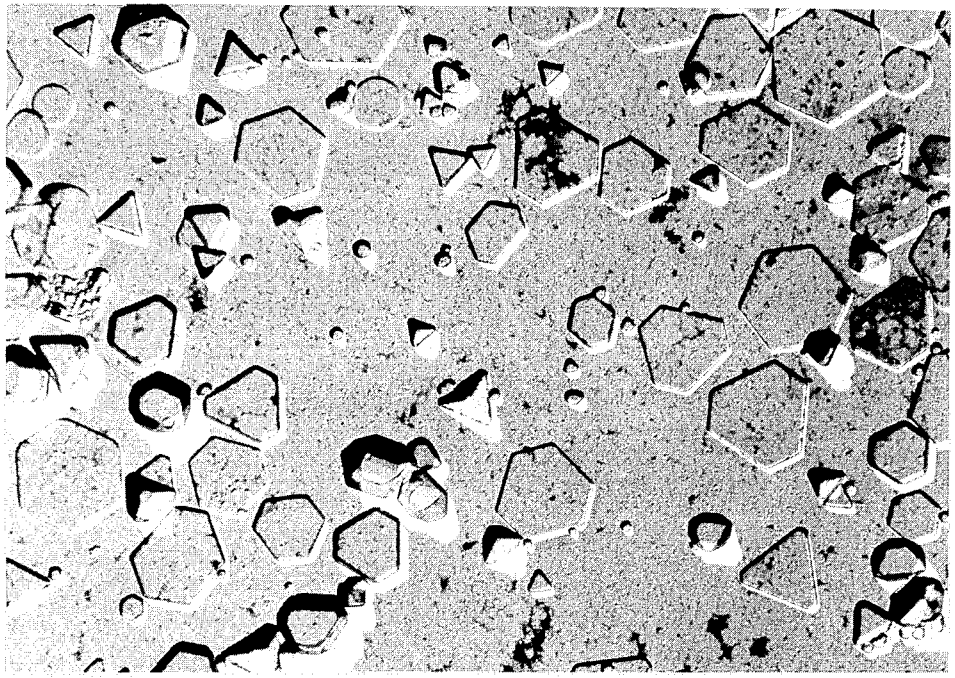
FIG. 1 is an electron microscopic photograph (magnification: 10,000 times) of silver halide grains contained in emulsion B of Example 1.

A silver halide emulsion was prepared as follows.

Solution (1)

| | |
|---|---|
| Solution (1) | |
| Bone Gelatin | 30 g |
| NaCl | 5 g |
| Water | 1000 cc |
| $NH_4NO_3$ | 3 g |
| Solution (2) | |
| $AgNO_3$ | 20 g |
| $NH_4NO_3$ | 0.5 g |
| Water to make | 300 cc |
| Solution (3) | |
| NaCl | 9.9 g |
| Water to make | 300 cc |
| Solution (4) | |
| $AgNO_3$ | 80 g |
| $NH_4NO_3$ | 1 g |
| Water to make | 600 cc |
| Solution (5) | |
| NaCl | 40.8 g |
| Water to make | 600 cc |

1N sulfuric acid was added to solution (1) maintained at 70° C. so that the pH of the solution was adjusted to 5.0. Then, while solution (1) was strongly agitated, solutions (2) and (3) were added at the same time to solution (1) over five minutes.

Solutions (4) and (5) were added at accelerated speeds to the resultant at the same time over 20 minutes so that a final flow rate was set to be three times an initial flow rate, thereby obtaining silver chloride emulsion A.

During grain formation of emulsion A, 0.1 N sulfuric acid was added under control in order to maintain the pH in a reaction tank constant. In addition, while solutions (4) and (5) were added over 20 minutes, solution (6) obtained by dissolving 180 mg of spectral sensitizing dye (III-31) represented by formula [IIIc] in 180 cc of a solution mixture of water and methanol was added at a constant rate over last two minutes.

Dye (III-31)

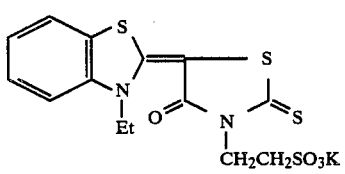

Emulsion A was a monodispersion cubic emulsion having an average volume of 0.30 $\mu m^3$.

An amount of NaCl in solution (1) was adjusted to be 14 g, 1 g of compound (II-22) represented by formula (II) was added to the solution (1), and the pH of the solution was adjusted to be 5.0. Thereafter, while the solution (1) was maintained at 55° C. and was strongly agitated, solutions (2) and (3) were added at the same time over five minutes. Then, solutions (4) and (5) were added at accelerated speeds at the same time to the resultant solution over 30 minutes so that a final flow rate became twice an initial flow rate, thereby obtaining silver chloride emulsion B.

During grain formation of emulsion B, 0.1 N sulfuric acid was added under control in order to maintain the pH in the reaction tank constant. In addition, while solutions (4) and (5) were added over 30 minutes, solution (7) obtained by dissolving 320 mg of a spectral sensitizing dye represented by formula (III-31) in 320 cc of a solution mixture of water and methanol was added at a constant rate over last 10 minutes. Emulsion B had tabular grains, and its weight-averaged volume was 0.25 $\mu m^3$. In emulsion B, tabular grains having an aspect ratio of 2 to 10 occupied about 90% of a total projected surface area, and an average aspect ratio of tabular grains having an aspect ratio of 2 or more was about 7.

FIG. 1 shows an electron microscopic photograph of emulsion B.

An amount of NaCl in solution (1) was adjusted to be 25 g, and 3 g of compound (II-22) were added to the solution (1). Then, while the solution (1) was maintained at 50° C. and was strongly agitated, solutions (2) and (3) were added at the same time over three minutes. Thereafter, solutions (4) and (5) were slowly added at the same time to the resultant over 60 minutes, thereby obtaining silver chloride emulsion C.

During grain formation of emulsion C, 0.1 N sulfuric acid was added under control in order to maintain the pH in the reaction tank constant. In addition, while solutions (4) and (5) were added over 60 minutes, solution (8) obtained by dissolving 360 mg of a spectral sensitizing dye represented by formula (III-31) in 360 cc of a solution mixture of water and methanol was added at a constant rate over last 10 minutes. Emulsion C had thin tabular grains, and its weight-averaged volume was 0.35 $\mu m^3$. In emulsion C, an average aspect ratio of tabular grains having an aspect ratio of 2 or more was 13, and tabular grains having an aspect ratio of 2 to 10 occupied about 25% or less of the total projected surface area.

An amount of NaCl in solution (1) was adjusted to be 14 g, and 1 g of compound (II-22) represented by formula (II) was added the solution (1) so that the pH of the solution was adjusted to be 5.0. Then, while the solution (1) was maintained at 55° C. and was strongly agitated, solutions (2) and (3) were added at the same time over five minutes. Thereafter, solutions (4) and (5) were added at accelerated speeds at the same time to the resultant solution over 30 minutes so that a final flow rate became twice an initial flow rate, thereby obtaining silver chloride emulsion H.

During grain formation of emulsion H, 0.1 N sulfuric acid was added under control in order to maintain the pH in the reaction tank constant.

Emulsion H had tabular grains, and its weight-averaged volume was 0.26 $\mu m^3$. In emulsion H, tabular grains having an aspect ratio of 2 to 10 occupied about 85% of the total projected surface area, and an average aspect ratio of tabular grains having an aspect ratio of 2 or more was about 7.

An amount of NaCl in solution (1) was adjusted to be 25 g, and 3 g of compound (II-22) were added to the solution (1). Then, while the solution (1) was maintained at 50° C. and was strongly agitated, solutions (2) and (3) were added at the same time over three minutes. Thereafter, solutions (4) and (5) were slowly added to the resultant solution at the same time over 60 minutes, thereby obtaining silver chloride emulsion I.

Emulsion I had thin tabular grains, and its weight-averaged volume was 0.36 $\mu m^3$. In emulsion I, an average aspect ratio of tabular grains having an aspect ratio of 2 or more was 13, and tabular grains having an aspect ratio of 2 to 10 occupied about 25% or less of the total projected surface area.

The resultant emulsions were washed by a normal flocculation method and desalted. After gelatin was added to the emulsions, the emulsions were maintained at 40° C. and the pH was adjusted to be 6.4 and the pAg was adjusted to be 7.5. Each emulsion was optimally, chemically sensitized using diphenylthiourea and chloroauric acid. The amounts of chemical sensitizers are listed in Table 1.

Then, 19.1 g of yellow coupler (ExY) together with 4.4 g of color image stabilizer (Cpd-1) were dissolved in a solution mixture of 7.7 ml of solvent (Solv-1) and 27.2 ml of ethylacetate. The resultant solution was emulsified and dispersed in 185 ml of a 10% aqueous gelatin solution containing 8 ml of 10% sodium dodecylbenzenesulfonate, thereby preparing emulsified dispersion (A). Chemical structure of the compounds used are listed in Table 2.

TABLE 2

Yellow Coupler (ExY)

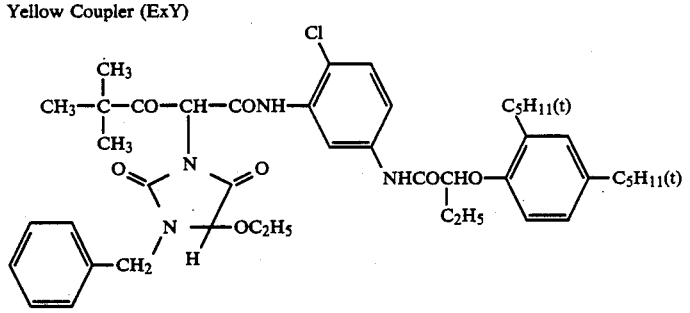

Color Image Stabilizer (Cpd-1)

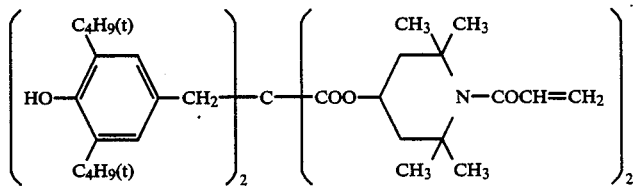

TABLE 3

| Support Both-surface-polyethylene-laminated Paper Support Emulsion coating silver amount 200 mg/m$^2$ | |
|---|---|
| Emulsified Dispersion | |
| Emulsified Dispersion (A) | |
| Yellow Coupler (ExY) | 547 mg/m$^2$ |
| Color Image Stabilizer (Cpd-1) | 127 mg/m$^2$ |
| Coupler Solvent (Solv-1) | 0.293 ml/m$^2$ |

Gelatin was added to the coating liquid so that a gelatin coating amount became 1,500 mg/m$^2$.

Fifteen samples listed in Table 1 having the contents as shown in Table 3 were prepared. Polyethylene at the side on which the emulsion and protective layers were applied contained titanium dioxide and a small amount of ultramarine blue. 1-oxy-3,5-dichloro-s-triazine sodium salt was used as a film hardening agent for each layer.

The following experiment was conducted to examine the photographic properties of these coated samples.

A sensitometric gradation exposure was performed for the coated samples through a blue filter using a sensitometer FWH (available from Fuji Photo Film Co., Ltd.; color temperature of light source: 3,200° K.). In this case, exposure was performed for an exposure time of 1/10 to 1/100 sec to obtain an exposure amount of 250 CMS.

Thereafter, the following color developing process was performed.

| (Process) | (Temperature) | (Time) |
|---|---|---|
| Color Development | 35° C. | 45 sec. |
| Bleaching-Fixing | 35° C. | 45 sec. |
| Washing | 28 to 35° C. | 90 sec. |

| Color Developer | |
|---|---|
| Triethanolamine | 8.12 g |
| N,N-diethylhydroxylamine | 4.93 g |
| Fluoroscence Breaching Agent (UVITEXCK, available from Ciba-Geigy Corp.) | 2.80 g |
| 4-amino-3-methyl-N-ethyl-N-[β-(methanesulfonamido)ethyl]-p-phenylenediamine Sulfate | 4.96 g |
| Sodium Sulfite | 0.13 g |
| Potassium Carbonate | 18.40 g |
| Potassium Bicarbonate | 4.85 g |
| EDTA · 2Na · 2H$_2$O | 2.20 g |
| Sodium Chloride | 1.36 g |
| Water to make | 1,000 ml |
| pH | 10.05 |
| **Bleach-fixing Solution** | |
| Water | 400 ml |
| Ammonium Thiosulfate (70%) | 150 ml |
| Sodium Sulfite | 18 g |
| Ferric Ammonium Ethylenediaminetetraacetate | 55 g |
| Disodium Ethylenediaminetetraacetate | 5 g |
| Water to make | 1,000 ml |
| pH (25° C.) | 6.70 |

Table 1 shows results obtained by measuring the densities of processed samples. The sensitivity is represented by a reciprocal of an exposure amount required to obtain an optical density of Fog +1.0. Each sample was bent at an angle of $\phi=6$ mm before exposure and then exposed and developed to check response to stress (stress desensitization and stress marks). Symbol o represents a level sufficient for practical use; symbol x represent a level not sufficient for practical use; and symbol Δ represent an intermediate level.

As shown in Table 1, photographic characteristics such as fog, sensitivity, and reciprocity failure of the tabular silver chloride emulsions of the present invention were more advantageous than those of the cubic emulsions. In addition, the emulsions according to the present invention satisfied a practically important requirement, i.e., their performances were not so much changed when a light-sensitive material was bent or rubbed.

When a large amount of a gold sensitizer was used, emulsion B exhibited very preferable characteristics, i.e., the sensitivity was increased and the fog was reduced. In addition, the high-intensity reciprocity failure was small.

TABLE 1

| | Sulfur Sensitizer (mol/mol of AgX) | Gold Sensitizer (mol/mol of AgX) | Fog | Photographic Sensitivity 1/10-sec Exposure | Photographic Sensitivity 1/100-sec Exposure | Response to Stress Stress Marks | Response to Stress Stress Desensitization |
|---|---|---|---|---|---|---|---|
| Emulsion A | $4 \times 10^{-6}$ | $3 \times 10^{-6}$ | 0.35 | 8.0 | 5.0 | o ~ x | o |
| Cubic Grain | | $10 \times 10^{-6}$ | 0.40 | 6.0 | 3.5 | | |
| (Comparative | | $30 \times 10^{-6}$ | 0.46 | 5.5 | 3.0 | | |
| Example) | | | | | | | |
| Emulsion B | $4 \times 10^{-6}$ | $3 \times 10^{-6}$ | 0.26 | 35 | 21 | | |
| Tabular Grain | | $10 \times 10^{-6}$ | 0.18 | 70 | 60 | | |
| (Present | | $30 \times 10^{-6}$ | 0.13 | 100 | 95 | o ~ Δ | o |
| Invention) | | | | | | | |
| Emulsion C | $4 \times 10^{-6}$ | $3 \times 10^{-6}$ | 0.24 | 40 | 23 | | |
| Tabular Grain | | $10 \times 10^{-6}$ | 0.19 | 64 | 35 | | |
| (Present | | $30 \times 10^{-6}$ | 0.15 | 81 | 45 | o ~ Δ | o ~ Δ |
| Invention) | | | | | | | |
| Emulsion H | $4 \times 10^{-6}$ | $3 \times 10^{-6}$ | 0.30 | 20 | 16 | | |
| Tabular Grain | | $10 \times 10^{-6}$ | 0.20 | 52 | 40 | | |
| (Comparative | | $30 \times 10^{-6}$ | 0.17 | 60 | 52 | o ~ Δ | o |
| Example) | | | | | | | |
| Emulsion I | $4 \times 10^{-6}$ | $3 \times 10^{-6}$ | 0.28 | 20 | 16 | | |
| Tabular Grain | | $10 \times 10^{-6}$ | 0.22 | 36 | 22 | | |
| (Comparative | | $30 \times 10^{-6}$ | 0.19 | 48 | 36 | o ~ Δ | o ~ Δ |
| Example) | | | | | | | |

Note 1:
In emulsions H and I, a dye (III-31) was added during preparation of a coating sample.

EXAMPLE 2

Emulsions D and E were prepared following the same procedures as for emulsions A and B except that instead of the spectral sensitizing dye represented by formula (III-31), 150 mg and 200 mg of dye (2) represented by formula (IIIb) were added to emulsions D and E, respectively.

dye (2)

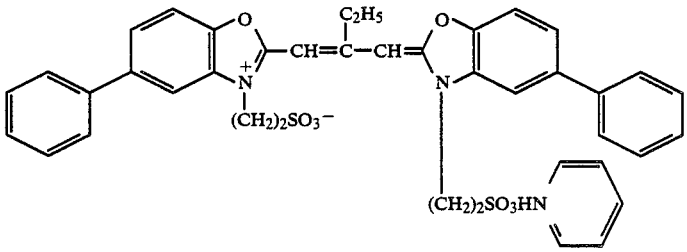

After desalting, the emulsions were chemically sensitized using sodium thiosulfate and chloroauric acid, thereby preparing light-sensitive materials having the contents shown in Table 4 following the same procedures as in Example 1 except that compound IV-9 represented by formula IV was added as a stabilizer.

Compound IV-9

-continued

IV-9

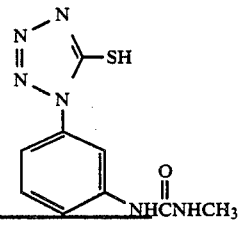

TABLE 4

| Support Both-surface-polyethylene-laminated Paper Support<br>Emulsion coating silver amount 400 mg/m² | |
|---|---|
| Emulsified Dispersion | |
| Emulsified Dispersion B | |
| Magenta Coupler (EXM1) | 350 mg/m² |
| Color Image Stabilizer (Cpd-3) | 280 mg/m² |
| Color Image Stabilizer (Cpd-4) | 133 mg/m² |
| Coupler Solvent (Solv-2) | 0.455 ml/m² |

Gelatin was added to a coating liquid so that a gelatin coating amount became 1,500 mg/m².

Color Image Stabilizer Cpd-3

-continued

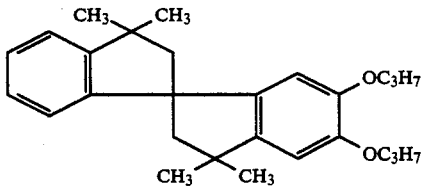

Magenta Coupler
ExM1

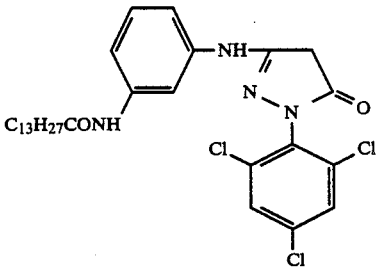

Color Image Stabilizer Cpd-4

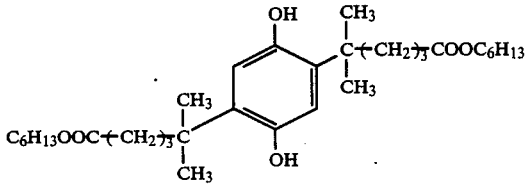

Solvent Solv-2
1:1 mixture (volume ratio) of:

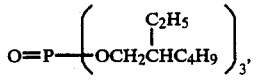

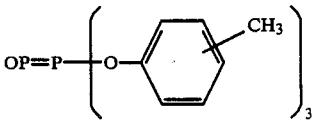

These light sensitive materials were sensitometry-exposed through a green filter and developed following the same procedures as in Example 1. Emulsion E exhibited more preferable photographic characteristics such as the fog, sensitivity, and reciprocity failure than those of emulsion D. In addition, preferable results were obtained for emulsion E when an amount of the gold sensitizer was increased.

EXAMPLE 3

Emulsions F and G were prepared following the same procedures as for emulsions A and B except that 125 mg and 180 mg of a spectral sensitizing dye represented by formula (4) were added to emulsions F and G, respectively. Formula (4)

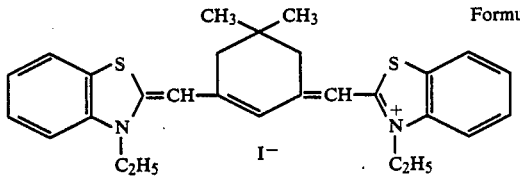

Formula (4)

After desalting, the emulsions were chemically sensitized using sodium thiosulfate, chloroauric acid, and potassium thiocyanate, thereby preparing light-sensitive materials following the same procedures as in Example 1 except that the following cyan coupler was used.

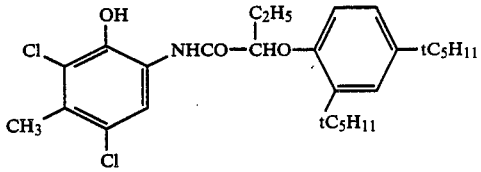

These light-sensitive materials were sensitometry-exposed through a red filter and developed following the same procedures as in Example 1.

Preferable results were obtained for emulsion G in terms of the sensitivity, fog, and reciprocity failure especially when an amount of the gold sensitizer was increased.

EXAMPLE 4

Multilayered color print paper having the following layers was prepared on a paper support on two surfaces of which polyethylene films were laminated.

A coating liquid was prepared by mixing and dissolving emulsions, various chemicals, and emulsified dispersions of couplers. Methods of preparing the coating liquid will be described below.

Preparation of a Coupler Emulsion is as follows: 27.2 cc of ethyl acetate and 7.7 cc of solvent (Solv-1) were added to 19.1 g of a yellow coupler (Ex Y) and 4.4 g of a color image stabilizer (Cpd-1) and these compounds were dissolved. The resultant solution was emulsified and dispersed in 185 cc of a 10% gelatin aqueous solution containing 8 cc of 10% sodium dodecylbenzenesulfonate.

Emulsions for magenta, cyan, and interlayer were prepared following the same procedures as described above.

The compounds used in the respective emulsions are listed in Table 19 to be presented later.

$2.5\times10^{-4}$ mol of a stabilizer [IV-9] per unit mol of the silver halide were added to a blue-sensitive emulsion layer.

1-oxy-3,5-dichloro-s-triazine sodium salt was used as a gelatin hardener for each layer.

In order to prevent irradiation, dyes Ex-3a and Ex-3b in Table 19 were added to the emulsion layer.

$2.6\times10^{-3}$ mol of compound Ex-3c listed in Table 19 to be presented later per unit mol of the silver halide were added to a red-sensitive emulsion layer.

Grain formation was performed following the same procedures as in Examples 1 to 3 except that the grain formation temperature contents are changed as shown in Table 5, thereby obtaining emulsions 301 to 306. The obtained emulsions were optimally, chemically sensitized using sodium thiosulfate, chloroauric acid, and potassium rhodanate.

TABLE 5

| Emulsion | Grain Formation | Sensitizing Dye | Average Volume ($\mu m^3$) | Grain Shape | Average Aspect Ratio |
|---|---|---|---|---|---|
| 301 | 70° C. | Ex Dye B $2.3 \times 10^{-4}$ mol/mol of Ag | 0.30 | Cubic | 1 |
| 302 | " | Ex Dye B $4.0 \times 10^{-4}$ mol/mol of Ag | 0.25 | Tabular | 7 |
| 303 | 45° C. | Ex Dye G $4.0 \times 10^{-4}$ mol/mol of Ag | 0.064 | Cubic | 1 |
| 304 | " | Ex Dye G $7.1 \times 10^{-4}$ mol/mol of Ag | 0.053 | Tabular | 7 |
| 305 | " | Ex Dye R $4.0 \times 10^{-4}$ mol/mol of Ag | 0.063 | Cubic | 1 |
| 306 | " | Ex Dye R $7.1 \times 10^{-4}$ mol/mol of Ag | 0.052 | Tabular | 7 |

The resultant emulsions were coated in combinations as listed in Table 6, thereby preparing samples 301 to 309.

All couplers are used in equimolar amounts.

TABLE 6

| Sample No. | Layer 1 Emulsion | Layer 1 Coupler | Layer 3 Emulsion | Layer 3 Coupler | Layer 5 Emulsion | Layer 5 Coupler | Remarks |
|---|---|---|---|---|---|---|---|
| 301 | (301) | Ex Y | (303) | Ex M1 | (305) | Mixture of ExC1 and ExC2 at Weight Ratio of 1:1 | Comparative Example |
| 302 | (302) | Ex Y | (304) | Ex M1 | (306) | Mixture of ExC1 and ExC2 at Weight Ratio of 1:1 | Present Invention |
| 303 | (302) | Ex Y | (304) | Ex M1 | (306) | Ex C2 | Present Invention |
| 304 | (302) | Ex Y | (304) | Ex M2 | (306) | Ex C4 | Present Invention |
| 305 | (302) | Ex Y | (304) | Ex M3 | (306) | Ex C4 | Present Invention |
| 306 | (302) | Ex Y | (304) | Ex M4 | (306) | Ex C4 | Present Invention |
| 307 | (302) | Ex Y | (304) | Ex M3 | (306) | Ex C3 | Present Invention |
| 308 | (302) | Ex Y | (304) | Ex M4 | (306) | Ex C5 | Present Invention |
| 309 | (302) | Ex Y | (304) | Ex M3 | (306) | Ex C1 | Present Invention |

Layer Structure

Compositions of layers in sample 301 will be described below. Numerals indicate coating amounts ($g/m^2$). The silver halide emulsion is represented in a silver-converted coating amount.

| | |
|---|---|
| **Support** | |
| Polyethylene Laminate Paper [Polyethylene on first layer side containing white pigment ($TiO_2$) and bluish dye (navy blue)] | |
| **Layer 1 (Blue-Sensitive Layer)** | |
| Silver Halide Emulsion | 0.30 |
| Gelatin | 1.86 |
| Yellow Coupler (Ex Y) | 0.82 |
| Color Image Stabilizer (Cpd-1) | 0.19 |
| Solvent (Solv-1) | 0.35 |
| **Layer 2 (Color Mixing Inhibitor Layer)** | |
| Gelatin | 0.99 |
| Color Mixing Inhibitor (Cpd-2) | 0.08 |

-continued

| | |
|---|---|
| **Layer 3 (Green-Sensitive Layer)** | |
| Silver Halide Emulsion | 0.36 |
| Gelatin | 1.24 |
| Magenta Coupler (Ex MI) | 0.31 |
| Color Image Stabilizer (Cpd-3) | 0.25 |
| Color Image Stabilizer (Cpd-4) | 0.12 |
| Solvent (Solv-2) | 0.42 |
| **Layer 4 (Ultraviolet Absorption Layer)** | |
| Gelatin | 1.58 |
| Ultraviolet Absorbent (UV-1) | 0.62 |
| Color Mixing Inhibitor (Cpd-5) | 0.05 |
| Solvent (Solv-3) | 0.24 |
| **Layer 5 (Red-Sensitive Layer)** | |
| Silver Halide Emulsion | 0.23 |
| Gelatin | 1.34 |
| Cyan Coupler (1:1 mixture of Ex C1 & Ex C2) | 0.34 |
| Color Image Stabilizer (Cdp-6) | 0.17 |
| Polymer (Cdp-7) | 0.40 |
| Solvent (Solv-4) | 0.23 |
| **Layer 6 (Ultraviolet Absorption Layer)** | |
| Gelatin | 0.53 |
| Ultraviolet Absorbent (UV-1) | 0.21 |
| Solvent (Solv-3) | 0.08 |
| **Layer 7 (Protective Layer)** | |
| Gelatin | 1.33 |
| Acrylic Denatured Copolymer of Polyvinyl Alcohol (Degree of denaturation: 17%) | 0.17 |

-continued

| | |
|---|---|
| Liquid Paraffin | 0.03 |

Coated samples 301 to 309 were subjected to color development in accordance with the processing solutions and processing steps described in Example 1, thereby comparing sensitivities and fog of the blue-, green-, and red-sensitive layers following the same procedures as in Example 1. results are shown in Table 7.

In this case, relative sensitivity of sample 302 was assumed to be 100.

As is apparent from the results shown in Table 7, the combinations of the present invention have fog much less than and sensitivity much higher than those of the comparative example.

TABLE 7

| | Sensitivity | | | Fog | | | |
|---|---|---|---|---|---|---|---|
| Sample No. | B | G | R | B | G | R | Remarks |
| 301 | 9 | 9 | 9 | 0.35 | 0.32 | 0.30 | Comparative Example |
| 302 | 100 | 100 | 100 | 0.16 | 0.13 | 0.14 | Present Invention |
| 303 | 102 | 100 | 100 | 0.16 | 0.13 | 0.14 | Present Invention |
| 304 | 100 | 102 | 110 | 0.16 | 0.12 | 0.14 | Present Invention |
| 305 | 100 | 105 | 110 | 0.16 | 0.14 | 0.14 | Present Invention |
| 306 | 98 | 105 | 110 | 0.16 | 0.14 | 0.14 | Present Invention |
| 307 | 100 | 102 | 98 | 0.16 | 0.14 | 0.14 | Present Invention |
| 308 | 100 | 102 | 115 | 0.16 | 0.14 | 0.14 | Present Invention |
| 309 | 98 | 102 | 105 | 0.16 | 0.14 | 0.14 | Present Invention |

EXAMPLE 5

The following layers were formed on an undercoated cellulose triacetate film support, thereby forming a sample as a multilayered light-sensitive material.

Composition of Light-Sensitive Layers

An amount of the silver halide and colloid silver in a coating material was measured in g/m$^2$ of silver. Amounts of a coupler, additive, and gelatin were measured in g/m$^2$. An amount of a sensitizing dye was represented by the number of moles per unit mol of a silver halide in the same layer.

| | |
|---|---|
| Layer 1 (Antihalation layer) | |
| Black Colloid Silver | 0.2 |
| Gelatin | 1.3 |
| Colored Coupler C-1 | 0.06 |
| Ultraviolet Absorbent UV-1 | 0.1 |
| Ultraviolet Absorbent UV-2 | 0.2 |
| Dispersion Oil Oil-1 | 0.01 |
| Dispersion Oil Oil-2 | 0.01 |
| Layer 2 (Interlayer) | |
| Gelatin | 1.0 |
| Colored Coupler C-2 | 0.02 |
| Dispersion Oil Oil-1 | 0.1 |
| Layer 3 (1st Red-Sensitive Emulsion Layer) | |
| Emulsion (401) listed in TABLE 8 silver | 1.0 |
| Gelatin | 1.2 |
| Coupler C-3 | 0.48 |
| Coupler C-4 | 0.56 |
| Coupler C-8 | 0.08 |
| Coupler C-2 | 0.08 |
| Coupler C-5 | 0.04 |
| Dispersion Oil Oil-1 | 0.30 |
| Dispersion Oil Oil-3 | 0.04 |
| Layer 4 (2nd Red-Sensitive Emulsion Layer) | |
| Emulsion (402) listed in TABLE 8 silver | 1.0 |
| Gelatin | 1.0 |
| Coupler C-6 | 0.05 |
| Coupler C-7 | 0.1 |
| Dispersion Oil Oil-1 | 0.01 |
| Dispersion Oil Oil-2 | 0.05 |
| Layer 5 (Interlayer) | |
| Gelatin | 1.0 |
| Compound Cpd-A | 0.03 |
| Dispersion Oil Oil-1 | 0.05 |
| Layer 6 (1st Green-Sensitive Emulsion Layer) | |
| Emulsion (403) listed in TABLE 8 silver | 0.8 |
| Gelatin | 0.8 |
| Coupler C-9 | 0.30 |
| Coupler C-12 | 0.10 |
| Coupler C-1 | 0.06 |
| Coupler C-10 | 0.03 |
| Coupler C-5 | 0.02 |
| Dispersion Oil Oil-1 | 0.4 |
| Layer 7 (2nd Green-Sensitive Emulsion Layer) | |
| Emulsion (404) listed in TABLE 8 silver | 0.85 |
| Gelatin | 1.0 |
| Coupler C-11 | 0.01 |
| Coupler C-12 | 0.04 |
| Coupler C-13 | 0.20 |
| Coupler C-1 | 0.02 |
| Coupler C-15 | 0.02 |
| Dispersion Oil Oil-1 | 0.20 |
| Dispersion Oil Oil-2 | 0.05 |
| Layer 8 (Interlayer) | |
| Gelatin | 1.2 |
| Compound Cpd-B | 0.1 |
| Dispersion Oil Oil-1 | 0.3 |
| Layer 9 (1st Blue-Sensitive Emulsion Layer) | |
| Emulsion (405) listed in TABLE 8 silver | 0.4 |
| Gelatin | 1.0 |
| Coupler C-14 | 0.9 |
| Coupler C-5 | 0.07 |
| Dispersion Oil Oil-1 | 0.2 |
| Layer 10 (2nd Blue-Sensitive Emulsion Layer) | |
| Emulsion (406) listed in TABLE 8 silver | 0.5 |
| Gelatin | 0.6 |
| Coupler C-14 | 0.25 |
| Dispersion Oil Oil-1 | 0.07 |
| Layer 11 (1st Protective Layer) | |
| Gelatin | 0.8 |
| Ultraviolet Absorbent UV-1 | 0.1 |
| Ultraviolet Absorbent UV-2 | 0.2 |
| Dispersion Oil Oil-1 | 0.01 |
| Dispersion Oil Oil-2 | 0.01 |
| Layer 12 (2nd Protective Layer) | |
| Gelatin | 0.45 |
| Polymethyl Methacrylate Particles (grain size: 1.5 μm) | 0.2 |
| Hardener H-1 | 0.4 |
| Formaldehyde Scavenger S-1 | 0.5 |
| Formaldehyde Scavenger S-2 | 0.5 |

A surfactant was added as a coating additive to the above-mentioned layers in addition to the components described above.

Names or chemical structures of the compounds used in the present example are listed in Table 20 to be presented later.

Cubic emulsions used to prepare a sample had the contents shown in Table 8 and obtained following the same procedures as in Examples 1 to 3, and sample 501 was prepared using these cubic emulsions.

Then, sample 502 was prepared using emulsions (407) to (412) having the contents shown in FIG. 9 instead of emulsions (401) to (406) of sample (501). Tabular emulsions were prepared following the same procedures as in Examples 1 to 3. Emulsions (401) to (412) were optimally, chemically sensitized using diphenylthiourea, chloroauric acid, and potassium rhodanate.

TABLE 8

| Emulsion | Grain Formation Temperature | Sensitizing Dye (mol/mol of AgX) | Average Volume ($\mu m^3$) | Grain Shape | Average Aspect Ratio |
|---|---|---|---|---|---|
| 401 | 45° C. | I $1.0 \times 10^{-4}$<br>II $3.0 \times 10^{-4}$<br>III $1.0 \times 10^{-5}$ | 0.064 | Cubic | 1 |
| 402 | 70° C. | I $5 \times 10^{-5}$<br>II $1.5 \times 10^{-4}$<br>III $5 \times 10^{-6}$ | 0.30 | " | " |
| 403 | 45° C. | IV $3.5 \times 10^{-4}$<br>V $1.4 \times 10^{-4}$ | 0.063 | " | " |
| 404 | 70° C. | IV $2 \times 10^{-4}$<br>V $7 \times 10^{-5}$ | 0.34 | " | " |
| 405 | 45° C. | VI $2 \times 10^{-4}$<br>VII $2 \times 10^{-4}$ | 0.062 | " | " |
| 406 | 70° C. | VI $1 \times 10^{-4}$<br>VII $1 \times 10^{-4}$ | 0.32 | " | " |

TABLE 9

| Emulsion | Grain Formation Temperature | Sensitizing Dye (mol/mol of AgX) | Average Volume ($\mu m^3$) | Grain Shape | Average Aspect Ratio |
|---|---|---|---|---|---|
| 407 | 45° C. | I $1.6 \times 10^{-4}$<br>II $4.8 \times 10^{-4}$<br>III $1.6 \times 10^{-5}$ | 0.060 | Tabular | 7.0 |
| 408 | 70° C. | I $8 \times 10^{-5}$<br>II $2.4 \times 10^{-4}$<br>III $8 \times 10^{-6}$ | 0.32 | " | 8.1 |
| 409 | 45° C. | IV $5.6 \times 10^{-4}$<br>V $2.2 \times 10^{-4}$ | 0.060 | " | 7.1 |
| 410 | 70° C. | IV $3.2 \times 10^{-4}$<br>V $1.1 \times 10^{-4}$ | 0.31 | " | 8.2 |
| 411 | 45° C. | VI $3.2 \times 10^{-4}$<br>VII $3.2 \times 10^{-4}$ | 0.061 | " | 7.2 |
| 412 | 70° C. | VI $1.6 \times 10^{-4}$<br>VII $1.6 \times 10^{-4}$ | 0.28 | " | 8.3 |

The samples were exposed on the basis of a method for obtaining an ISO speed of a still photographing color negative films according to the JIS standards (JIS then subjected to processing as shown K7614-1986) and then subjected to processing as shown in Table 10.

Each sample was processed in an amount of 50 m/day for 16 days while replenishing a processing solution. After each processing solution reached a stationary composition in continuous processing, samples were tested.

TABLE 10

| Process | Time | Temperature | Replenishing* Amount | Tank Volume |
|---|---|---|---|---|
| Color Development | 1 min. | 38° C. | 10 ml | 4 liter |
| Bleach-Fixing | 1 min. | 38° C. | 20 ml | 4 liter |
| Washing (1) | 15 sec. | 38° C. | Counter flow piping from (2) to (1) | 2 liter |
| Washing (2) | 15 sec. | 38° C. | 10 ml | 2 liter |
| Drying | 30 sec. | 65° C. | | |

*A replenishing amount per meter of a 35-mm wide sample

The compositions of the process solution (mother and replenishing solutions) are represented as follows:

| Color Developing Solution (g) | Mother Solution | Replenishment Solution |
|---|---|---|
| Water | 900 ml | 900 ml |
| Potassium Chloride | 1.0 | 1.0 |
| Potassium Carbonate | 34.6 | 38.0 |
| Sodium Bicarbonate | 1.8 | 2.0 |
| Ethylenediamine-N,N,N,N-tetramethylenephosphonate | 1.0 | 1.2 |
| Triethylenediamine-(1,4-diazabicyclo[2,2]-octane | 5.3 | 6.0 |
| Diethylhydroxylamine | 4.2 | 5.5 |
| 3-methyl-4-amino-N-ethyl-N-β-hydroxyethylanilinesulfate | 4.6 | 7.5 |
| Potassium hydroxide to obtain | pH 10.05 | pH 10.15 |
| Water to make | 1.0 liter | 1.0 liter |

| Bleach-Fixing Solution | Mother and replenishment solutions are common (g) |
|---|---|
| Ferric Ammonium Ethylenediaminetetraacetate (Dihydrate) | 90.0 |
| Disodium Ethylenediaminetetraacetate | 10.0 |
| Sodium Sulfite | 12.0 |
| Ammonium Thiosulfate Aqueous Solution (70%) | 260.0 ml |
| Acetic Acid (98%) | 5.0 ml |
| Bleach Accelerator | 0.01 mol |

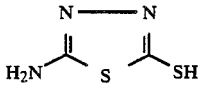

| | |
|---|---|
| Water to make | 1.0 liter |
| pH | 6.0 |

-continued

| | |
|---|---|
| Potassium Chloride | 1.0 1.0 |
| Washing Solution | Mother and replenishment solutions are common |
| Ion Exchanged Water (obtained by supplying tap water to a mixed-bed column filled with an H type strongly acidic cation exchange resin (DIA ION SK-1B available from Mitsubishi Chemical Industries Ltd.) and an OH type strongly basic anion exchange resin (DIA ION SA-10A available from Mitsubishi Chemical Industries Ltd.) at a volume ratio of 1:1.5 to set the concentrations of calcium and magnesium to be 3 mg/l or less) | 1 liter |
| Sodium Dichloro isocyanurate | 20 ml |
| Sodium Sulfate | 150 mg |
| Polyoxyethylene-p-monononylphenylether (average degree of polymerization: 10) | 300 mg |
| pH | 6.5 to 7.5 |

After the above processing, samples similar to those subjected to the continuous processing were exposed on the basis of the JIS standards and then processed by the above processing solution.

As a result of calculating the ISO sensitivity of a processed film on the basis of the JIS standards, sample 501 had ISO 8 while sample 502 had ISO 64. Thus, an effect of the present invention was confirmed.

EXAMPLE 6

The processing in Example 5 was performed following the same procedures as in Example 5 except that the conditions were changed as shown in Table 11 and the processing solution composition was changed as follows. As a result, the same effect as that of Example 5 was obtained.

TABLE 11

| Process | Time | Temperature | Replenishing* Amount | Tank Volume |
|---|---|---|---|---|
| Color Development | 30 sec. | 42° C. | 20 ml | 4 liter |
| Bleach-Fixing | 30 sec. | 42° C. | 20 ml | 4 liter |
| Washing (1) | 10 sec. | 42° C. | Counter flow piping from (2) to (1) 10 ml | 2 liter |
| Washing (2) | 10 sec. | 42° C. | | 2 liter |
| Drying | 30 sec. | 65° C. | | |

*A replenishing amount per meter of a 35-mm wide sample.

The compositions of the process solutions (mother and replenishment solutions) are represented as follows:

| Color Developing Solution (g) | Mother Solution | Replenishment Solution |
|---|---|---|
| Water | 900 ml | 900 ml |
| Potassium Chloride | 2.0 | 2.0 |
| Potassium Carbonate | 34.6 | 38.0 |
| Sodium Bicarbonate | 1.0 | 1.5 |
| Ethylenediamine-N,N,N,N-tetramethylenephosphonate | 2.0 | 2.4 |
| Triethylenediamine-(1,4-diazabicyclo[2,2,2]-octane | 5.3 | 6.0 |
| Diethylhydroxylamine | 4.2 | 5.5 |
| 3-methyl-4-amino-N-ehyl-N-β-hydroxyethylanilinesulfate | 6.0 | 8.0 |
| Potassium hydroxide | pH 10.2 | pH 10.3 |

-continued

| | | |
|---|---|---|
| to obtain Water to make | 1.0 liter | 1.0 liter |

| Bleach-Fixing Solution | Mother Solution | Replenishment Solution |
|---|---|---|
| Water | 600 ml | 600 ml |
| Ferric Ammonium Ethylenediaminetetraacetate (Dihydrate) | 90.0 | 100.0 |
| Disodium Ethylenediaminetetraacetate | 10.0 | 10.0 |
| Ammonium Sulfite | 10.0 | 12.0 |
| Ammonium Thiosulfate Aqueous Solution (70%) | 260.0 ml | 270.0 ml |
| Bleach Accelerator | 0.01 mol | 0.015 mol |

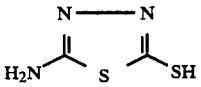

| | | |
|---|---|---|
| Acetic Acid to obtain | pH 5.5 | pH 5.0 |
| Water to make | 1.0 liter | 1.0 liter |

| Wash Solution | Mother and replenishment solutions are common |
|---|---|
| Ion Exchanged Water (obtained by supplying tap water to a mixed-bed column filled with an H type strongly acidic cation exchange resin (DIA ION SK-1B available from Mitsubishi Chemical Industries Ltd.) and an OH type strongly basic anion exchange resin (DIA ION SA-10A available from Mitsubishi Chemical Industries Ltd.) at a volume ratio of 1:1.5 to set the concentrations of calcium and magnesium to be 3 mg/l or less) | 1 l |
| Sodium Isocyanuric Acid Dichloride | 20 mg |
| Sodium Sulfate | 150 mg |
| Polyoxyethylene-p-mononononylphenylether (average degree of polymerization: 10) | 300 mg |
| pH | 6.5 to 7.5 |

EXAMPLE 7

| | |
|---|---|
| Solution (1) | |
| Bone Gelatin | 30.0 g |
| NaCl | 10.0 g |
| Water | 1,000 ml |
| Solution (2) | |
| 0.1% water/methanol solution of dye III-31 | 496 cc |
| Solution (3) | |
| $AgNO_3$ | 15 g |
| Water | 150 cc |
| Solution (4) | |
| $AgNO_3$ | 135 g |
| Water | 450 cc |
| Solution (5) | |
| NaCl | 51.8 g |
| Water | 450 cc |

Emulsion L

Solution (1) was heated up to 55° C., and solution (3) was added to solution (1) over seven minutes. 10 minutes after the addition, solution (4) and solution (5) were added to the resultant solution over 50 minutes, and one minute after the addition, solution (2) was added. Five minutes after the addition, the temperature was reduced, and the resultant was washed and desalted by means of a normal flocculation method.

Emulsion L had comparatively monodispersion cubic grains, and its weight-averaged volume was 0.28 $\mu m^3$. Water and dispersion gelatin were added to emulsion L, then, the pH was adjusted to be 6.2, and the pAg was adjusted to be 7.4. The resultant emulsion was chemically sensitized at 60° C. using diphenylthiourea, chloroauric acid, and ammonium rhodanate.

Emulsion M

Solution (1) was heated up to 55° C., and solution (3) was added to solution (1) over seven minutes. Ten minutes after the addition, solution (4) and solution (5) were added at the same time over 50 minutes. At this time, 310 cc of solution (2) was added over 40 minutes five minutes after the addition of solutions (4) and (5) was started. One minute after the addition of solutions (4) and (5) was completed, 186 cc of solution (2) was added. Five minutes after the addition, the temperature was reduced, and the resultant was washed and desalted by means of a normal flocculation method. Emulsion M had comparatively monodispersion octahedral grains, and its weight-averaged volume was 0.31 $\mu m^3$. Then, water and dispersion gelatin were added to emulsion M then, the pH was adjusted to be 6.2, and the pAg was adjusted to be 7.4. The resultant emulsion was chemically sensitized using diphenylthiourea, chloroauric acid, and ammonium rhodanate.

Emulsion N

Figure 2:
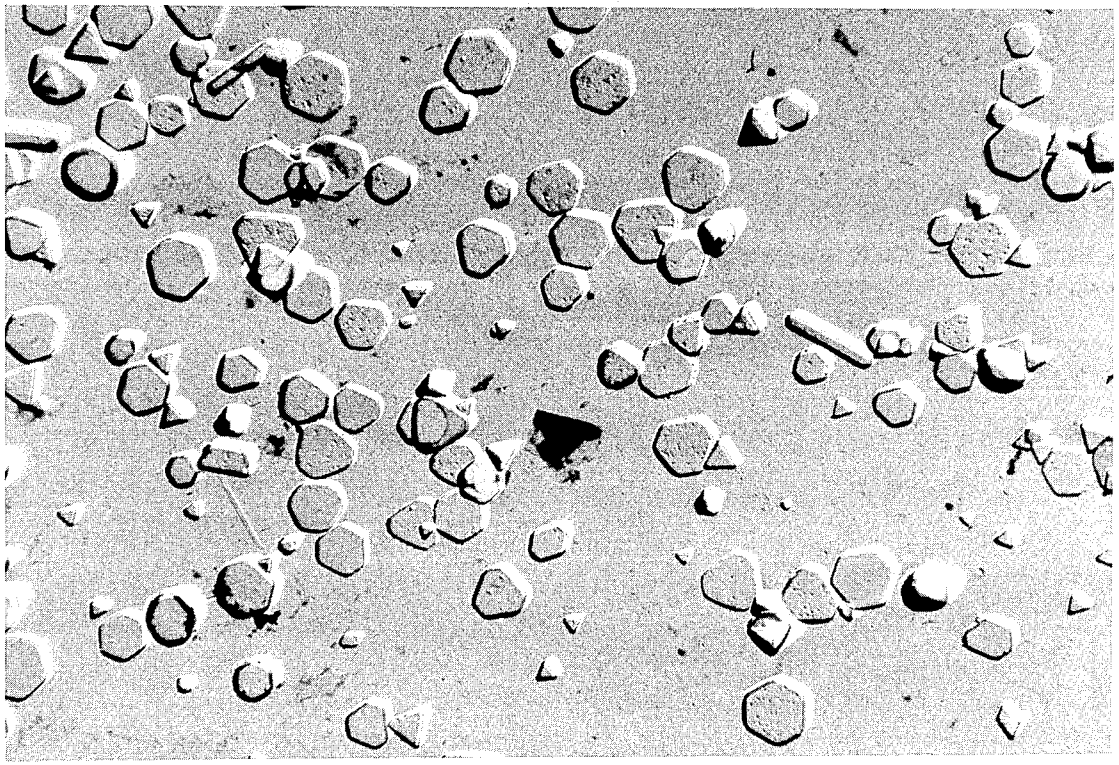
FIG. 2 is an electron microscopic photograph (magnification: 6,000 times) of silver halide grains contained in emulsion N of Example 7.

Solution (1) was heated up to 55° C., and 50 cc of solution (2) were added to solution (1). Then, solution (3) was added to the the resultant solution over seven minutes, and 10 minutes after the addition, solution (4) and solution (5) were added at the same time over 50 minutes. At this time, 310 cc of solution (2) were added over 40 minutes, five minutes after the addition of solutions (4) and (5) was started. One minute after the addition of solutions (4) and (5) was completed, 136 cc of solution (2) were added, and five minutes after the addition, the temperature was reduced and washing and desalting were performed by a normal flocculation method. Emulsion N had thin tabular grains, and its weight-averaged volume was 0.31 $\mu m^3$. In emulsion N, tabular grains having an aspect ratio of 2 to 10 occupied about 90% of a total projected surface area, and an average aspect ratio of tabular grains having an aspect ratio of 2 or more was about 7.5. FIG. 2 shows an electron microscopic photograph of emulsion N.

Water and dispersion gelatin were added to the emulsion so that the pH was adjusted to be 6.2 and the pAg was adjusted to be 7.4. Then, the resultant emulsion was chemically sensitized at 60° C. using sodium thiosulfate, chloroauric acid, and ammonium rhodanate.

Thereafter, the emulstions were used to prepare light-sensitive materials shown in Table 21 following the same procedures as in Example 1 except that compound IV-9 was added as a stabilizer. Exposure, development, and density measurement were performed following the same procedures as in Example 1. As a result, the most preferable photographic characteristics were obtained by emulsion N in terms of the fog, sensitivity, reciprocity failure, and pressure properties.

TABLE 21

| | Sulfur Sensitizer (mol/mol of AgX) | Gold Sensitizer (mol/mol of AgX) | Fog | Photographic Sensitivity 1/10 sec Exposure | Photographic Sensitivity 1/100 sec Exposure | Response to Stress Stress Marks | Response to Stress Stress Desensitization |
|---|---|---|---|---|---|---|---|
| Emulsion L Cubic Grain (Comparative Example) | $4 \times 10^{-6}$ | $3 \times 10^{-6}$ | 0.33 | 8.0 | 6.0 | Δ~x | o |
| | | $10 \times 10^{-6}$ | 0.41 | 6.0 | 4.0 | | |
| | | $30 \times 10^{-6}$ | 0.49 | 5.5 | 3.5 | | |
| Emulsion M Octahedral Grain (Comparative Example) | $4 \times 10^{-6}$ | $3 \times 10^{-6}$ | 0.25 | 50 | 30 | | |
| | | $10 \times 10^{-6}$ | 0.18 | 65 | 50 | | |
| | | $30 \times 10^{-6}$ | 0.16 | 80 | 70 | o~Δ | o |
| Emulsion N Tabular Grain (Present Invention) | $4 \times 10^{-6}$ | $3 \times 10^{-6}$ | 0.22 | 60 | 50 | | |
| | | $10 \times 10^{-6}$ | 0.12 | 85 | 80 | | |
| | | $30 \times 10^{-6}$ | 0.10 | 100 | 98 | o~Δ | o |

TABLE 12

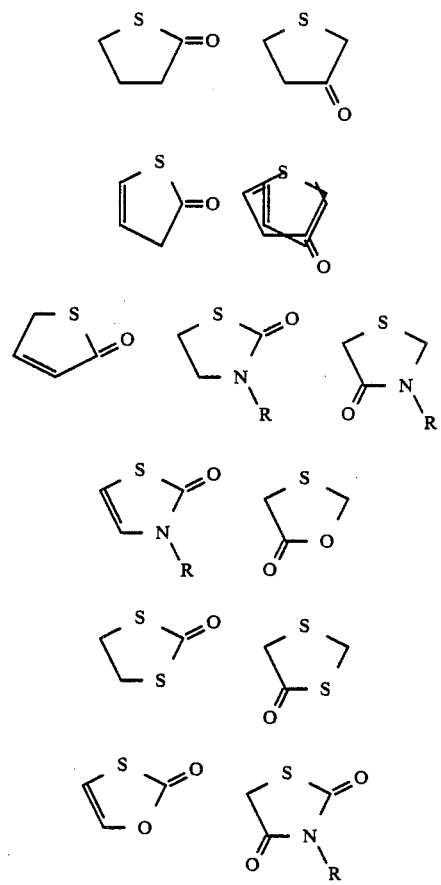

TABLE 12-continued
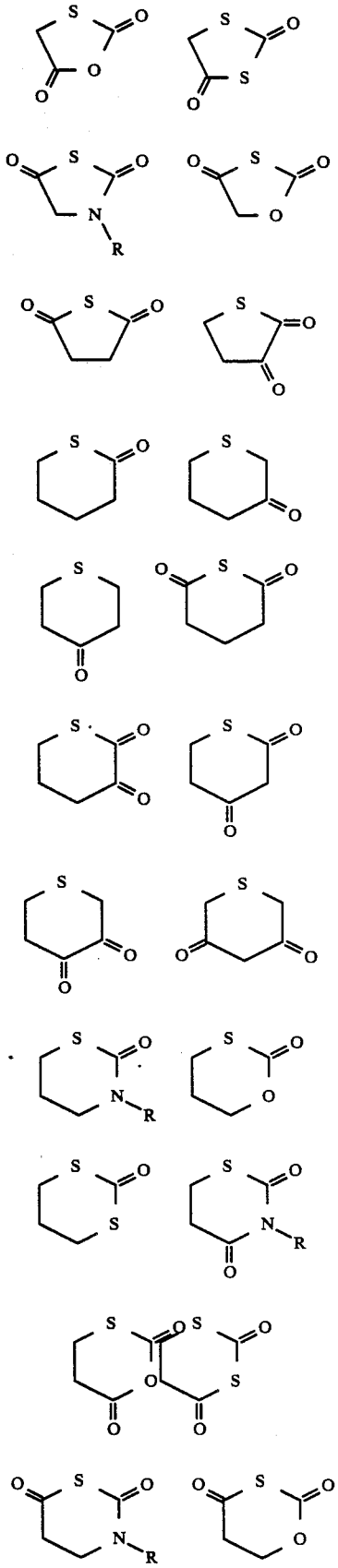
TABLE 12-continued
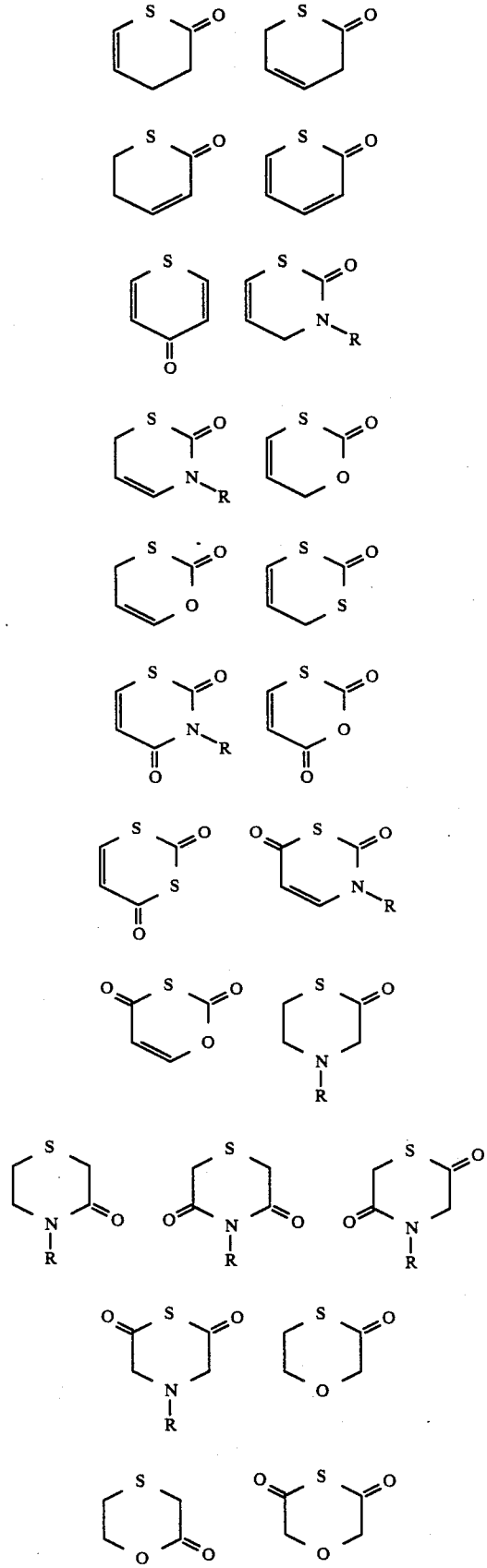

TABLE 12-continued
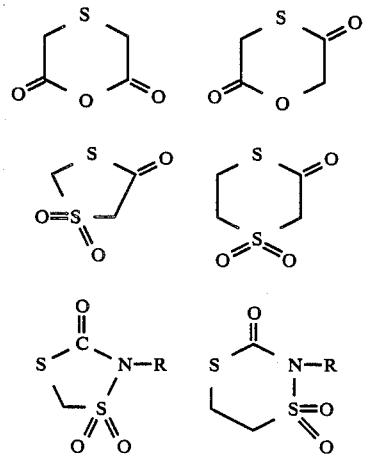
TABLE 13
I-1
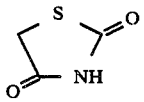
I-2
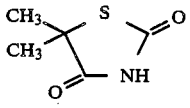
I-3
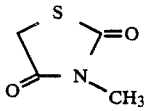
I-4
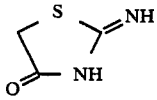
I-5
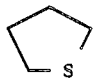
I-6
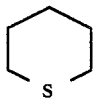
I-7
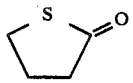
I-8
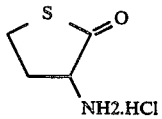
I-9
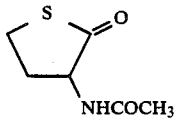
TABLE 13-continued
I-10
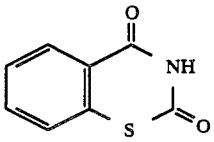
I-11
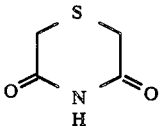
I-12
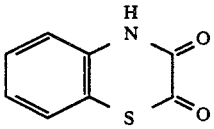
I-13
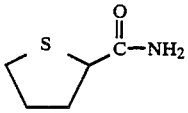
I-14
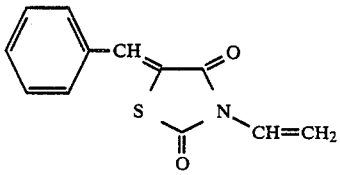
I-15
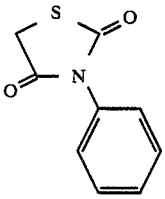
I-16
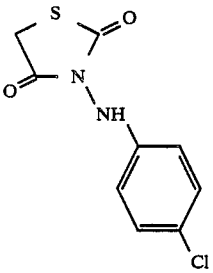
I-17
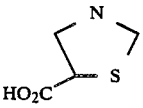
TABLE 14
II-1
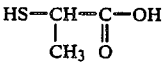
II-2
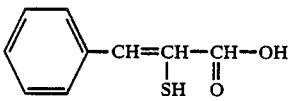

TABLE 14-continued
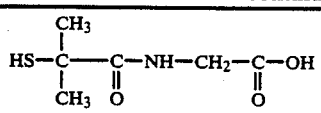
II-3
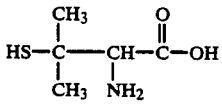
II-4
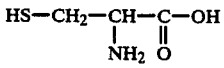
II-5
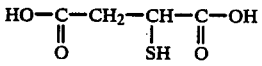
II-6
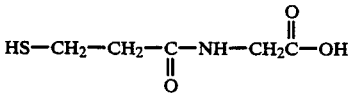
II-7
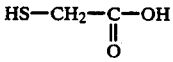
II-8
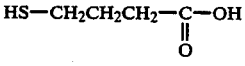
II-9
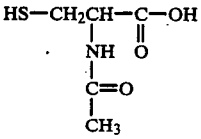
II-10
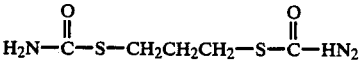
II-11
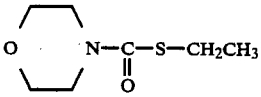
II-12
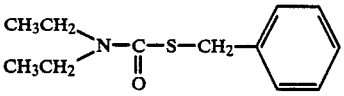
II-13
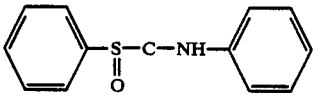
II-14
TABLE 14-continued
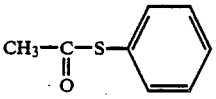
II-15
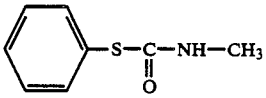
II-16
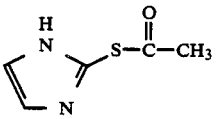
II-17
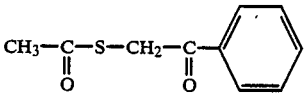
II-18
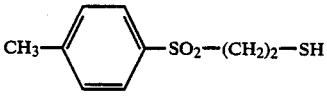
II-19
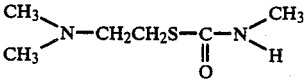
II-20
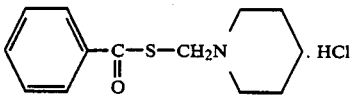
II-21
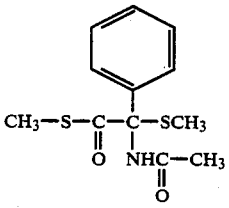
II-22
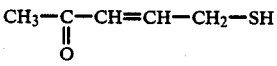
II-23
$HS-CH_2CH_2SO_3Na$ II-24
TABLE 15
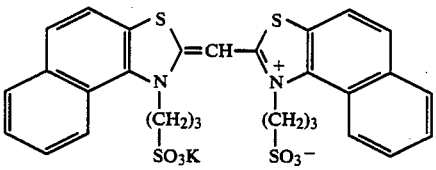
III-1
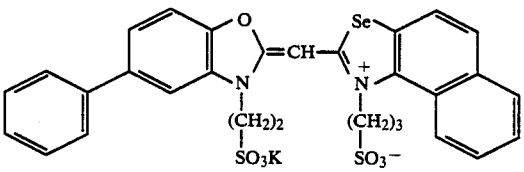
III-2

TABLE 15-continued
III-3
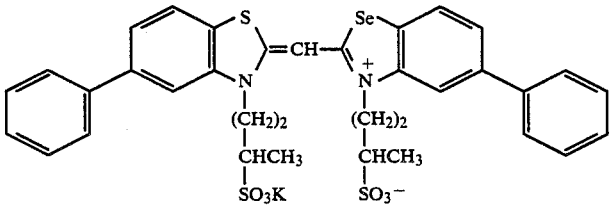
III-4
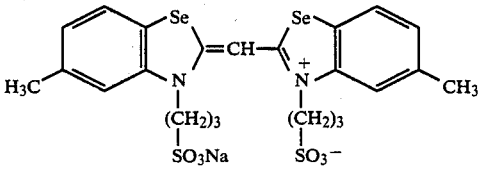
III-5
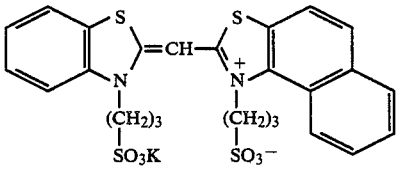
III-6
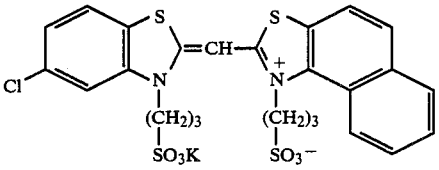
III-7
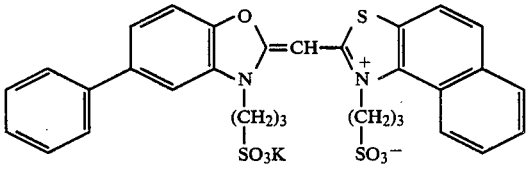
III-8
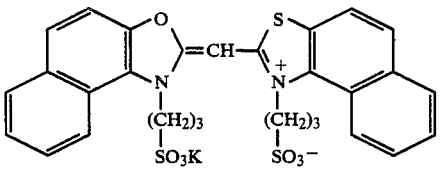
III-9
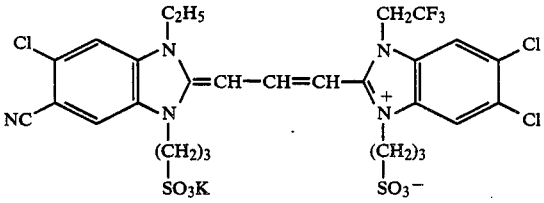
III-10
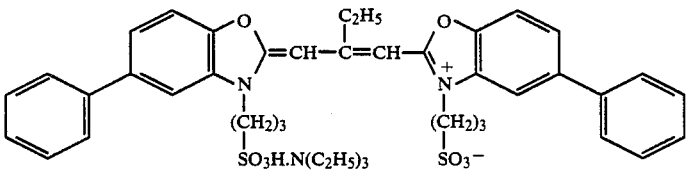

TABLE 15-continued
III-11
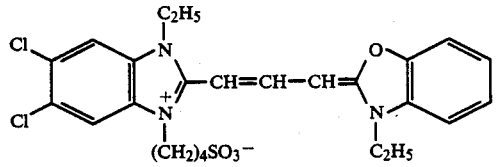
III-12
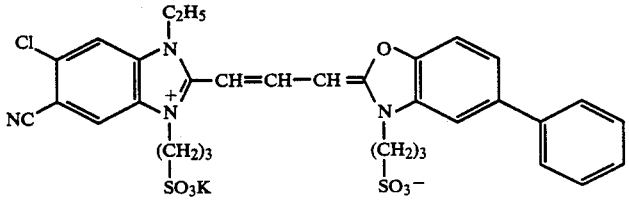
III-13
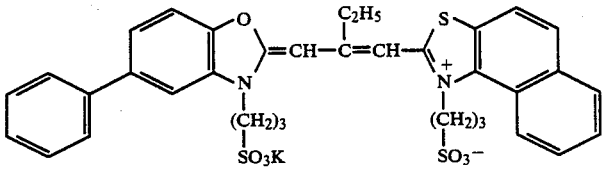
III-14
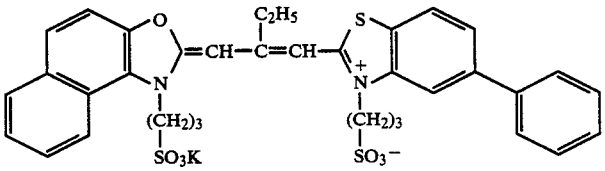
III-15
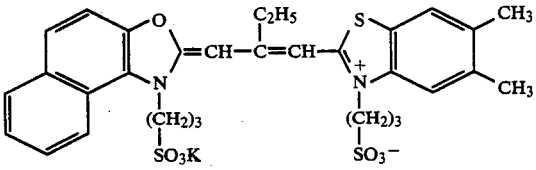
III-16
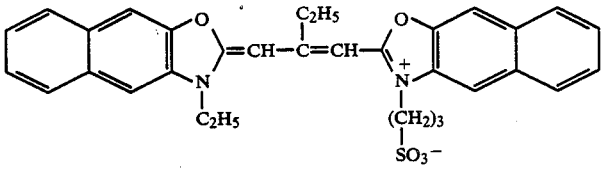
III-17
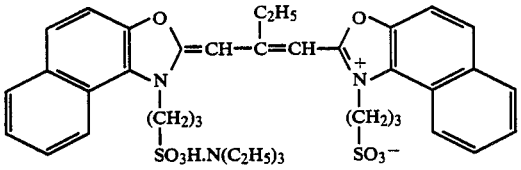
III-18
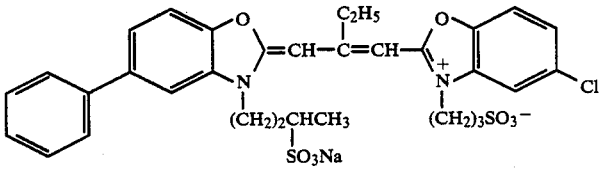

TABLE 15-continued
III-19
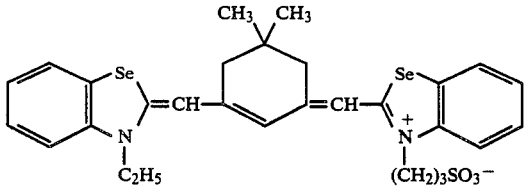
III-20
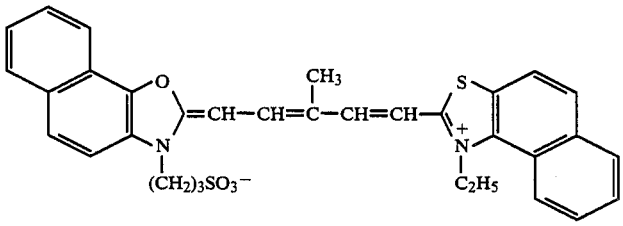
III-21
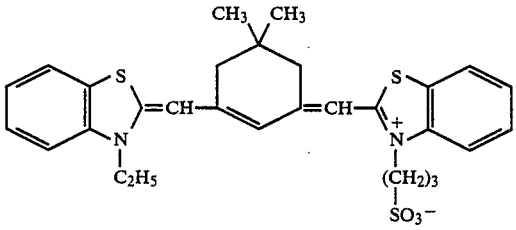
III-22
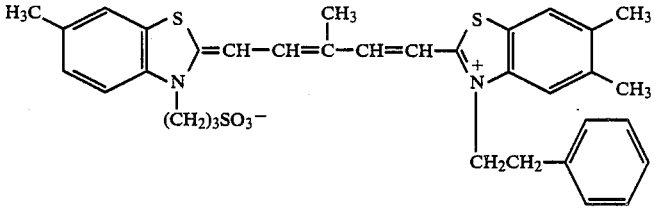
III-23
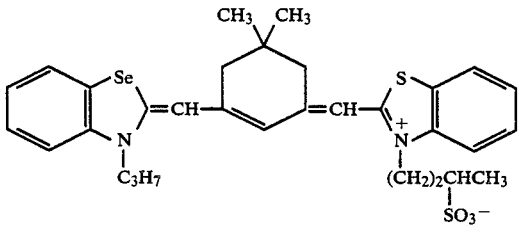
III-24
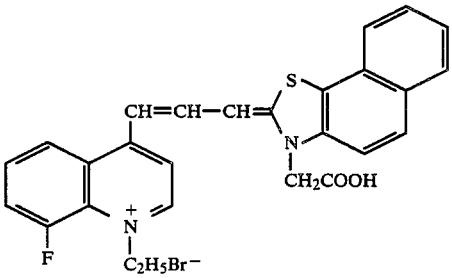

TABLE 15-continued
III-25
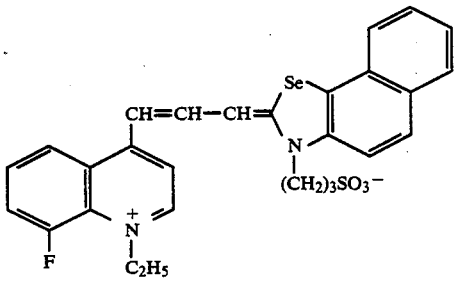
III-26
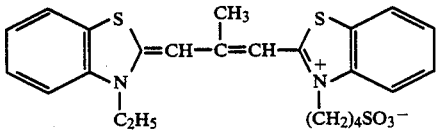
III-27
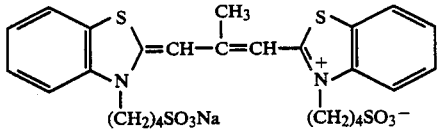
III-28
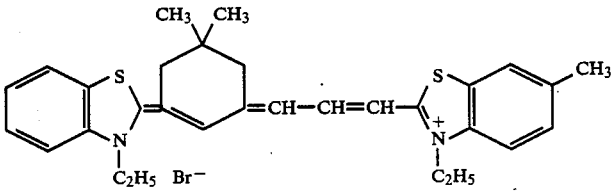
III-29
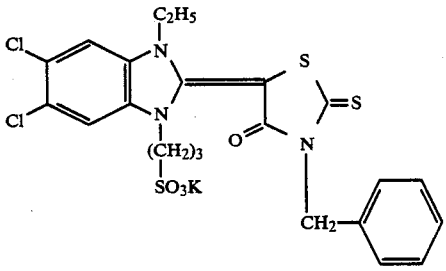
III-30
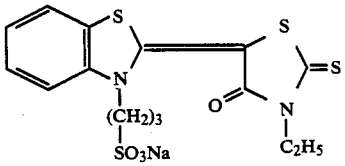
III-31
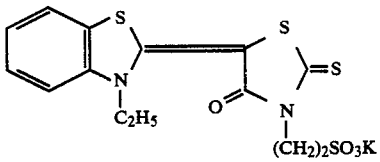
III-32
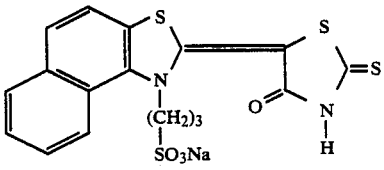

TABLE 15-continued
III-33
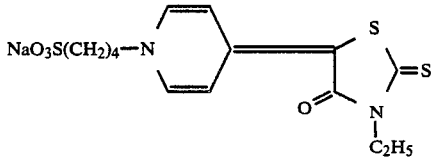
III-34
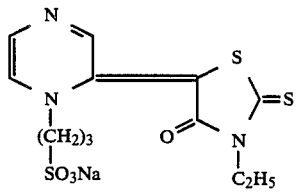
III-35
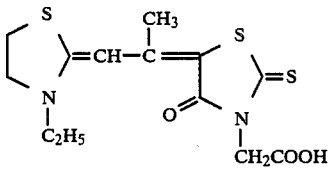
III-36
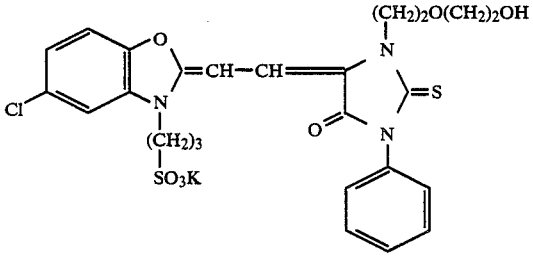
III-37
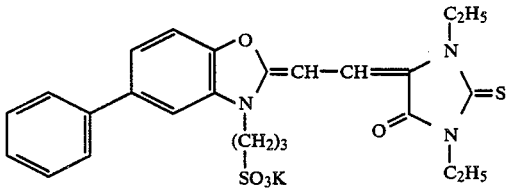
III-38
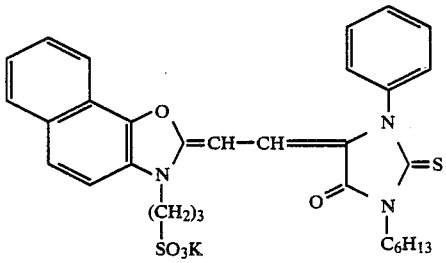
III-39
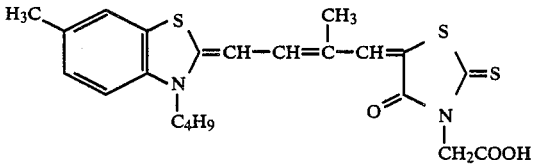

TABLE 15-continued
III-40
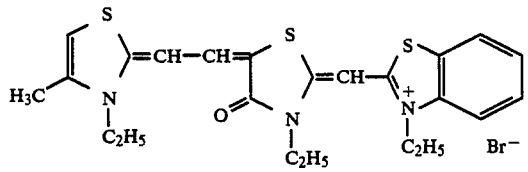
III-41
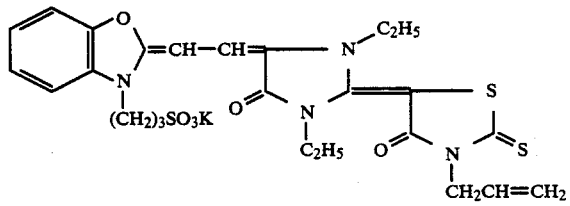
TABLE 16
IV-1
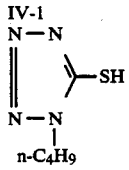
IV-2
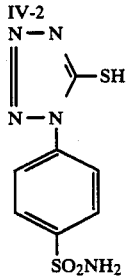
IV-3
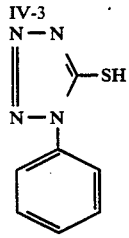
IV-4
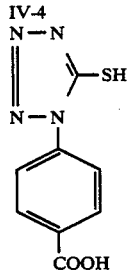
IV-5
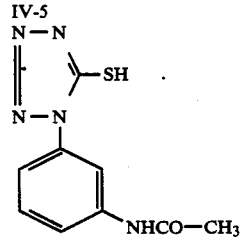
IV-6
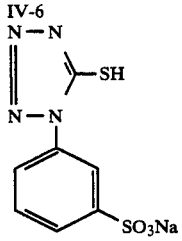
IV-7
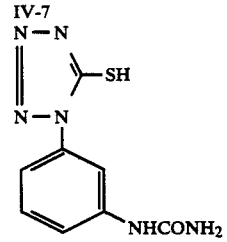
IV-8
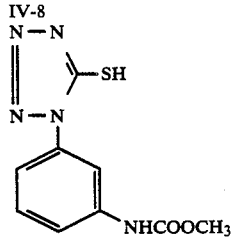

TABLE 16-continued
IV-9
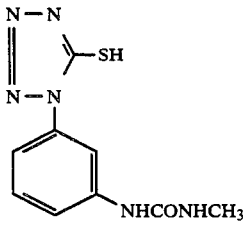
IV-10
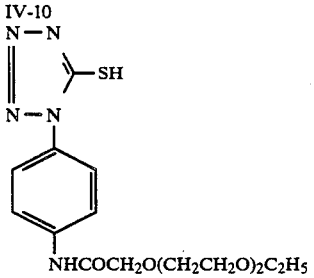
IV-11
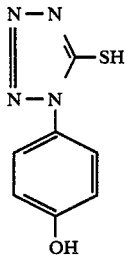
IV-12
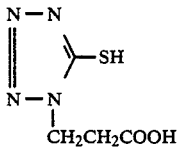
IV-13
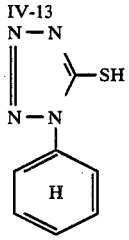
IV-14
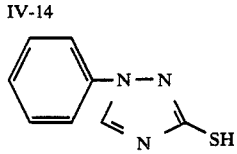
IV-15
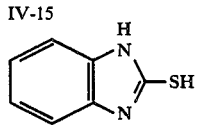
IV-16
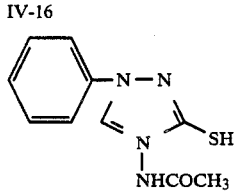
IV-17
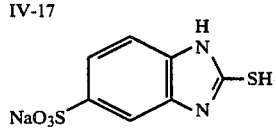
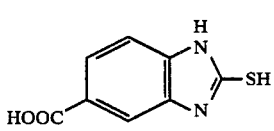
IV-18
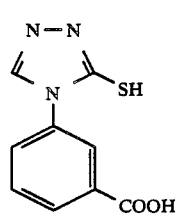
IV-19
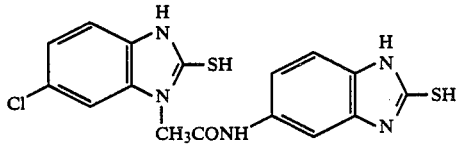

TABLE 16-continued
IV-20
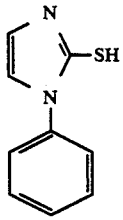
IV-21
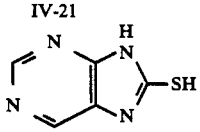
IV-22
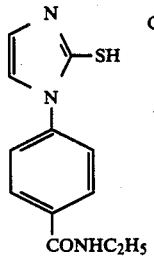
IV-23
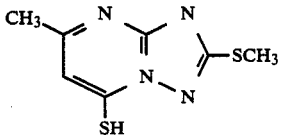
IV-24
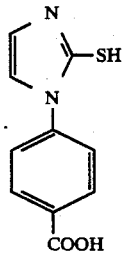
IV-25
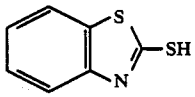
IV-26
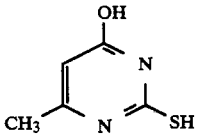
IV-27
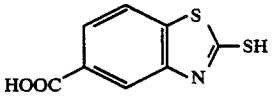
IV-28
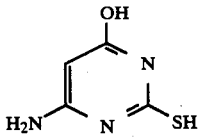
IV-29
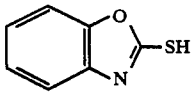
IV-30
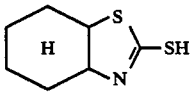
IV-31
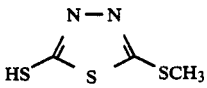
IV-32
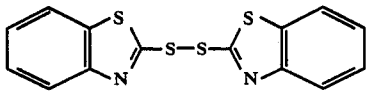
IV-33
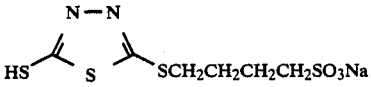

TABLE 16-continued
IV-34
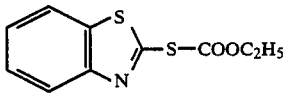
IV-35
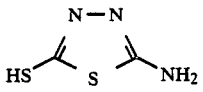
IV-36
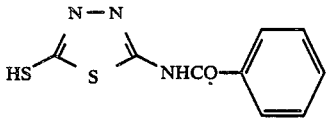
IV-37
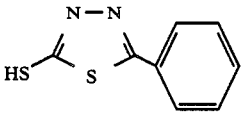
IV-38
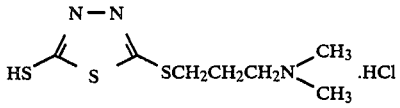
IV-39
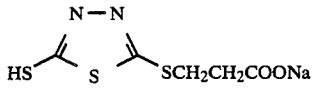
IV-40
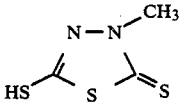
TABLE 17
C-1
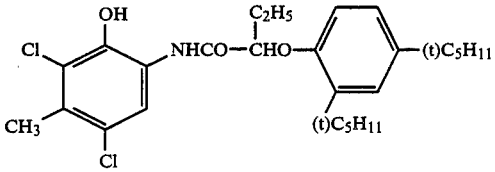
C-2
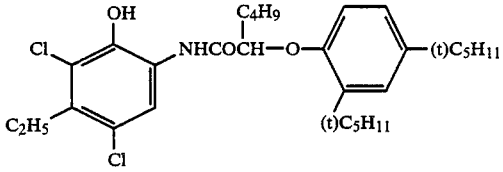
C-3
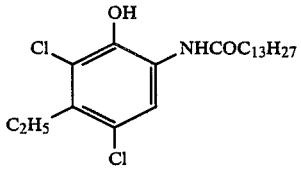
C-4
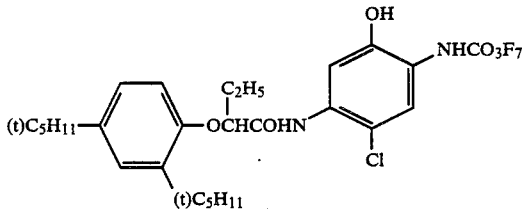
C-5
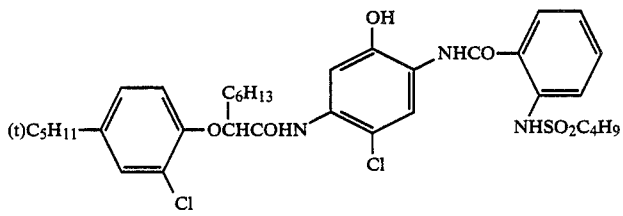

TABLE 17-continued
C-6
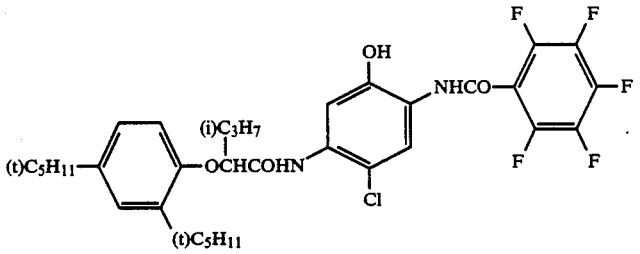
C-7
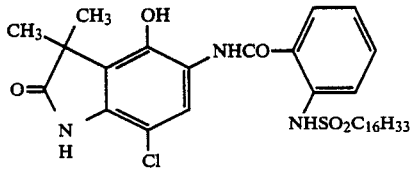
C-8
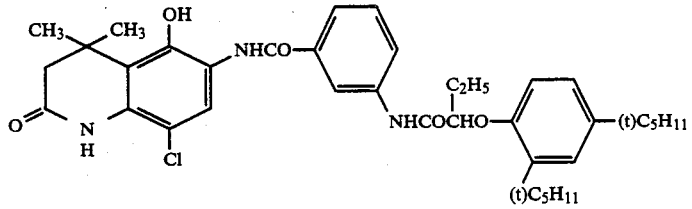
C-9
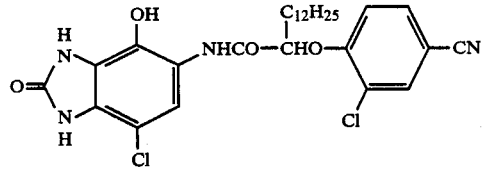
C-10
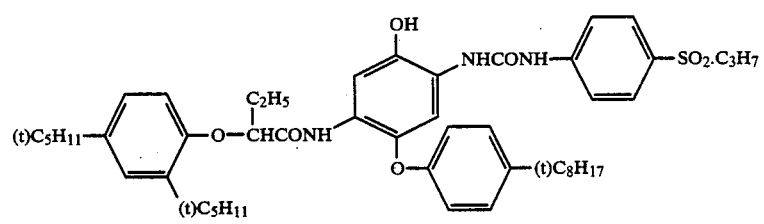
C-11
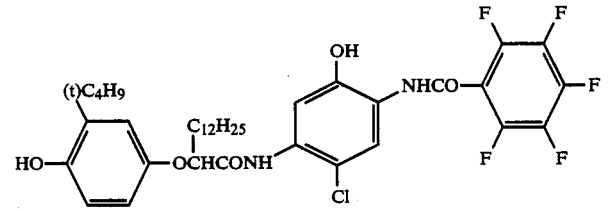
M-1
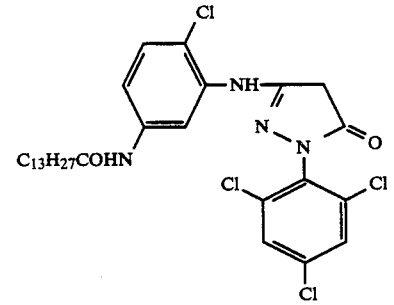

TABLE 17-continued
M-2
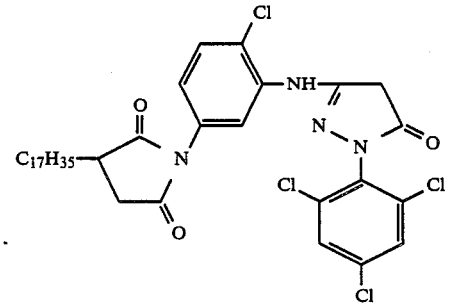
M-3
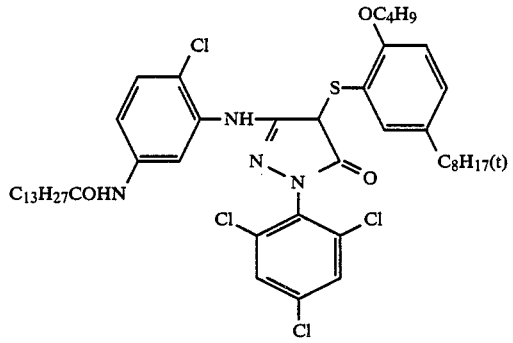
M-4
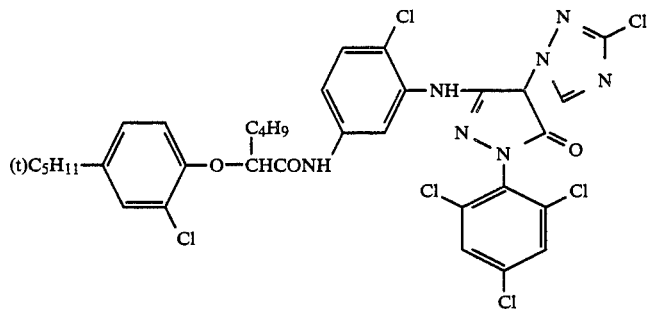
M-5
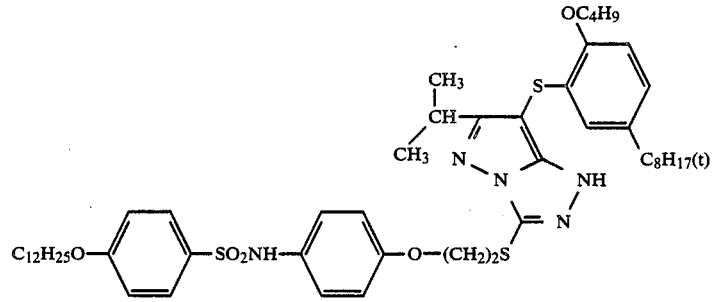
M-6
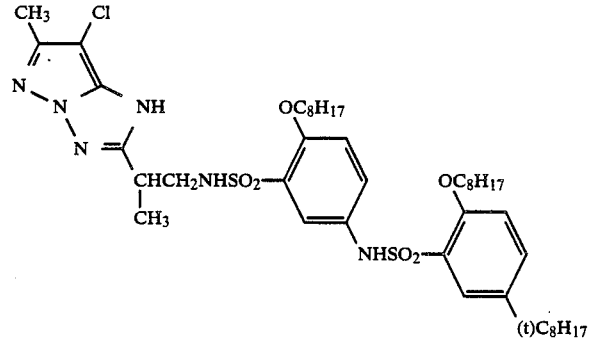

TABLE 17-continued
M-7
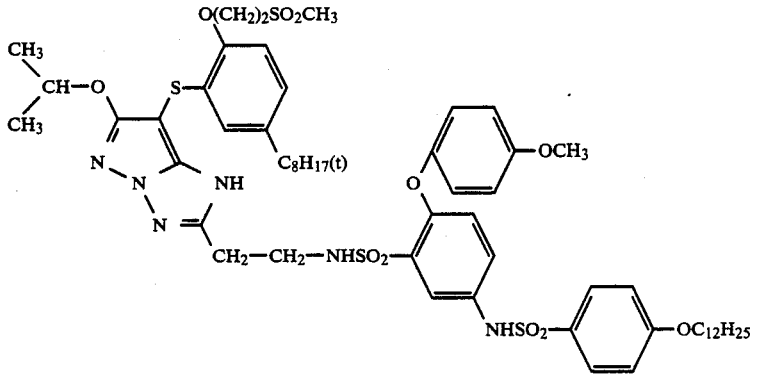
M-8
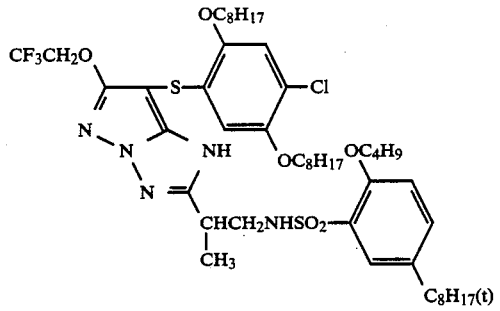
M-9
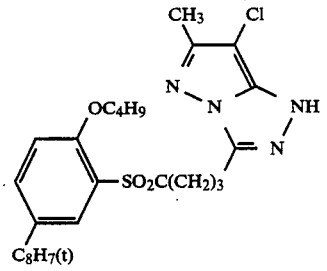
Y-1
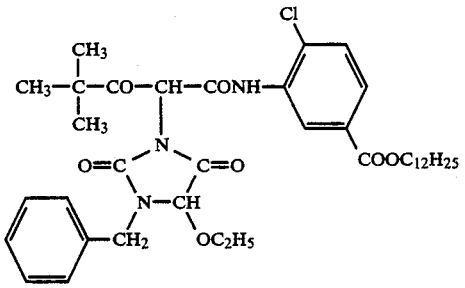
Y-2
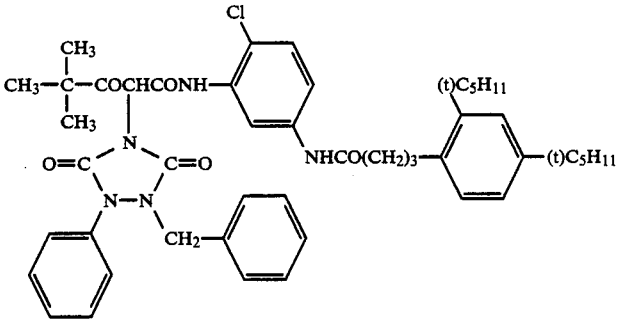

TABLE 17-continued
Y-3
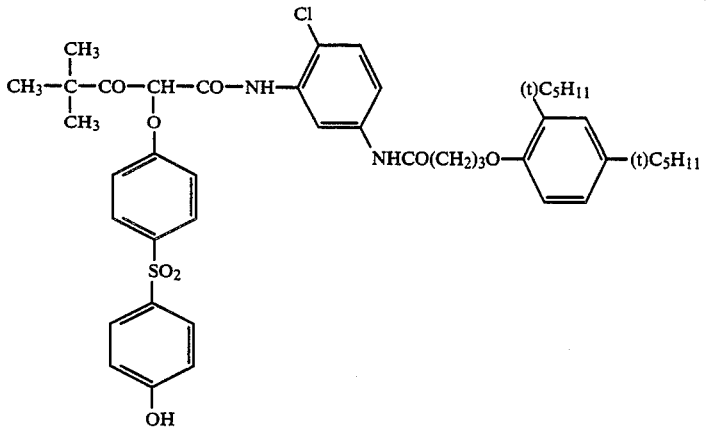
Y-4
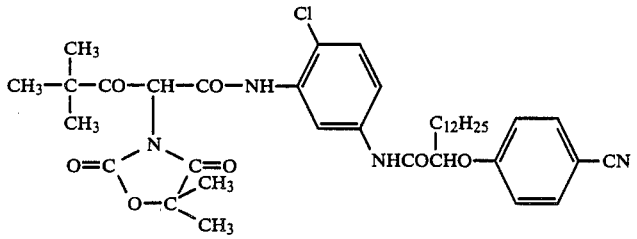
Y-5
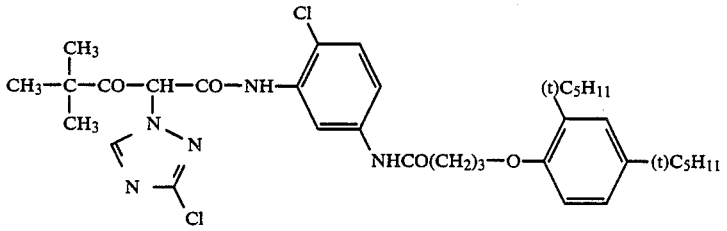
TABLE 18
XXI-1
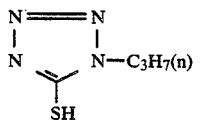
XXI-2
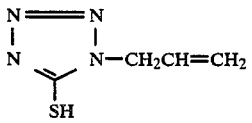
XXI-3
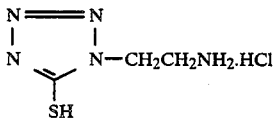
XXI-4
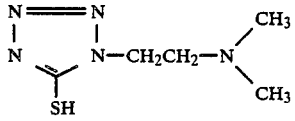
XXI-5
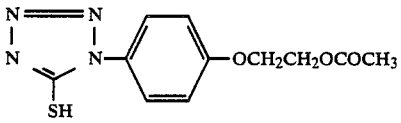
TABLE 18-continued
XXI-6
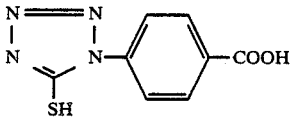
XXI-7
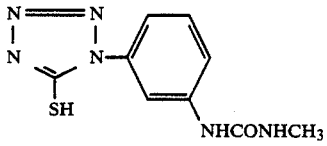
XXI-8
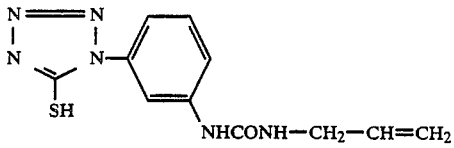
XXII-1
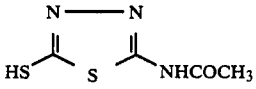
XXII-2
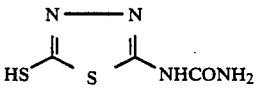

TABLE 18-continued
XXII-3
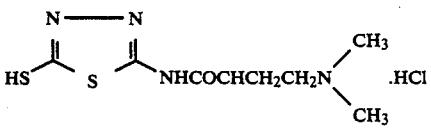
XXII-4
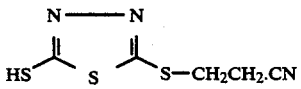
XXII-5
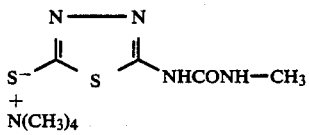
TABLE 18-continued
XXIII-1
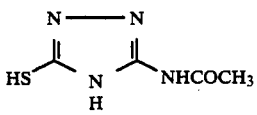
XXIII-2
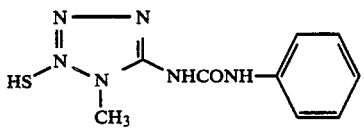
TABLE 19
Yellow Coupler
ExY
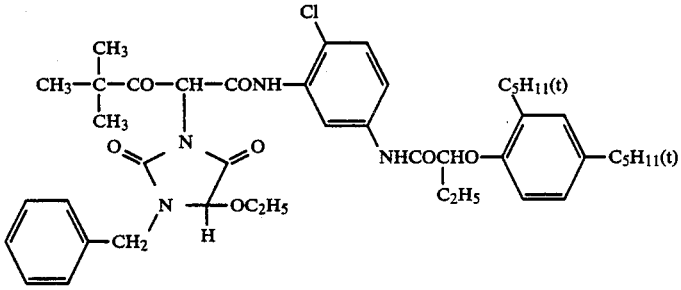
Mazenta Couplers
ExM1
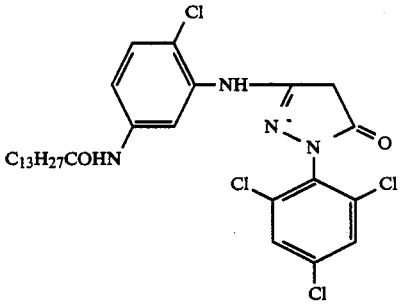
ExM2
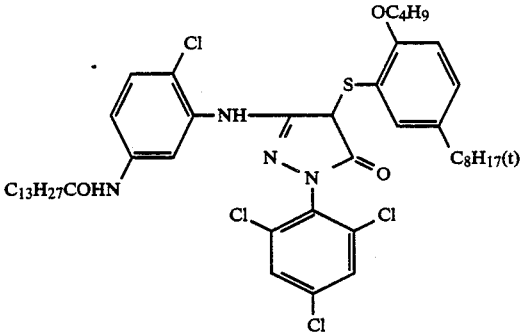

TABLE 19-continued
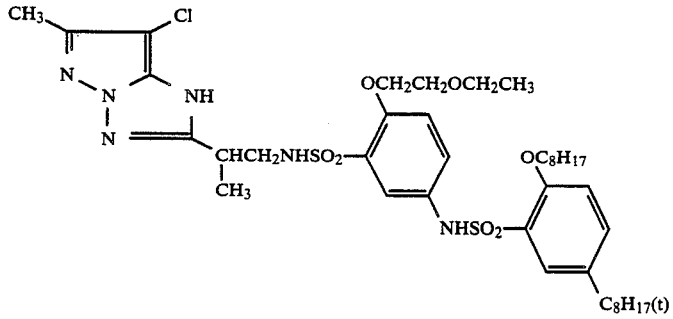
ExM3
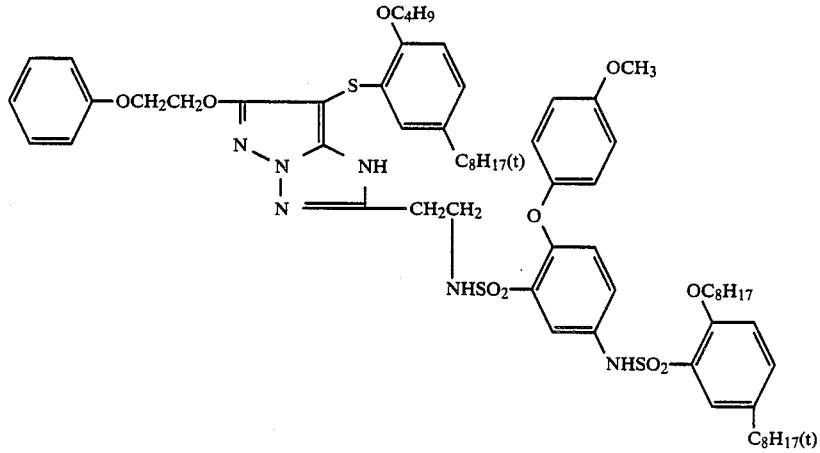
ExM4
Cyan Couplers
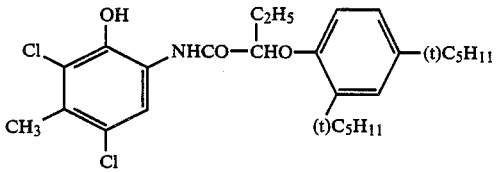
ExC1
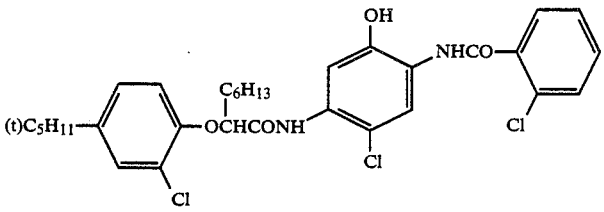
ExC2
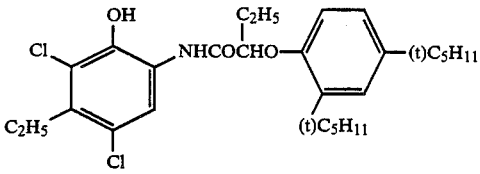
ExC3
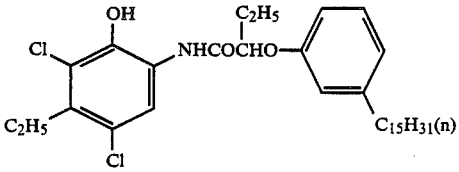
ExC4

TABLE 19-continued
ExC5
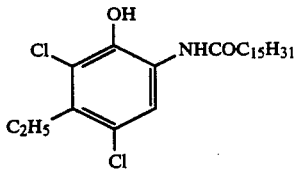
Dye Image Stabilizer Cpd-1
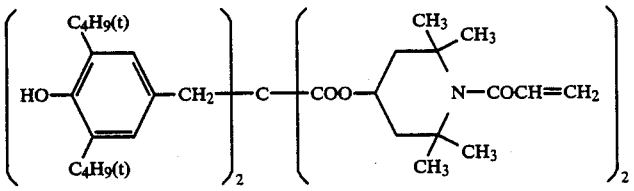
Color Mixing Inhibitor Cpd-2
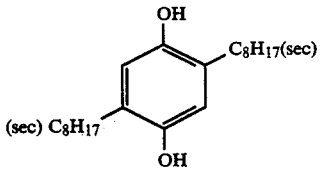
Color Mixing Inhibitor Cpd-5
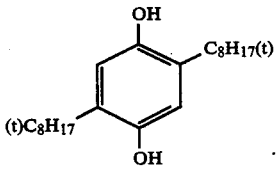
Dye Image Stabilizer Cpd-6
5:8:9 mixture (weight ratio) or:
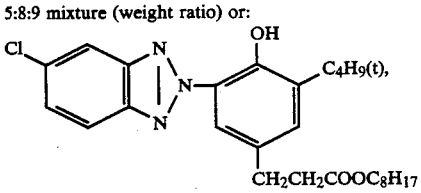
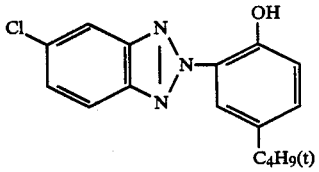
and
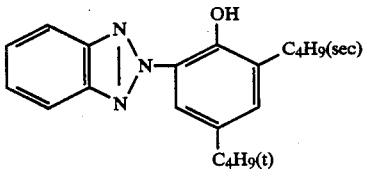
Polymer Cpd-7
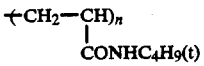
(Mean Molecular Weight 80,000)
Ultraviolet Absorbent UV-1
2:9:8 mixture (weight atio) of:
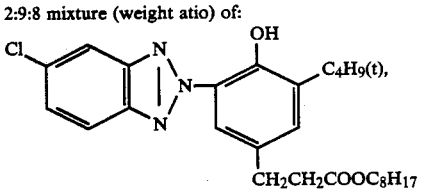

TABLE 19-continued
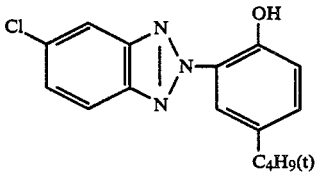
and
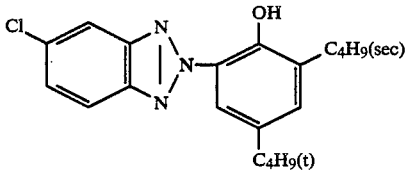
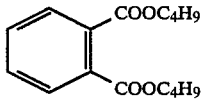
Solvent Solv-1
$O{=}P{\leftarrow}O{-}C_9H_{19}(iso))_3$
Solvent-3
Solvent Solv-4
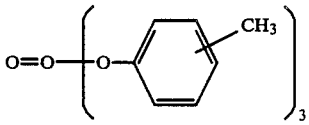
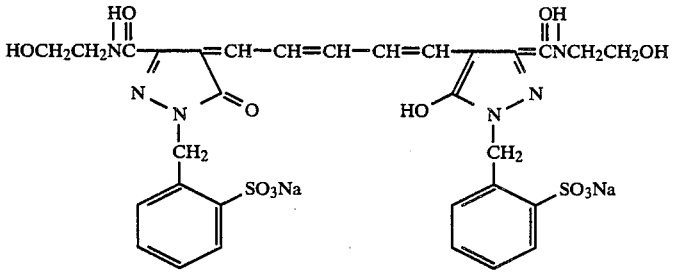
Conpound Ex-3a
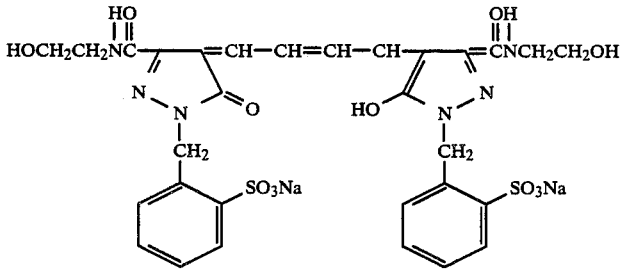
Conpound Ex-3b
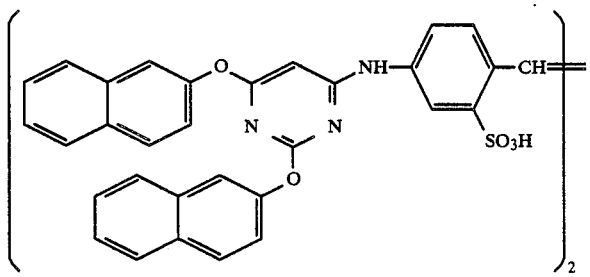
Conpound Ex-3c TABLE 19-continued
| | |
|---|---|
| 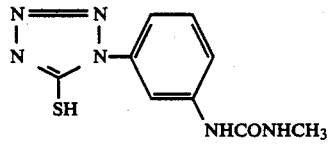 | Conpound Ex-3d |
| 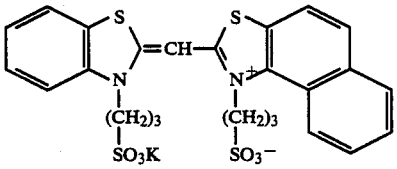 | Ex Dye B |
| 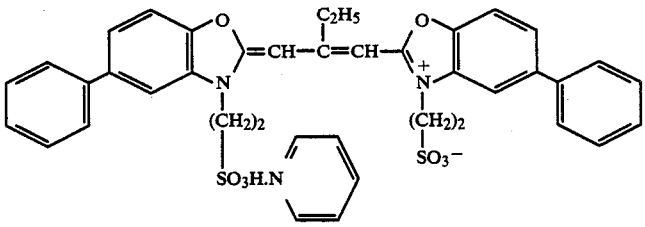 | Ex Dye G |
| 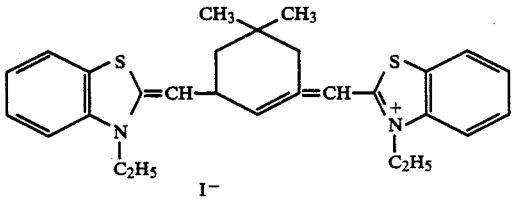 | Ex Dye R |
| 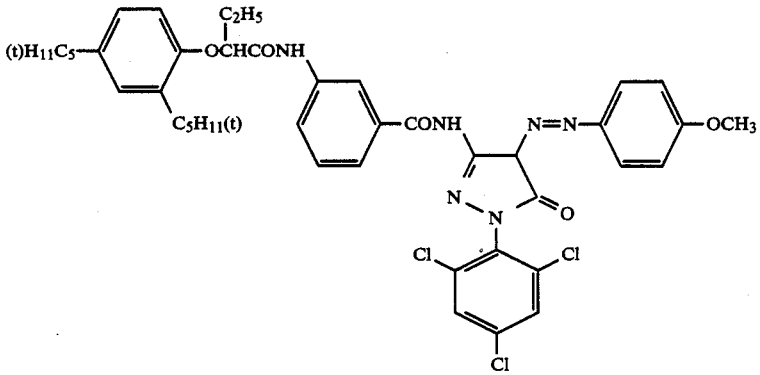 | C-1 |
| 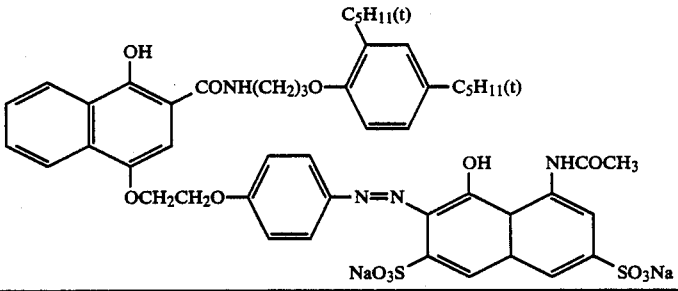 | C-2 |

TABLE 20
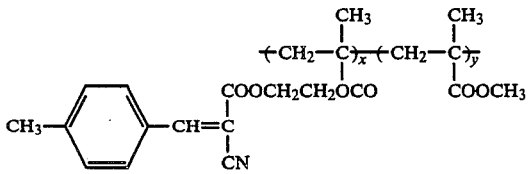
UV-1
x/y = 7/3 (weight ratio)
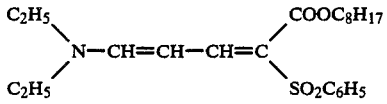
UV-2
tricresyl Phosphate — Oil-1
dibutyl phtalate — Oil -2
bis(2-ethylhexyl)phthalate — Oil-3
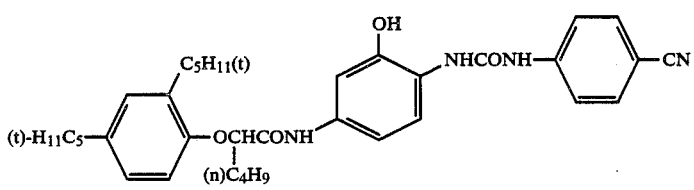
C-3
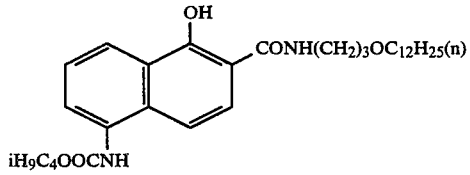
C-4
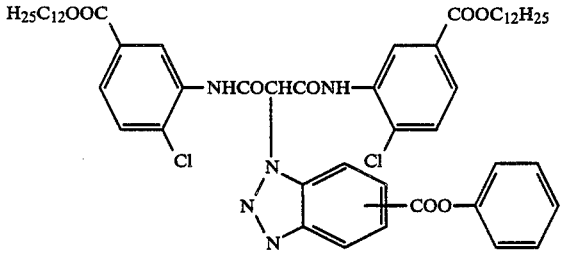
C-5
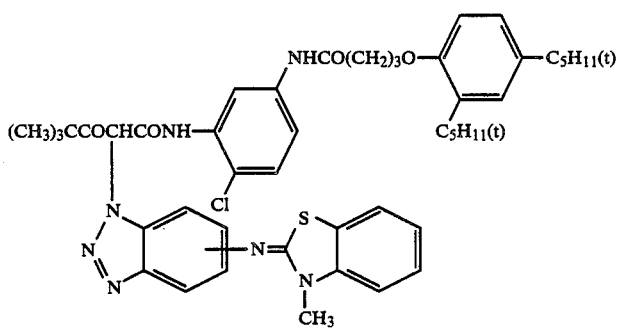
C-15

TABLE 20-continued
C-6
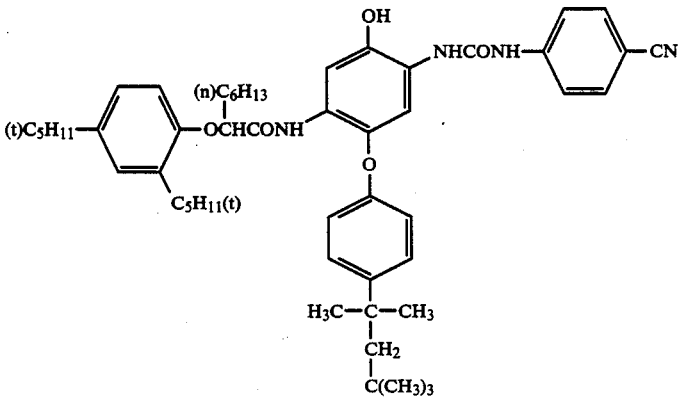
C-7
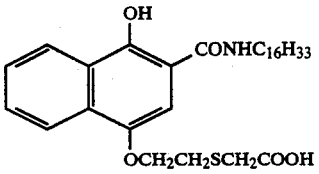
C-8
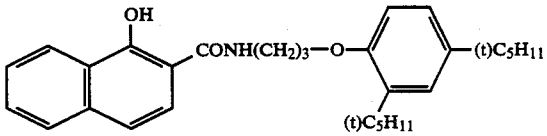
C-9
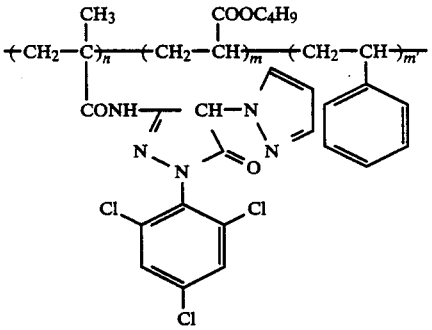
n = 50
m = 25 } (weight ratio)
m' = 25
mol. wt. is about 20,000
C-10
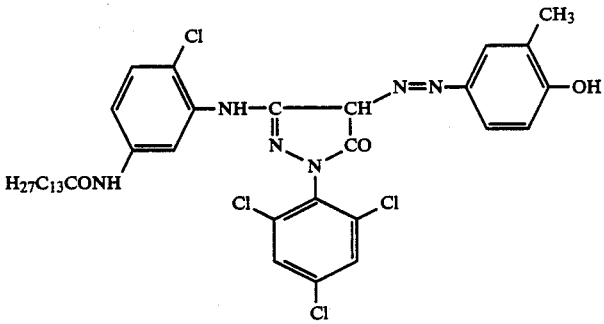

TABLE 20-continued
C-11
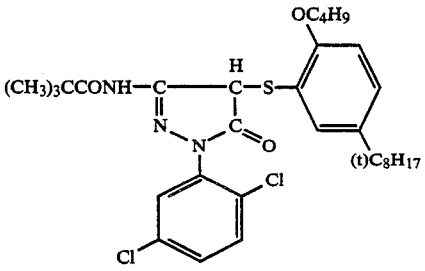
C-12
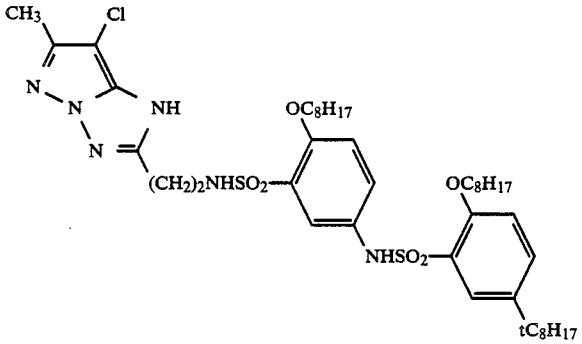
C-13
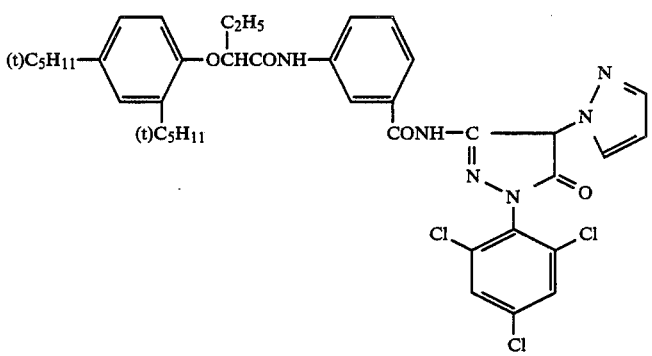
C-14
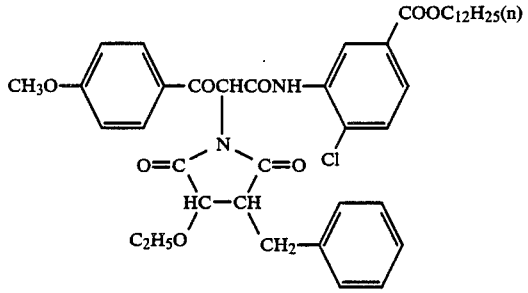
Cpd A
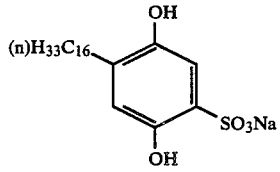
Cpd B
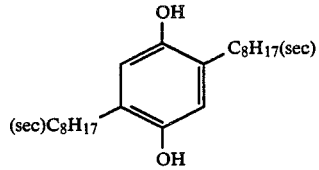

TABLE 20-continued
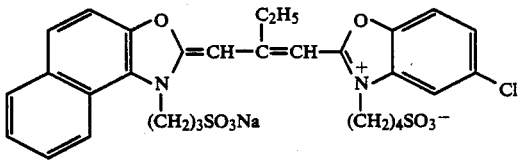
Sensitizing dye I
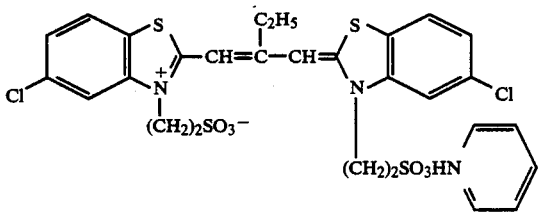
Sensitizing dye II
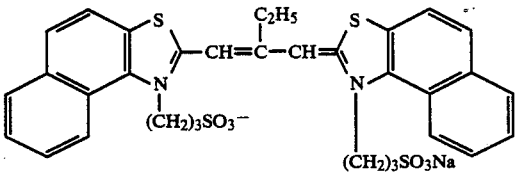
Sensitizing dye III
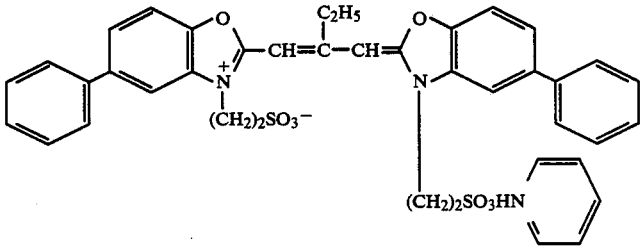
Sensitizing dye IV
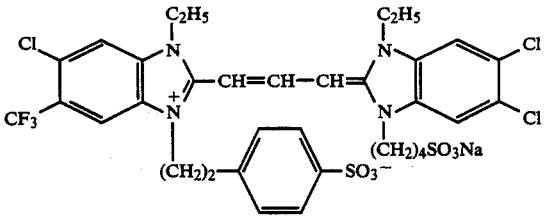
Sensitizing dye V
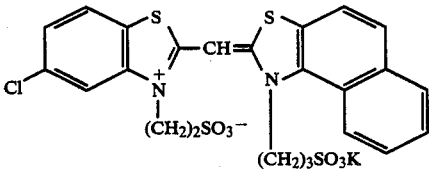
Sensitizing dye VI
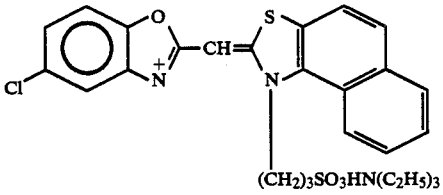
Sensitizing dye VII
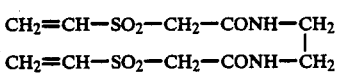
H-1

TABLE 20-continued

| | |
|---|---|
| 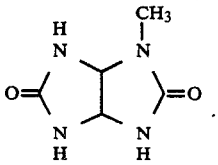 | S-1 |
| 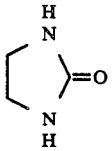 | S-2 |

What is claimed is:

1. A photographic light-sensitive material comprising, on a support, at least one silver halide emulsion layer containing silver halide grains, wherein at least 50% of the total projected surface area of silver halide grains contained in said silver halide emulsion layer is occupied by tabular grains comprising at least about 50 mol % of silver chloride, said tabular grains having been precipitated in the presence of a crystal habit controlling amount of a spectral sensitizing dye before and during nucleation and during precipitation of the silver halide grains, and having an aspect ratio of at least 2 and further wherein nucleation of said silver halide grains has been carried out under a chloride concentration of at least about 0.15 mol/liter.

2. A photographic light-sensitive material according to claim 1, wherein precipitation has been continued in the presence of at least one compound selected from those represented by formulae (I) and (II):

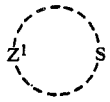

(I)

wherein $Z^1$ represents an atom group which is required for the formation of a saturated or unsaturated heterocyclic ring together with a sulfur atom, and S represents the sulfur atom; and $$R_1—S—(X)_m—Y—R_2 \ldots \text{(II)}$$

wherein X is an organic group having a valency of 2 and including at least one of alkylene, allylene, alkenylene, $$—SO_2—,\ —SO—,\ —O—,\ —S—,\ —\underset{\underset{O}{\|}}{C}—,\ \text{and}\ —\overset{\overset{R^3}{|}}{N}—$$

wherein $R^3$ is selected from the group of hydrogen, a substituted or unsubstituted alkyl group, and a substituted or unsubstituted aryl group;

m is 0 or 1;

$R_1$ is selected from the group of hydrogen, an alkali metal group, an alkali earth metal group, a substituted or unsubstituted alkyl group, a substituted or unsubstituted aryl group, and a substituted or unsubstituted heterocyclic ring including and N, S, or O atom;

$R_2$ is selected from the group of a hydroxyl group, a substituted or unsubstituted alkyl group, a substituted or unsubstituted aryl group, a substituted or unsubstituted heterocyclic ring, a substituted or unsubstituted amino group, an alkoxy group, and an aryloxy group; and Y is selected from the group of —CO— and —$SO_2$—.

3. A photographic light-sensitive material according to claim 1, said tabular grains having been precipitated in a pH range maintained from 2 to 6.

4. A photographic light-sensitive material according to claim 1, wherein said dye is a methine sensitizing dye.

5. A photographic light-sensitive material according to claim 4, wherein said methine sensitizing dye is selected from at least one of cyanine dyes, merocyanine dyes, complex cyanine dyes, complex merocyanine dyes, holopolar cyanine dyes, hemicyanine dyes, styryl dyes, and hemioxonol dyes.

6. A photographic light-sensitive material according to claim 1, said tabular grains having been chemically sensitized in the presence of a sulfur sensitizer.

7. A photographic light-sensitive material according to claim 1, said tabular grains having been chemically sensitized in the presence of a gold sensitizer or a combination of sulfur and gold sensitizers.

8. A photographic light-sensitive material according to claim 1, said tabular grains having been chemically sensitized using at least $5\times10^{-6}$ mol of a gold sensitizer per mol of silver halide.

9. A photographic light-sensitive material according to claim 7, said tabular grains having been chemically sensitized using at least $1.5\times10^{-5}$ mol of gold sensitizer.

10. A photographic light-sensitive material according to claim 7, said tabular grains having been chemically sensitized in the presence of a sulfur sensitizer and at least 250 mol % of gold sensitizer based on the amount of sulfur sensitizer.

11. A photographic light-sensitive material according to claim 1, said tabular grains having been spectrally sensitized by at least one blue spectral sensitizing dye.

12. A photographic light-sensitive material according to claim 1, wherein said tabular grains have an average aspect ratio ranging from 3 to 10.

13. A photographic light-sensitive material according to claim 12, wherein said tabular grains have an aspect ratio ranging from 5 to 7.

14. A photographic light-sensitive material according to claim 1, wherein said dye is a spectral sensitizing dye.

15. A photographic light-sensitive material according to claim 1, wherein said tabular grains contain at least 75 mol % of silver chloride.

16. A photographic light-sensitive material according to claim 15, wherein said tabular grains contain at least 90 mol % of silver chloride.

17. A material according to claim 1, said tabular grains having been spectrally sensitized by at least one of sensitizing dye selected from those represented by formulae (IIIa), (IIIb). and (IIIc):

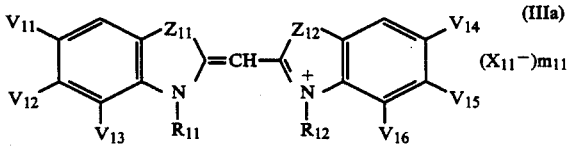

(IIIa)

wherein $Z_{11}$ is selected from the group of oxygen, sulfur, and selenium;

$Z_{12}$ is selected from the group of sulfur and selenium;

$R_{11}$ and $R_{12}$, which may be same or different, are selected from the group of an alkyl having up to and including six carbon atoms and an alkenyl having up to and including six carbon atoms;

$V_{11}$ and $V_{14}$, which may be same or different, are selected from the group of hydrogen, an alkyl having up to and including four carbon atoms and an alkoxy having up to and including four carbon atoms;

$V_{12}$ and $V_{15}$, which may be the same or different, are selected from the group of, an aklyl having up to and including five carbon atoms, an alkoxy having up to and including four carbon atoms, chlorine, hydrogen, substituted or unsubstituted phenyl, and hydroxyl;

$V_{13}$ and $V_{16}$ are hydrogen, and any of $V_{11}$ and $V_{12}$, $V_{12}$ and $V_{13}$, $V_{14}$ and $V_{15}$, and $V_{15}$ and $V_{16}$ can be coupled to form a condensed benzene ring;

$X^-_{11}$ is an anion residue of acid; and $m_{11}$ is 0 or 1;

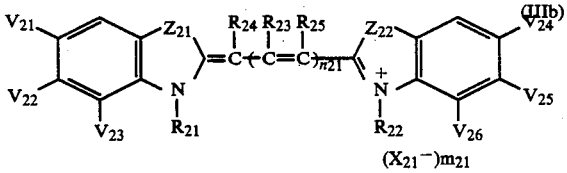

(IIIb)

wherein $Z_{21}$ and $Z_{22}$, which may be the same or different, are selected from the group of oxygen, sulfur, selenium, and >N-$R_{26}$;

$R_{21}$, $R_{22}$, $R_{26}$ and $R_{27}$, which may be the same or different, are selected from the group of an alkyl having up to and including six carbon atoms, and an alkenyl having up to and including six carbon atoms;

$R_{23}$ is selected from the group of hydrogen, a lower alkyl, a lower phenethyl, or a combination thereof to form a 5- or 6-membered ring;

$R_{24}$ and $R_{25}$ are hydrogen, and any of $R_{21}$ and $R_{24}$, and $R_{22}$ and $R_{25}$ may be coupled to form a 5- or 6-membered carbon ring;

$V_{21}$ and $V_{24}$, which may be the same or different, are selected from the group of hydrogen, an alkyl having up to and including five carbon atoms, an alkoxy having up to and including five carbon atoms, and chlorine;

$V_{22}$ and $V_{25}$, which may be the same or different, are selected from the group of hydrogen, an alkyl having up to and including five carbon atoms, an alkoxy having up to and including five carbon atoms, chlorine, a substituted or unsubstituted phenyl, an alkoxycarbonyl having up to and including five carbon atoms, an acylamino having up to and including four carbon atoms, a trifluoromethyl, a cyano, and an alkylsulfonyl having up to and including four carbon atoms;

$V_{23}$ and $V_{26}$ are hydrogen, and $V_{22}$ can be coupled to $V_{21}$ or $V_{23}$ to form a condensed benzene ring, and $V_{25}$ can be coupled to $V_{24}$ to $V_{26}$ to form a condensed benzene ring;

$X^-_{21}$ is an anion residue of acid;

$m_{21}$ is 0 or 1; and $n_{21}$ is 1, 2, or 3;

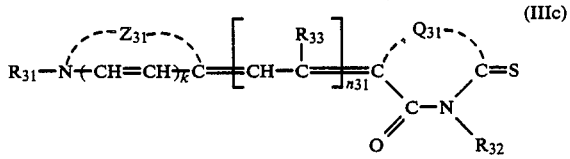

(IIIc)

wherein $Z_{31}$ is an atom group required for forming substituted or unsubstituted nuclei of a member selected from the group of thiazoline, thiazole, benzothiazole, naphtholthiazole, selenazoline, selenazole, benzoselenazole, naphthoselenazole, benzmidazole, naphthoimidazole, oxazole, benzoxazole, naphthooxazole, and pyridine;

$R_{31}$ is selected from the group of an alkyl having up to and including six carbon atoms and an alkenyl having up to and including six carbon atoms;

$R_{32}$ *is selected from the group of an alkyl having up to and including six carbon atoms, an alkenyl having up to and including six carbon atoms, hydrogen, a furfuryl, and a monocyclic aryl;*

$R_{33}$ is selected from the group of an alkyl having up to and including five carbon atoms, a phenethyl, a phenyl, a 2-carboxyphenyl, and coupled combinations thereof to form a 5- or 6-membered ring;

$Q_{31}$ *is selected from the group of oxygen, sulfur, selenium, and* >N-$R_{34}$ wherein $R_{34}$ is selected from the group of hydrogen, pyridl, phenyl, substituted phenyl, and an aliphatic hydrocarbon group having up to and including eight carbon atoms and which may contain at least one of oxygen, sulfur, or nitrogen in a carbon chain;

k is 0 or 1; and $n_{31}$ *is* 0, 1, or 3.

18. A photographic light-sensitive material according to claim 1, containing at least one compound having a mercapto group represented by formula (IV):

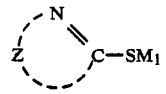

(IV)

wherein, $M_1$ represents hydrogen, a cation, or a protective group for mercapto, which is cleaved by alkali; and Z represents an atom group for forming a 5- or 6-membered heterocyclic ring.

19. A photographic light-sensitive material according to claim 1, wherein said photographic light-sensitive material contains at least one yellow coupler, at least one magenta coupler, and at least one cyan coupler.

20. A photographic light-sensitive material according to claim 1, comprising at least one blue-sensitive silver halide emulsion layer containing a yellow coupler, at least one green-sensitive silver halide emulsion layer containing a magenta coupler, and at least one red-sensitive silver halide emulsion layer containing a cyan coupler.

21. A method of developing a photographic light-sensitive material comprising color-developing the photographic light-sensitive material in the presence of a color coupler, said photographic light-sensitive material comprising, on a support, at least one silver halide emulsion layer containing silver halide grains, wherein at least 50% of the total projected surface area of silver halide grains contained in said silver halide emulsion layer is occupied by tabular grains comprising at least about 50 mol % of silver chloride, said tabular grains having been precipitated in the presence of a crystal habit controlling amount of a spectral sensitizing dye before and during nucleation and during precipitation of the silver halide grains, and having an aspect ratio of at least 2 and further wherein nucleation of said silver halide grains has been carried out under a chloride concentration of at least about 0.15 mol/liter.

22. A method according to claim 21, wherein color development is performed using a p-phenylenediamine color developing agent.

23. A method according to claim 21, wherein color development is performed using a color developer substantially free of iodide ions.

24. A method according to claim 21, wherein color development is performed using a color developer substantially free of sulfite ions.

25. A method according to claim 21, wherein color development is continuously performed using a color developer in which a concentration of bromide ion is not more than $1.0\times10^{-2}$ mol/l.

26. A method according to claim 21, wherein bleach-fixing is performed after color development.

27. A method according to claim 21, wherein processing, from color development to drying, is completed within 120 seconds.

28. A photographic light-sensitive material comprising, on a support, at least one silver halide emulsion layer containing silver halide grains, wherein at least 50% of the total projected area of silver halide grains contained in said silver halide emulsion layer is occupied by tabular grains comprising at least about 50 mol % of silver chloride, said tabular grains having been prepared in the presence of a crystal habit controlling amount of a spectral sensitizing dye before and during nucleation and during precipitation of the silver halide grains, and having an aspect ratio of at least 2.

29. A photographic light-sensitive material according to claim 28, said nucleation of silver halide grains having been carried out at a chloride concentration of about 0.05 mol/l or more.

* * * * *